US012258670B2

(12) United States Patent
Li et al.

(10) Patent No.: US 12,258,670 B2
(45) Date of Patent: Mar. 25, 2025

(54) ENHANCED ELECTROSYNTHESIS OF OXIRANES

(71) Applicant: THE GOVERNING COUNCIL OF THE UNIVERSITY OF TORONTO, Toronto (CA)

(72) Inventors: Yuhang Li, Toronto (CA); Adnan Ozden, Toronto (CA); Wan Ru Leow, Toronto (CA); Pengfei Ou, Toronto (CA); Edward Sargent, Toronto (CA)

(73) Assignee: THE GOVERNING COUNCIL OF THE UNIVERSITY OF TORONTO, Toronto (CA)

( * ) Notice: Subject to any disclaimer, the term of this patent is extended or adjusted under 35 U.S.C. 154(b) by 0 days.

(21) Appl. No.: 18/086,356

(22) Filed: Dec. 21, 2022

(65) Prior Publication Data

US 2023/0220565 A1 Jul. 13, 2023

Related U.S. Application Data

(60) Provisional application No. 63/265,897, filed on Dec. 22, 2021.

(51) Int. Cl.

| | |
|---|---|
| ***C25B 3/07*** | (2021.01) |
| ***C25B 3/03*** | (2021.01) |
| ***C25B 3/23*** | (2021.01) |
| ***C25B 3/25*** | (2021.01) |
| ***C25B 11/031*** | (2021.01) |
| ***C25B 11/032*** | (2021.01) |
| ***C25B 11/051*** | (2021.01) |

(Continued)

(52) U.S. Cl.

CPC ..... *C25B 3/07* (2021.01); *C25B 3/03* (2021.01); *C25B 3/23* (2021.01); *C25B 3/25* (2021.01); *C25B 11/031* (2021.01); *C25B 11/032* (2021.01); *C25B 11/051* (2021.01); *C25B 11/054* (2021.01); *C25B 11/093* (2021.01); *C25B 13/00* (2013.01)

(58) Field of Classification Search

None

See application file for complete search history.

(56) References Cited

U.S. PATENT DOCUMENTS

2007/0034505 A1* 2/2007 Ikematsu ..... C25B 1/13 427/372.2

2019/0032228 A1 1/2019 Krause

OTHER PUBLICATIONS

"Bio-Mono Ethylene Glycol (MEG) from renewable source—an India Glycols Limited case study," (International Council of Chemical Associations, (2017).

(Continued)

*Primary Examiner* — Guinever S Gregorio

(74) *Attorney, Agent, or Firm* — PABST PATENT GROUP LLP

(57) ABSTRACT

Electrosynthesis of oxirane can include contacting a halide electrolyte with an anode that includes an electrocatalyst comprising iridium oxide loaded with a period-6 metal oxide and provided on a metal substrate. The cathode can be operated under ORR conditions. The electrochemical system can also be provided as an integrated system that includes $CO_2$ electroreduction to produce ethylene and formation of hypochlorous acid using the electrocatalyst, followed by contact of the ethylene and the hypochlorous acid to form ethylene chlorohydrin which is, in turn, contacted with $OH^-$ ions to produce oxirane.

20 Claims, 52 Drawing Sheets

(51) Int. Cl.

| | |
|---|---|
| ***C25B 11/054*** | (2021.01) |
| ***C25B 11/093*** | (2021.01) |
| ***C25B 13/00*** | (2006.01) |

(56) References Cited

OTHER PUBLICATIONS

"Energy use in industry," Use of energy explained (U.S. Energy Information Administration, 2019).
"Ethylene Oxide Production by Nippon Shokubai Process," PEP Review Dec. 2010 (IHS Markit, 2010).
"Market Analytics: Propylene Oxide—2018," Markets & Profitability (Nexant, Inc., 2018).
"Ethylene oxide (EO) prices and information", (ICIS Ltd., 2011). https://www.icis.com/explore/resources/news/2007/11/05/9075771/ethylene-oxide-eo-prices-and-pricing-information/.
Bajada, et al., "A precious-metal-free hybrid electrolyzer for alcohol oxidation coupled to CO2-to-syngas conversion", Angew. Chem. Int. Ed., 59:15633-15641 (2020).
Barton, "Electrification of the chemical industry", Science, 368:1181-1182 (2020).
Boulamanti, et al., "Energy efficiency and GHG emissions: Prospective scenarios for the chemical and petrochemical industry", DOI: 10.2760/630308 (2017).
Bushuyev, et al., "What should we make with CO2 and how can we make it?", Joule, 2:825-832 (2018).
Carrillo, et al., "Revisiting the BaO2/BaO redox cycle for solar thermochemical energy storage", Phys. Chem. Chem. Phys. ,18:8039-8048 (2016).
Cha, et al., "Combined biomass valorization and hydrogen production in a photoelectrochemical cell", Nat. Chem., 7:328 (2015).
Chu, et al., "The path towards sustainable energy", Nat. Mater., 16(1):16-22 (2016).
Chung, et al., "Mechanism of chlorinemediated electrochemical ethylene oxidation in saline water", ACS Catal., 10:14015-14023 (2020).
Dai, et al., "Electrochemical production of lactic acid from glycerol oxidation catalyzed by AuPt nanoparticles", J. Catal., 356:14-21 (2017).
De Luna, et al., "What would it take for renewably powered electrosynthesis to displace petrochemical processes?", Science, 364:eaav3506 (2019).
Dudley, "Renewable Energy Costs Take Another Tumble, Making Fossil Fuels Look More Expensive Than Ever," (Forbes, 2019).
Eigen, et al., "The Kinetics of Halogen Hydrolysis", Journal of the American Chemical Society, 84:1355-1361 (1962).
Grimme, et al., "A consistent and accurate ab initio parametrization of density functional dispersion correction (DFT-D) for the 94 elements H—Pu", J. Chem. Phys., 132:154104 (2010).
Horn, et al., "Scalable and sustainable electrochemical allylic C—H oxidation", Nature, 533:77 (2016).
Huang, et al., "Boosting Hydrogen Production by Anodic Oxidation of Primary Amines over a NiSe Nanorod Electrode", Angew. Chem. Int. Ed., 57:13163-13166 (2018).
Huang, et al., "Integrating Hydrogen Production with Aqueous Selective Semi-Dehydrogenation of Tetrahydroisoquinolines over a Ni2P Bifunctional Electrode.", Angew. Chem. Int. Ed., 58:12014-12017 (2019).
International Energy Agency, Direct CO2 emissions from primary chemical production in the sustainable development scenario, 2015-2030, IEA, Paris. https://www.iea.org/data-and-statistics/charts/direct-co2-emissions-from6045535167 ROBIC 100 095552/0002 primary-chemical-production-in-the-sustainable-development-scenario-2015-2030.
Israel, et al., "The kinetics of chlorohydrin formation. Part I. The reaction between hypochlorous acid and allyl alcohol in aqueous solution", J. Chem. Soc., 1282-1285 (1950).
Jiang, et al.., "Integrating Electrocatalytic 5-Hydroxymethylfurfural Oxidation and Hydrogen Production via Co—P-Derived Electrocatalysts", ACS Energy Lett., 1:386-390 (2016).
Jouny, et al., "General Techno-Economic Analysis of CO2 Electrolysis Systems", Ind. Eng. Chem. Res., 57:2165-2177 (2018).
Kohn, et al., "Self-consistent equations including exchange and correlation effects", Phys. Rev., 140:A1133-A1138 (1965).
Kresse, et al., "Efficient iterative schemes for ab initio total-energy calculations using a plane-wave basis set", Phys. Rev. B, 54:11169-11186 (1996).
Kresse, et al., "From ultrasoft pseudopotentials to the projector augmented-wave method", Phys. Rev. B, 59:1758-1775 (1999).
Kwon, et al., "Highly Selective Electro-Oxidation of Glycerol to Dihydroxyacetone on Platinum in the Presence of Bismuth", ACS Catal., 2:759-764 (2012).
Leow, et al., "Chloride-mediated selective electrosynthesis of ethylene and propylene oxides at high current density", Science, 368:1228-1233 (2020).
Li, et al., "Electrolytic CO2 reduction in tandem with oxidative organic chemistry", ACS Cent. Sci., 3:778-783 (2017).
Li, et al., "Molecular tuning of CO2-to-ethylene conversion", Nature, 577:509-513 (2020).
Liu, et al., "Selective photoelectrochemical oxidation of glycerol to high value-added dihydroxyacetone", Nat. Commun., 10:1779 (2019).
Llorente, et al., "Paired electrolysis in the simultaneous production of synthetic intermediates and substrates", J. Am. Chem. Soc., 138:15110-15113 (2016).
Luc, et al., "An Ir-based anode for a practical CO2 electrolyzer", Catal. Today, 288:79-84 (2017).
Lum, et al., "Tuning OH binding energy enables selective electrochemical oxidation of ethylene to ethylene glycol", Nat. Catal., 3:14-22 (2020).
Mccabe, et al., "The Kinetics of the Reaction between the Ethylene Halohydrins and Hydroxyl Ion in Water and Mixed Solvents1a", Journal of the American Chemical Society, 70:4031-4034 (1948).
Monkhurst, et al., "Special points for Brillouin-zone integrations", Phys. Rev. B, 13: 5188-5192 (1976).
Neugebauer, et al., "Adsorbate-substrate and adsorbateadsorbate interactions of Na and K adlayers on Al(111)", Phys. Rev. B, 46(24):16067-16080 (1992).
Nikolaeva, et al., "Interaction between barium oxide and barium containing chloride melt", Z. Naturforsch., 70:325-331 (2015).
Perez-Gallent, et al., "Electroreduction of CO2 to CO paired with 1,2-propanediol oxidation to lactic acid. toward an economically feasible system", Ind. Eng. Chem. Res., 58:6195-6202 (2019).
Rafiee, et al., "Electrocatalytic Alcohol Oxidation with TEMPO and Bicyclic Nitroxyl Derivatives: Driving Force Trumps Steric Effects", J. Am. Chem. Soc., 137:14751-14757 (2015).
Rafiee, et al., "Nydroxyphthalimide-Mediated Electrochemical Iodination of Methylarenes and Comparison to Electron-Transfer-Initiated C—H Functionalization", J. Am. Chem. Soc., 140:22-25 (2018).
Rebsdat, et al., "Ethylene Oxide", Ullmann's Encyclopedia of Industrial Chemistry (2001).
Seh, et al., "Combining theory and experiment in electrocatalysis: Insights into materials design", Science, 355:eaad4998 (2017).
Service, "Renewable bonds", Science, 365:1236-1239 (2019).
Sherbo, et al., "Complete electron economy by pairing electrolysis with hydrogenation", Nat. Catal., 1:501-507 (2018).
Tachikawa, et al., "Relationship between OER activity and annealing temperature of sputter-deposited flat IrO2 thin films", Catal. Lett., 150:1976-1984 (2020).
Touni, et al., "Oxygen evolution reaction at IrO2/Ir(Ni) film electrodes prepared by galvanic replacement and anodization: effect of precursor Ni film thickness", Molecules, 24:2095 (2019).
Van Geem, et al., "Making chemicals with electricity", Science, 364:734-735 (2019).
Wang, et al., "Simultaneous electrosynthesis of syngas and an aldehyde from CO2 and an alcohol by molecular electrocatalysis", ACS Appl. Energy Mater. , 2:97-101 (2019).
Winiwarter, et al., "Towards an atomistic understanding of electrocatalytic partial hydrocarbon oxidation: propene on palladium", Energy Environ. Sci., 12:1055-1067 (2019).

(56) References Cited

OTHER PUBLICATIONS

Wismann, et al., "Electrified methane reforming: a compact approach to greener industrial hydrogen production", Science, 364:756-759 (2019).
Xia, et al., "Direct electrosynthesis of pure aqueous H202 solutions up to 20% by weight using a solid electrolyte", Science, 366:226-231 (2019).
You, et al., "Simultaneous H2 Generation and Biomass Upgrading in Water by an Efficient Noble-Metal-Free Bifunctional Electrocatalyst", Angew. Chem. Int. Ed., 55(34): 9913-9917 (2016).
Zheng, et al., "Hierarchical Porous NC@CuCo Nitride Nanosheet Networks: Highly Efficient Bifunctional Electrocatalyst for Overall Water Splitting and Selective Electrooxidation of Benzyl Alcohol", Adv. Funct. Mater., 27:1704169 (2017).
Zheng, et al., "Strategies to reduce the global carbon footprint of plastics", Nat. Clim. Change, 9:374-378 (2019).
Zhou, et al., "Highly efficient binary copper-iron catalyst for photoelectrochemical carbon dioxide reduction toward methane", Proc. Natl. Acad. Sci., 117:1330-1338 (2020).
Zhuang, et al., "Dopant-tuned stabilization of intermediates promotes electrosynthesis of valuable C3 products", Nat. Commun., 10(1):4807 (2019).

* cited by examiner

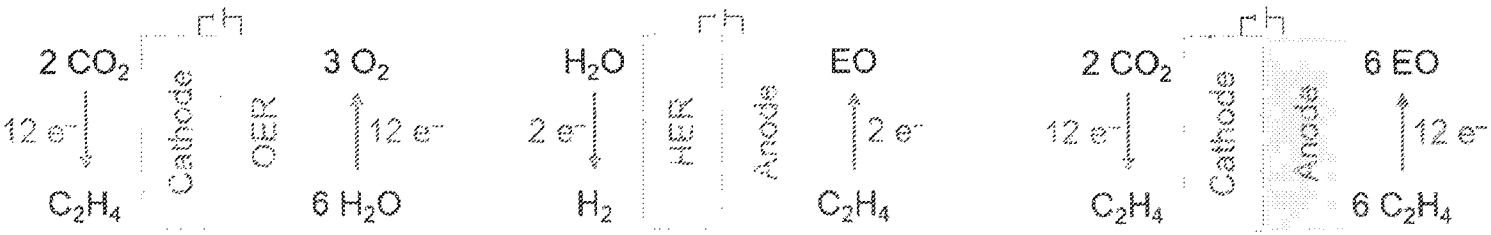
Two independent electrolyzers
Power loss to OER and HER
Fig. 33A
One electrolyzer
Upper limit of ~17% EO FE
Fig. 33B
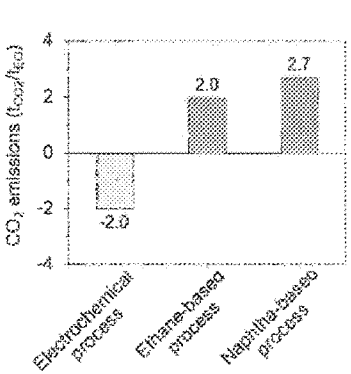
Fig. 34B
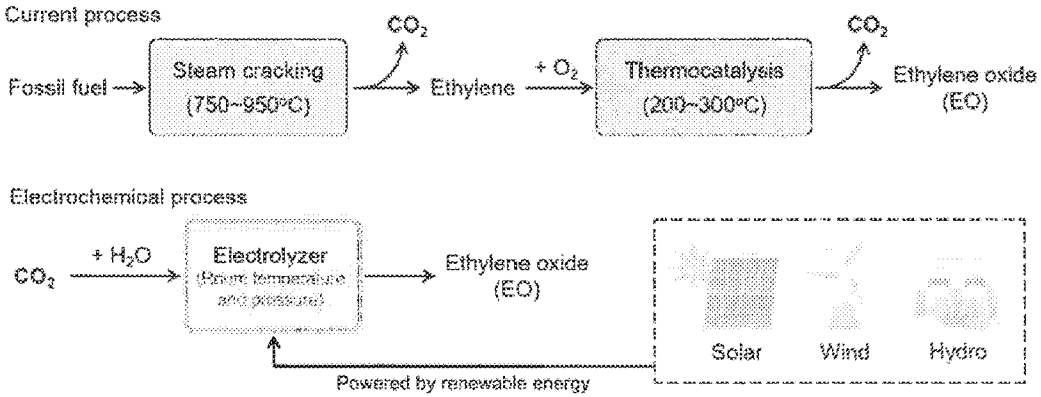
Fig. 34A

ENHANCED ELECTROSYNTHESIS OF OXIRANES

CROSS REFERENCE TO RELATED APPLICATION

Priority is claimed to U.S. provisional application Ser. No. 63/265,897 filed Dec. 22, 2021 by the Governing Council of the University of Toronto entitled "ENHANCED ELECTROSYNTHESIS OF OXIRANES".

TECHNICAL FIELD

The technical field generally relates to the synthesis of oxiranes, and more particularly to techniques for the electrocatalytic conversion of olefins into oxiranes where the olefins can be electrocatalytically produced from $CO_2$.

BACKGROUND

Oxirane is used in the manufacture of plastics, detergents, thickeners and solvents, and is among the world's top fifteen most produced chemicals at about 20 million metric tons per annum. At present, it is manufactured via the thermocatalytic partial oxidation of ethylene at high temperature and pressure, e.g., 200-300° C. and 1-3 MPa, generating 1.6 tons of $CO_2$ per ton oxirane produced. There are a number of drawbacks and challenges with respect to the production of oxiranes.

SUMMARY

In some implementations, there is provided an electrocatalyst for selective anodic oxidation of an olefin reactant to produce ethylene halohydrin in a halide ion based electrolyte, the electrocatalyst comprising iridium oxide loaded with a period-6 metal oxide and provided on a substrate. The period-6 metal oxide can include barium oxide, lanthanum oxide, cerium oxide, or bismuth oxide or a combination thereof. The substrate can be composed of metal, carbon or ceramic, and is optionally in the form of a mesh, felt, foam, or cloth. The halide ion can include Cl and the halide ion based electrolyte can be an aqueous KCl electrolyte.

In some implementations, the substrate is metal and optionally comprises titanium; or the substrate comprises carbon; or the substrate comprises porous ceramic; and wherein the substrate is optionally in the form of a mesh, felt, foam, or cloth. In some implementations, the iridium oxide is provided as particles on the metal substrate. In some implementations, the iridium oxide is provided as nanoparticles on the metal substrate. In some implementations, the substrate is in the form of a network of filaments defining openings, and the iridium oxide and period-6 metal oxide is deposited on the filaments and also forms a catalytic web extending across the openings In some implementations, the substrate is a titanium mesh. In some implementations, the halide ion comprises Cl and the halide ion based electrolyte is an aqueous KCl electrolyte. In some implementations, the period-6 metal oxide has a loading between 0.5 wt % and 5 wt % with respect to the iridium oxide. In some implementations, the period-6 metal oxide has a loading between 1 wt % and 4 wt % with respect to the iridium oxide. In some implementations, the period-6 metal oxide has a loading between 2 wt % and 3.5 wt % with respect to the iridium oxide.

In some implementations, there is provided a method of manufacturing an electrocatalyst, comprising depositing iridium oxide onto a substrate to form an iridium oxide layer and loading a period-6 metal oxide with respect to the iridium oxide layer to form a loaded catalytic material. The substrate can be pre-treated via etching following by application of the iridium and period-6 metal compounds which can be performed by soaking in a solution followed by drying and sintering. Multiple cycles of soaking, drying and sintering can be performed unit a desired loading of the catalytic material is obtained.

In some implementations, the loading is performed to provide between 0.5 wt % and 5 wt % loaded period-6 metal oxide with respect to the iridium oxide layer. In some implementations, the method further includes pre-treating the substrate prior to depositing the iridium oxide thereon. In some implementations, the pre-treating comprises etching. In some implementations, the etching is performed in an HCl solution, optionally at a temperature between 50° C. and 85° C. for an etching time between 20 min and 60 min. In some implementations, the deposition of the iridium oxide and the loading of the period-6 metal oxide comprise one or more soaking stages, optionally including soaking the substrate in a soaking solution comprising iridium (IV) oxide dehydrate and a period-6 metal salt. In some implementations, the period-6 metal salt comprises a period-6 metal chloride dihydrate. In some implementations, the soaking solution further comprises HCl and isopropanol. In some implementations, the method further includes, after each soaking stage, a drying stage followed by a sintering stage. In some implementations, the drying stage is performed at a drying temperature between 100° C. and 140° C. In some implementations, the sintering stage is performed at a sintering temperature of at least 450° C. In some implementations, the soaking, drying and sintering stages are repeated for multiple cycles until a target loading is achieved for the loaded catalytic material that comprises the iridium oxide and the period-6 metal oxide. In some implementations, the target loading of the catalytic material is at least 2 $mg/cm^2$. In some implementations, the period-6 metal oxide has a loading between 0.5 wt % and 5 wt %, between 1 wt % and 4 wt %, or between 2 wt % and 3.5 wt %, in the loaded catalytic material.

In some implementations, there is provided an electrocatalyst for selective anodic oxidation of an olefin reactant to produce ethylene halohydrin in a halide ion based electrolyte, the electrocatalyst comprising a primary metal catalyst associated with an HO-halide-cleavage inhibitor and provided on a substrate. The HO-halide-cleavage inhibitor can include a period-6 metal oxide, and the primary metal catalyst comprises iridium oxide, cobalt oxide, platinum, platinum oxide, palladium or palladium oxide.

In some implementations, the HO-halide-cleavage inhibitor comprises a period-6 metal oxide. In some implementations, the HO-halide-cleavage inhibitor is loaded in the primary metal catalyst. In some implementations, the primary metal catalyst comprises iridium oxide, cobalt oxide, platinum, platinum oxide, palladium or palladium oxide. In some implementations, the halide in the halide ion based electrolyte is Cl, the HO-halide-cleavage inhibitor is an HOCl— cleavage inhibitor, and the ethylene halohydrin is ethylene chlorohydrin. In some implementations, the period-6 metal oxide has a loading between 0.5 wt % and 5 wt %, between 1 wt % and 4 wt %, or between 2 wt % and 3.5 wt %, in the primary metal catalyst. In some implementations, the substrate comprises a metal substrate or a material that is stable and corrosion resistant under oxidative conditions, optionally wherein the substrate comprises titanium, carbon or ceramic that is in the form of a mesh, felt, foam, or cloth. In some implementations, the substrate is titanium.

In some implementations, there is provided an electrochemical process for producing oxirane from olefin reactants, comprising: contacting a halide based electrolyte with an anode located in an anodic compartment, the anode optionally comprising the electrocatalyst as described herein or as manufactured using the method as described herein; generating a source of $OH^-$ at a cathode in a cathodic compartment; contacting olefin reactants with the electrolyte to generate ethylene halohydrin; and contacting the ethylene halohydrin with a solution comprising $OH^-$ ions to form oxirane.

In some implementations, the olefin reactants are contacted with the electrolyte withdrawn from the anodic compartment. In some implementations, the solution comprising $OH^-$ ions and contacted with the ethylene halohydrin is obtained from the cathodic compartment. In some implementations, the olefin reactants comprise ethylene or propylene or a combination thereof. In some implementations, the halide based electrolyte is Cl based and the ethylene halohydrin comprises ethylene chlorohydrin. In some implementations, the halide based electrolyte is an aqueous KCl solution. In some implementations, the halide based electrolyte is Br based. In some implementations, the halide based electrolyte is provided at a concentration of about 1.5 to 2.5 M. In some implementations, the halide based electrolyte is provided at a concentration of about 1.8 to 2.2 M. In some implementations, the anodic compartment and the cathodic compartment are separated by an anion or a cation exchange membrane. In some implementations, the anodic compartment and the cathodic compartment are clamped together and have spacers. In some implementations, the cathode is composed of platinum supported carbon on PTFE. In some implementations, the cathode is in contact with air and an aqueous liquid. In some implementations, some or all of the olefin reactants are generated by a $CO_2$-to-ethylene membrane electrode assembly. In some implementations, the $CO_2$-to-ethylene membrane electrode assembly comprises a copper based cathode and an anode provided for OER.

In some implementations, there is provided an electrochemical system for producing oxirane from olefin reactants, comprising:

an electrochemical flow cell comprising:
- an anodic compartment having an anode provided therein,
- an electrolyte inlet for receiving a halide based electrolyte, and
- an electrolyte outlet for expelling the electrolyte, wherein the anode comprises the electrocatalyst as described herein or as manufactured using the method as described herein;
- a cathodic compartment having a cathode provided therein,
- a catholyte inlet for receiving a catholyte, and
- an outlet for expelling a basic solution comprising $OH^-$ ions; and
- an ion exchange membrane between the anodic and cathodic compartments; and a first mixing region configured to receive at least a portion of the electrolyte from the anodic compartment and a source of olefin reactant to form ethylene halohydrin; and a second mixing region configured to receive the ethylene halohydrin and at least a portion of the basic solution from the cathodic compartment, to provide conditions to react ethylene halohydrin with $OH^-$ to produce oxirane.

In some implementations, the cathodic compartment is configured so that the cathode is in contact with air on a first side and the catholyte on a second side. In some implementations, the cathodic compartment and the anodic compartment are separated by an anion exchange membrane. In some implementations, some or all of the olefin reactants are generated by a $CO_2$-to-ethylene membrane electrode assembly. In some implementations, the $CO_2$-to-ethylene membrane electrode assembly has a cathodic region receiving humidified $CO_2$ gas, and an anodic region receiving an aqueous liquid. In some implementations, there is provided an electrochemical system for producing oxirane from olefin reactants, the system comprising an anodic compartment having an anode provided therein and comprising an electrocatalyst as defined herein or as manufactured using the method as defined herein.

In some implementations, there is provided an electrochemical system for producing oxirane from olefin reactants, the system comprising an anodic compartment having an anode provided therein and comprising an electrocatalyst as described herein.

In some implementations, there is provided a use of the electrocatalyst as described herein or as manufactured using the method as described herein, in an anodic compartment of an electrochemical cell for contacting a halide based electrolyte and generating hypochlorous acid. In some implementations, the hypochlorous acid is contacted with ethylene to form ethylene chlorohydrin which is contacted with $OH^-$ to form oxirane.

In some implementations, there is provided an electrochemical process for producing oxirane from olefin reactants, comprising: contacting a chloride based electrolyte with an anode located in an anodic compartment, to generate hypochlorous acid; contacting a catholyte with a cathode located in a cathodic compartment under oxygen reduction reaction (ORR) conditions; contacting olefin reactants with at least a portion of the hypochlorous acid to generate ethylene chlorohydrin; and converting at least a portion of the ethylene chlorohydrin to oxirane.

In some implementations, the process further includes withdrawing the chloride based electrolyte from the anodic compartment and contacting the electrolyte with the olefin reactants to form an anodic solution comprising the ethylene chlorohydrin. In some implementations, the process further includes withdrawing a loaded cathodic solution comprising $OH^-$ ions from the cathodic compartment and mixing the anodic solution with the loaded cathodic solution to react the ethylene chlorohydrin with the $OH^-$ to produce the oxirane. In some implementations, the cathode comprises a cathodic electrocatalyst comprising platinum supported carbon. In some implementations, the anode comprises an electrocatalyst that comprises iridium oxide, cobalt oxide, platinum, platinum oxide, palladium or palladium oxide. In some implementations, the electrocatalyst is as defined herein or as manufactured using the method as defined herein. In some implementations, the cathodic compartment is configured so that the cathode is in contact with air on a first side and the catholyte on a second side, the catholyte optionally comprising water.

In some implementations, there is provided an electrochemical system for producing oxirane from olefin reactants, comprising:

an electrochemical flow cell comprising:

an anodic compartment having an anode provided therein, an electrolyte inlet for receiving a halide based electrolyte, and an electrolyte outlet for expelling the electrolyte;

a cathodic compartment having a cathode provided therein, a catholyte inlet for receiving a catholyte, and an outlet for expelling a basic solution comprising $OH^-$ ions, and being configured to operate under oxygen reduction reaction (ORR) conditions; and an ion exchange membrane between the anodic and cathodic compartments; and a first mixing region configured to receive at least a portion of the electrolyte from the anodic compartment and a source of olefin reactant to form ethylene halohydrin; and a second mixing region configured to receive the ethylene halohydrin and at least a portion of the basic solution from the cathodic compartment, to provide conditions to react ethylene halohydrin with $OH^-$ to produce oxirane.

In some implementations, the cathodic compartment is configured so that the cathode is in contact with air on a first side and the catholyte on a second side. In some implementations, the ion exchange membrane is an anion exchange membrane which separates the anodic compartment from the cathodic compartment. In some implementations, some or all of the olefin reactants are generated by a $CO_2$-to-ethylene membrane electrode assembly. In some implementations, the $CO_2$-to-ethylene membrane electrode assembly has a cathodic region receiving humidified $CO_2$ gas, and an anodic region receiving an aqueous liquid. In some implementations, the anode comprises an electrocatalyst as defined herein or as manufactured using the method as defined herein. In some implementations, the catholyte comprises water.

In some implementations, there is provided an electrochemical system for producing oxirane from olefin reactants, the system comprising an anodic compartment having an anode provided therein and contacting halide based electrolyte to promote oxidation reactions; a cathodic compartment having a cathode provided therein and being configured to operate under oxygen reduction reaction (ORR) conditions; an ion exchange membrane between the anodic and cathodic compartments; and wherein the electrochemical system is configured such that the electrolyte from the anodic compartment is contacted with an olefin reactant to form ethylene halohydrin, and the ethylene halohydrin is then converted to oxirane.

In some implementations, there is provided an electrochemical process for producing oxirane from olefin reactants, comprising: in a first electrochemical subsystem contacting $CO_2$ with an electroreduction catalyst to convert the $CO_2$ into olefins and contacting a first anolyte with an oxidation electrocatalyst, thereby generating olefin reactants; in a second electrochemical subsystem, contacting a halide based electrolyte with an electrocatalyst to produce HOX species, wherein X is a halide, and contacting a catholyte with a cathodic catalyst; contacting at least a portion of the halide based electrolyte comprising the HOX species with at least a portion of the olefin reactants to form ethylene halohydrin; and contacting the ethylene halohydrin with $OH^-$ ions to form oxirane.

In some implementations, the first anolyte comprises water and the oxidation electrocatalyst causes generation of oxygen. In some implementations, the first anolyte is circulated through a first anodic compartment that accommodates the oxidation electrocatalyst. In some implementations, the electroreduction catalyst is copper based and is provided on a PTFE gas diffusion membrane. In some implementations, the oxidation electrocatalyst comprises $IrO_2$. In some implementations, the oxidation electrocatalyst and the electroreduction catalyst are separated by and in contact with an anion exchange membrane. In some implementations, the second electrochemical subsystem comprises an air conduit for passage of air for contacting a first side of the cathodic catalyst, and a cathodic compartment receiving the catholyte and allowing contact thereof with a second side of the cathodic catalyst. In some implementations, the catholyte comprises water. In some implementations, the catholyte is circulated through the cathodic compartment. In some implementations, the catholyte withdrawn from the cathodic compartment provides a source of the $OH^-$ ions used to contact the ethylene halohydrin to form the oxirane. In some implementations, a first portion of the catholyte withdrawn from the cathodic compartment is flowed for addition to the ethylene halohydrin, and a second portion is recirculated through the cathodic compartment. In some implementations, the halide based electrolyte comprising the HOX species is removed from an anodic compartment of the second electrochemical subsystem and supplied into a vessel along with at least a portion of the olefin reactants from the first electrochemical subsystem to form an anodic electrolyte mixture; a first portion of the anodic electrolyte mixture is supplied from the vessel into the anodic compartment as at least part of the halide based electrolyte; and a second portion of the anodic electrolyte mixture is removed from the vessel and contacted with the $OH^-$ ions to form the oxirane. In some implementations, the electrocatalyst of the second electrochemical subsystem comprises iridium oxide, cobalt oxide, platinum, platinum oxide, palladium or palladium oxide. In some implementations, the electrocatalyst is as defined herein or as manufactured using the method as defined herein; and optionally wherein the process further comprises one or more features as claimed and/or described herein.

In some implementations, there is provided an electrochemical system for producing oxirane from olefin reactants, comprising:

a first electrochemical subsystem comprising:

a $CO_2$ compartment for receiving a flow of $CO_2$, optionally humidified $CO_2$;

an electroreduction catalyst provided on a gas diffusion membrane and being coupled to the $CO_2$ compartment, the electroreduction catalyst and having a first side configured to contact and convert the $CO_2$ into olefins;

an ion exchange membrane in contact with a second side of the electroreduction catalyst;

an oxidation electrocatalyst in contact with an opposed side of the ion exchange membrane; and an anolyte compartment configured to receive an anolyte and provide contact thereof with the oxidation electrocatalyst;

a second electrochemical subsystem comprising:

a gas flow compartment for receiving a flow of air or oxygen;

a cathodic catalyst on a gas diffusion membrane and being coupled to the gas flow compartment, the cathodic catalyst and having a first side configured to contact the air or oxygen;

a catholyte compartment configured to receive a catholyte and provide contact thereof with a second side of the cathodic catalyst;

an ion exchange membrane spaced away from the cathodic catalyst and in contact with the catholyte; and an anodic compartment configured to receive a halide based electrolyte that is in contact with the ion exchange membrane and an electrocatalyst in opposed relation thereto, thereby generating HOX species, wherein X is a halide;

a first mixing region in fluid communication with an outlet of the anodic compartment and an outlet of the $CO_2$ compartment, configured to mix the olefin reactants with the HOX species to form ethylene halohydrin; and a second mixing region in fluid communication with the first mixing region and configured to mix the ethylene halohydrin with $OH^-$ ions to form oxirane.

In some implementations, an outlet of the catholyte compartment is in fluid communication the second mixing to provide $OH^-$ ions thereto. In some implementations, the system includes a catholyte vessel configured for receiving the catholyte from the outlet of the catholyte compartment, recirculating a first portion thereof back into the catholyte compartment, and supplying a second portion of the catholyte to the second mixing region. In some implementations, the electroreduction catalyst of the first electrochemical subsystem is copper based and is provided on a PTFE gas diffusion membrane. In some implementations, the oxidation electrocatalyst of the first electrochemical subsystem comprises iridium oxide, cobalt oxide, platinum, platinum oxide, palladium or palladium oxide. In some implementations, the catholyte in the second electrochemical subsystem comprises water and/or the anolyte in the first electrochemical subsystem comprises water. In some implementations, the electrocatalyst of the second electrochemical subsystem the comprises iridium oxide, cobalt oxide, platinum, platinum oxide, palladium or palladium oxide. In some implementations, the electrocatalyst of the second electrochemical subsystem is as defined herein or as manufactured using the method as defined herein. In some implementations, the first mixing region comprises an electrolyte vessel configured for receiving the electrolyte from the anodic compartment and a flow of the olefins to form an electrolyte mixture. supplying a first portion of the electrolyte mixture back into the anodic compartment as at least part of the electrolyte, and supplying a second portion of the electrolyte mixture to the second mixing region. In some implementations, the system includes a pump assembly coupled to the electrolyte vessel and configured to supply a first portion of the electrolyte mixture back into the anodic compartment as at least part of the electrolyte, and to supply a second portion of the electrolyte mixture to the second mixing region. In some implementations, the system includes one or more features as claimed or described herein.

In some implementations, the use, process, method and/or system are provided with additional features, such as one or more operating conditions and/or quantitative features are as described herein within a range of ±2%, ±5%, ±10% or ±15%.

Various implementations, features and aspects of the technology are described herein, including in the claims, figures and following description.

In addition, certain implementations of the technology can be combined with the following aspects:

For example, in some aspects there is provided an electrocatalyst for selective anodic oxidation of an olefin reactant to produce ethylene chlorohydrin in a halide ion based electrolyte, the electrocatalyst comprising iridium oxide on a titanium substrate.

The iridium oxide can be provided as particles, such as nanoparticles, on the titanium substrate. The titanium mesh can include a network of filaments defining openings, and the iridium oxide can be deposited on the filaments and also forms an iridium oxide web extending across the openings. The halide ion can include Cl and the halide ion based electrolyte can be an aqueous KCl electrolyte.

In some aspects, there is provided an electrochemical process for producing oxirane from olefin reactants, comprising:

contacting a halide based electrolyte with an anode and a cathode respectively located in an anodic compartment and a cathodic compartment;

supplying olefin reactants into the electrolyte in the anodic compartment, such that the anode generates ethylene chlorohydrin;

withdrawing a loaded anodic solution comprising ethylene halohydrin from the anodic compartment, and a loaded cathodic solution comprising $OH^-$ ions from the cathodic compartment; and mixing at least a portion of the loaded anodic solution with at least a portion of the loaded cathodic solution under conditions to react ethylene halohydrin with OH— to produce oxirane.

The olefin reactants can include ethylene and/or propylene. The halide based electrolyte can be Cl based and the ethylene halohydrin and include ethylene chlorohydrin. The halide based electrolyte can be provided at a concentration of about 1.5 to 2.5 M or about 1.8 to 2.2 M. The anode can include an electrocatalyst comprising a metal oxide catalyst provided on a metal substrate, and the metal oxide catalyst can include iridium, such as iridium oxide, which can be provided in particulate form on a metal mesh that can be made of titanium. The electrocatalyst can be fabricated by etching the metal substrate followed by coating the etched metal substrate in a coating solution comprising a dihydrate of the metal oxide catalyst.

In some aspects, there is provided an electrochemical process for producing oxirane from olefin reactants, comprising:

contacting a halide based electrolyte with an anode and a cathode respectively located in an anodic compartment and a cathodic compartment;

supplying olefin reactants into the electrolyte in the anodic compartment, such that the anode generates ethylene halohydrin;

withdrawing a loaded anodic solution comprising ethylene halohydrin from the anodic compartment;

contacting at least a portion of the loaded anodic solution with a basic solution comprising $OH^-$ ions under conditions to react ethylene halohydrin with OH— to produce oxirane.

In some aspects, there is provided an electrochemical system for producing oxirane from olefin reactants, comprising an electrochemical flow cell comprising an anodic compartment having an anode provided therein, an electrolyte inlet for receiving a halide based electrolyte, a gas inlet for supplying olefin reactants to electrocatalytically convert the olefin and halide into ethylene halohydrin, and an outlet for expelling a solution comprising the ethylene halohydrin; a cathodic compartment having a cathode provided therein, an electrolyte inlet for receiving a halide based electrolyte, a hydrogen outlet, and an outlet for expelling a basic solution comprising $OH^-$ ions; and an ion exchange membrane between the anodic and cathodic compartments. The system also includes a mixing chamber configured to receive at least a portion of the solution comprising the ethylene halohydrin and the basic solution comprising $OH^-$ ions, or a mixture thereof, and to provide conditions to react ethylene halohydrin with OH− to produce oxirane.

In some aspects, there is provided an electrochemical process for producing an organic product from olefin reactants, comprising: contacting a halide based electrolyte with an anode and a cathode respectively located in an anodic compartment and a cathodic compartment; supplying olefin reactants into the electrolyte in the anodic compartment, such that the olefin reactants contact the anode; wherein the anode comprises an electrocatalyst that defines an extended heterogenous:homogenous interface with halide ions acting as a reservoir for positive charges, thereby storing and redistributing positive charges to promote selective generation of halohydrins; and converting the halohydrins into the organic product. The halohydrins can include ethylene halohydrins, and the organic product can include or be oxiranes. The converting can include mixing at least a portion of a loaded anodic solution withdrawn from the anodic compartment, and at least a portion of a loaded cathodic solution withdrawn from the cathodic compartment.

In some aspects, there is provided an electrochemical process for producing oxiranes from olefin reactants, comprising contacting a halide based electrolyte with an anode and a cathode respectively located in an anodic compartment and a cathodic compartment; supplying olefin reactants into the electrolyte in the anodic compartment, such that the olefin reactants contact the anode; wherein the anode comprises an electrocatalyst that defines an extended heterogenous:homogenous interface with halide ions acting as a reservoir for positive charges, thereby storing and redistributing positive charges to promote selective generation of ethylene halohydrins; and converting the ethylene halohydrins into oxiranes.

The techniques described above can also be combined with various features as described herein.

BRIEF DESCRIPTION OF DRAWINGS

The Figures describe various aspects and information regarding the technology.

FIG. 33 | Schematic description of the electrochemical processes, including (a) two independent electrolyzers and (b) one electrolyzer, to produce EO from $CO_2$.

FIG. 34 | (a) Schematic illustration of the current industrial processes and electrochemical process for EO production. (b) Carbon footprint of two typical industrial processes for EO product. One is ethane-based steam cracking process coupled with air-based oxidation and the other is naphtha-based process (see Table 7 below).

DETAILED DESCRIPTION

The present description relates to the selective electrosynthesis of oxiranes. The electrosynthesis can involve one or more aspects that will be described herein. The enhanced electrosynthesis techniques can include an anodic electrocatalyst material, the implementation of oxygen reduction reaction (ORR) at the cathode when paired with a chlorine evolution reaction (e.g., CIER) at the anode, and the use of a paired electrocatalytic system for the conversion of $CO_2$ into olefins followed by the conversion of the olefins into ethylene halohydrin which is then converted into oxirane.

More particularly, in one example implementation, the electrosynthesis can be performed using an electrochemical cell that has an anode including an electrocatalyst for selective anodic oxidation of an olefin reactant, such as ethylene or propylene, to produce ethylene halohydrin in a halide ion based electrolyte, where the electrocatalyst includes a catalyst metal oxide loaded with a period-6 metal oxide and provided on a substrate, which can be a metal substrate. The catalyst metal oxide can include iridium oxide and the period-6 metal oxide can include barium, lanthanum, cerium, and bismuth oxides, with the substrate being a titanium mesh or foam for example. The period-6 metal oxides have enhanced stability in chlorine solutions to act as HOCl-cleavage inhibitors and the loaded electrocatalyst was found to provide enhanced performance, such as higher Faradaic Efficiency (FE) for olefin oxidation and reduced aqueous waste.

In another example implementation, the electrochemical cell can include a cathode that is configured and operated to provide ORR instead of the hydrogen evolution reaction (HER). In alternative implementations, HER was provided at the cathode and required a certain theoretical reaction potential to drive the cathodic HER together with the anodic $Cl_2$ evolution reaction (CIER). However, when ORR was used at the cathode, the reaction potential to drive ORR and CIER was lowered. In one example, it was found that the operating full-cell voltage was reduced by 1.2 V from 3.2 V to 2.0 V at 100 mA/cm$^2$ current density when using ORR instead of HER. Various catalyst materials can be used at the cathode for facilitating the ORR, some examples of which include platinum supported carbon as described herein.

Figure 39:
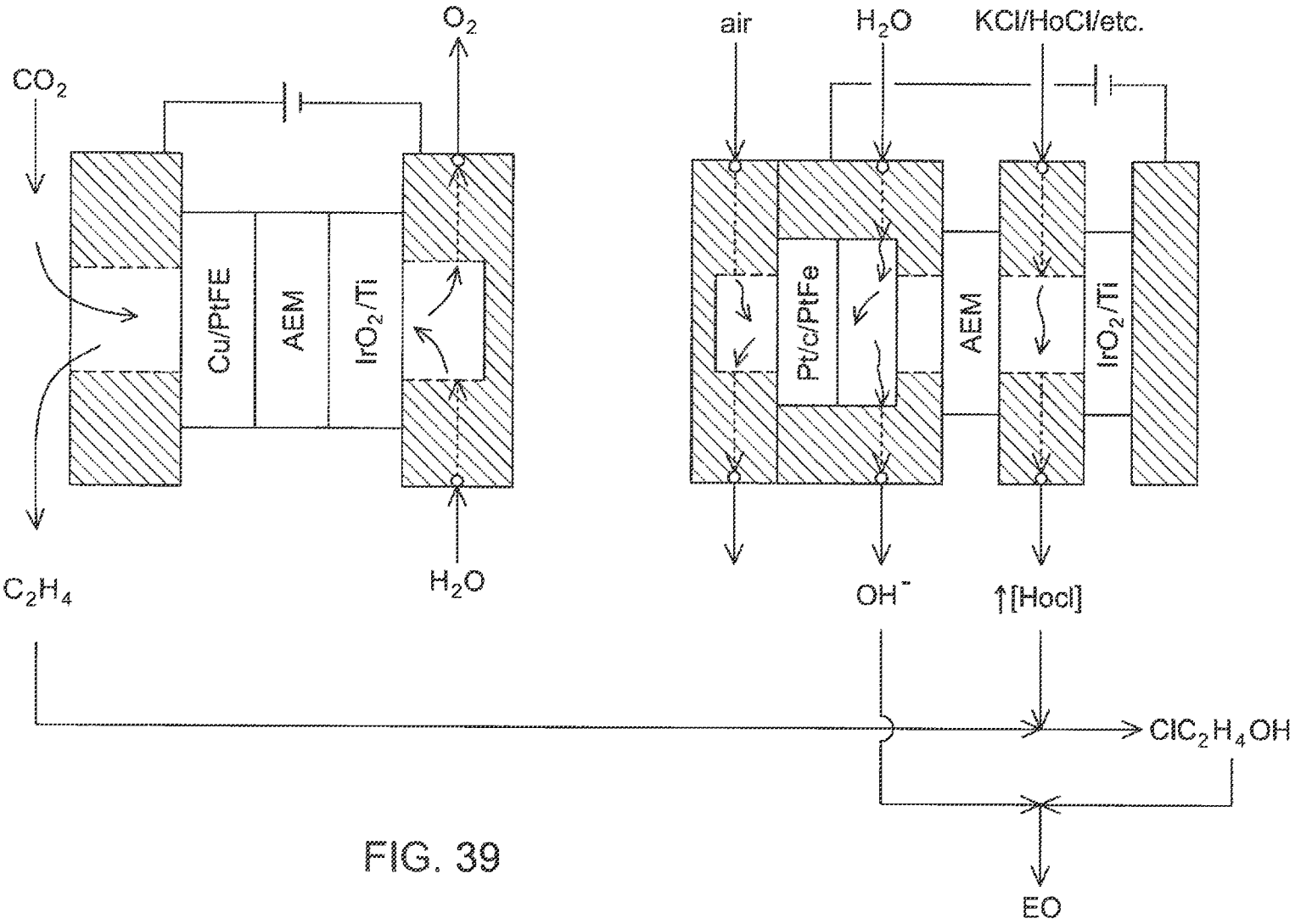
FIG. 39 is a schematic of an example integrated system for converting $CO_2$ into oxirane.

In another implementation, the electrosynthesis converts $CO_2$ into olefins, the olefins are in turn converted into ethylene halohydrin which is then converted into oxirane, and the reactions are performed in a paired electrochemical system instead of two distinct electrolysers. For example, it is possible to convert $CO_2$ into ethylene in a first electrolyser, and then to feed the ethylene into a second electrolyser that is operated to produce the ethylene halohydrin which is converted to oxirane. In the paired electrochemical system, the setup can have features as shown in FIGS. 33 and 39, for example.

Initial Information & Optional Aspects

The following section provides further information and describes optional features that can be used in combination with certain aspects and implementations as described herein:

In some implementations, the electrosynthesis can be done at relatively high current density facilitated by an extended heterogeneous:homogeneous interface. In some implementations, oxirane is produced using a method that includes selective anodic oxidation under high current densities without uncontrolled oxidation by utilizing $Cl^-$ as a reservoir for positive charges from the anode to create an extended heterogeneous:homogeneous interface. In one example, the electrochemical system can include a flow-cell with a KCl based electrolyte in which ethylene is continuously sparged into the anolyte, with iridium oxide nanoparticles on titanium mesh as the working electrode (anode), and Ni foam as the counter electrode (cathode).

More broadly, an electrochemical process for producing oxirane from olefin reactants can include contacting a halide based electrolyte with an anode and a cathode respectively located in an anodic compartment and a cathodic compartment; supplying olefin reactants into the electrolyte in the anodic compartment, such that the anode electrocatalytically produces ethylene halohydrin; withdrawing a loaded anodic solution comprising ethylene halohydrin from the anodic compartment; and contacting at least a portion of the loaded anodic solution with a basic solution comprising $OH^-$ ions under conditions to react ethylene halohydrin with OH— to produce oxirane. Preferably, the basic solution comprising $OH^-$ ions is obtained from the cathodic compartment as the catholyte.

The anode can comprise an electrocatalyst for selective anodic oxidation of an olefin reactant, such as ethylene or propylene, to produce ethylene halohydrin in a halide ion based electrolyte, the electrocatalyst comprising a catalyst metal oxide on a metal substrate. The catalyst metal oxide can comprise iridium oxide and the metal substrate can comprise titanium.

In some implementations, the process enables selective anodic oxidation under high current densities without uncontrolled oxidation by utilizing $Cl^-$ as a reservoir for positive charges from the anode to create an extended heterogeneous:homogeneous interface. The olefin oxidation experiments were conducted in a flow-cell configuration consisting of 2.0 M KCl electrolyte, the iridium oxide nanoparticles on titanium mesh anode catalyst, ion exchange membrane and cathode (e.g., Ni foam). These are positioned and clamped together with spacers to enable the introduction of liquid electrolyte into the anodic and cathodic chambers. The electrolyte is circulated through the cell during which ethylene or propylene gas is continuously sparged into the anolyte at a constant flow rate. The catholyte and anolyte output streams are merged post electrolysis, oxirane can be generated from the reaction between ethylene chlorohydrin and $OH^-$. Other concentrations of the electrolyte, as well as other electrolytes comprising the halide ions $Cl^-$ and $Br^-$ can be used as well, but it was found that 2.0 M KCl provides the highest energy efficiency.

The iridium oxide nanoparticles on titanium mesh anode was fabricated by etching the titanium mesh in boiling 6 M HCl for 40 min, followed by dip-coating in a solution comprised of 2 mL HCl, 18 mL isopropanol, and 60 mg iridium (IV) oxide dihydrate. The resultant catalyst was dried in a preheated oven at 100° C. for 10 min and calcined in air at 500° C. for 10 min. The procedure was repeated 10 times to achieve an $IrO_2$ loading of ~1 mg/cm$^2$.

Thus, in some implementations, an electrochemical route for the production of oxirane at 1 A/cm$^2$ current densities was developed.

Chemicals manufacturing consumes large amounts of energy and is responsible for 15% of global carbon emissions. Electrochemical systems that produce the desired chemicals using renewable electricity offer a route to decarbonization of the chemicals sector. Oxirane is among the world's top 15 most produced chemicals at ~20 million tons yearly due to its importance in the plastics industry, notably in the manufacture of polyesters and polyethylene terephthalates (PET). If one could develop the renewable electricity powered electrosynthesis of oxirane under ambient conditions, the associated carbon emissions could be reduced. This work first utilized techno-economic analysis to determine conditions that could enable the profitable synthesis of a renewable-energy-powered anodic partial oxidation of ethylene and propylene to oxirane and methyl oxirane, respectively. This work then utilized an extended heterogeneous:homogeneous interface, using $Cl^-$ as a reservoir for positive charges from an iridium oxide nanoparticles on titanium mesh anode, to facilitate the partial anodic oxidation of ethylene to oxirane at current densities of 1 A/cm$^2$ and Faradaic efficiencies of ~70%. This work ran the system at 300 mA/cm$^2$ for 100 h and maintained a 71(±1) % Faradaic efficiency throughout. This work also achieved a Faradaic efficiency of 45% to oxirane in an integrated system using ethylene generated from a $CO_2$-to-ethylene membrane electrode assembly.

The electrosynthesis of oxirane involves the partial oxidation of ethylene, an anodic reaction. Reactions of this nature at high current density and Faradaic efficiency are hampered by two challenges. Firstly, the large positive potentials applied mean that uncontrolled over-oxidation often occurs, generating undesired byproducts such as $CO_2$. Currently, reported anodic upgrading reactions such as the oxidation of 5-hydroxymethylfurfural, alcohol and glycerol, are conducted at low current densities, since at these low current densities, high Faradaic efficiencies toward the target product have been obtained. However, the production of industrially-relevant quantities of the product at such low current densities would require unreasonably high electrolyzer surface areas, leading to high capital costs per unit of productivity. Secondly, if the reactant has limited solubility in the aqueous electrolyte (in this case, ethylene), the system quickly becomes mass-transport-limited, resulting in poor Faradaic efficiency at high current density.

The anodic electrosynthesis of olefins such as ethylene and propylene has been reported using anodes based on palladium dendritic nanotrees, achieving a Faradaic efficiency of 80% at current density of 7.1 mA/cm$^2$. This method only occurs under low current density of 7.1 mA/cm$^2$, which is two orders below industrially relevant current densities at 300-100 mA/cm$^2$. Operating at such high current densities would result in the dissolution of the Pd anode. As previously mentioned, the production of industrially-relevant quantities of the product at such low current densities would require unreasonably high electrolyzer surface areas, leading to high capital costs per unit of productivity. As renewable electricity is much more expensive than electricity derived from fossil fuels, the energy efficiency of the reaction needs to be high to ensure profitability by keeping the total electricity costs low.

Implementations described herein overcome at least some of the drawback of other techniques. For example, this work utilized $Cl^-$ or another halide as a reservoir for positive charges from the anode to create an extended heterogeneous: homogeneous interface. For instance, $Cl^-$ stores and redistributes positive charges to ethylene, thereby buffering it from uncontrolled oxidation and facilitating ethylene oxide production. Thus, this work was able to achieve high Faradaic efficiencies of ~70% under high current densities of 300-1000 mA/cm$^2$.

In terms of examples that were assessed, this was realized in a flow-cell setup with 2.0 M KCl electrolyte, in which ethylene was continuously sparged into the anolyte, with iridium oxide nanoparticles on titanium mesh as the working electrode (anode), Ni foam as the counter electrode (cathode). The final step involves addition of alkali ($OH^-$), which then reacts with ethylene chlorohydrin to yield the desired ethylene oxide and regenerate $Cl^-$: the hydrogen evolution reaction at the cathode during electrolysis generates the $OH^-$ needed to do this. This means that by merging the catholyte and anolyte output streams post electrolysis, oxirane can be generated from the reaction between ethylene chlorohydrin and $OH^-$.

In addition, this work developed an anode (iridium oxide nanoparticles on titanium mesh) and reaction conditions to enable this reaction to remain profitable even at the upper bound of renewable electricity costs. This work obtained a high energy efficiency of 31% under current density 300 mA/cm$^2$, which is key to enabling profitability by reducing the high electricity costs associated with renewable energy use. This anode also enabled us to maintain a stable applied potential of 2.86(±0.02) V and Faradaic efficiency averaging 71(±0.6) % for 100 hours continuously.

The electrocatalytic techniques described herein for producing oxiranes include features such as providing an extended heterogeneous:homogeneous interface for the electrocatalytic reactions (e.g., conversion of olefins into ethylene halohydrins in the anodic compartment), providing a halide ion positive charge reservoir proximate to the electrocatalyst of the anode, and/or the development of an electrocatalyst material for use in the anodic compartment and having certain chemical, structural and functional features (e.g., iridium oxide nanoparticles on a titanium mesh). The development of an extended heterogeneous:homogeneous interface is beneficial as it facilitates storing and redistributing positive charges to an organic molecule, thereby buffering it from uncontrolled oxidation and facilitating highly selective product generation. This facilitates anodic electrosynthesis at relatively high current densities, which in turn allow for industrially-relevant production rates without incurring unreasonably high capital costs. Another aspect is the anode based on iridium nanoparticles on titanium mesh, which facilitated this reaction to remain profitable even at the upper bound of renewable electricity costs. This is relevant in terms of providing industries with the incentive to decarbonize by making the switch from the conventional thermal ethylene oxidation process to an electrochemical one. This anode material was also able to maintain a stable applied potential of 2.86(±0.02) V and Faradaic efficiency averaging 71(±0.6) % for 100 hours continuously.

The following section provides additional background, information and experimentation regarding the technology and notably example implementations regarding the selective electrosynthesis of ethylene oxide at high current density enabled by an extended heterogeneous:homogeneous interface.

Chemicals manufacturing consumes large amounts of energy and is responsible for 15% of global carbon emissions. Electrochemical systems that produce the desired chemicals using renewable electricity offer a route to decarbonization of the chemicals sector. Ethylene oxide is among the world's top 15 most produced chemicals at ~20 million tons yearly due to its importance in the plastics industry, notably in the manufacture of polyesters and polyethylene terephthalates (PET). Here, this work utilized an extended heterogeneous:homogeneous interface, using $Cl^-$ as a reservoir for positive charges from the anode, to facilitate the partial anodic oxidation of ethylene to ethylene oxide at current densities of 1 A/cm$^2$ and Faradaic efficiencies of ~70%. This work ran the system at 300 mA/cm$^2$ for 100 h and maintained a 71(±1) % Faradaic efficiency throughout.

In the United States, chemical manufacture accounts for 28% of total industrial energy demand (1). At present, this demand is largely met by the consumption of fossil fuels, resulting in significant $CO_2$ emissions (2, 3): a recent report showed that the plastics industry alone releases 1.8 billion metric tons of $CO_2$ per year; and that replacing fossil fuels-based production methods with ones powered using renewable energy offers a route to reduce net greenhouse gas emissions associated with plastics manufacture (4).

Figure 1A:
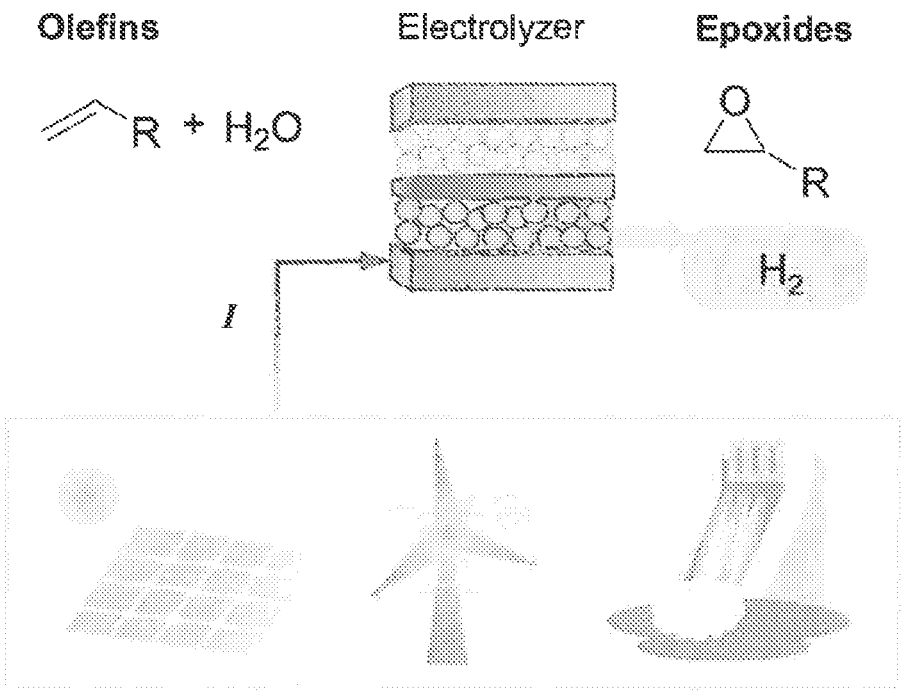
FIG. 1. Electrosynthesis of ethylene oxide using renewable energy. (A) Schematic illustrating the proposed electrochemical system. (B) Sensitivity analysis of the plant-gate levelized cost per ton of ethylene oxide (EO) produced. (C) Techno-economic analysis (TEA) showing plant-gate levelized cost as a function of energy efficiency and renewable energy cost. (D) Reported current densities and Faradaic efficiencies for other anodic partial oxidation reactions in the literature (blue squares, left of graph, references 16-28). Data for the system demonstrated in this work are shown for comparison (red squares, right of graph) (E) Breakdown of costs at current densities of 50 and 300 $mA/cm^2$, as calculated from TEA.

One attractive strategy involves developing electrochemical systems that produce the necessary raw materials using renewable electricity (5-8). Ethylene oxide is used in the manufacture of plastics, detergents, thickeners and solvents (9) and among the world's top 15 most produced chemicals at ~20 million metric tons per annum (10, 11). At present, it is manufactured via the thermocatalytic partial oxidation of ethylene at high temperature and pressure (200-300° C. and 1-3 MPa), generating 1.6 tons of $CO_2$ per ton ethylene oxide produced (12). If one could develop the renewable electricity powered electrosynthesis of ethylene oxide under ambient conditions, the associated carbon emissions could be reduced (FIG. 1A) (13, 14).

Figure 5:
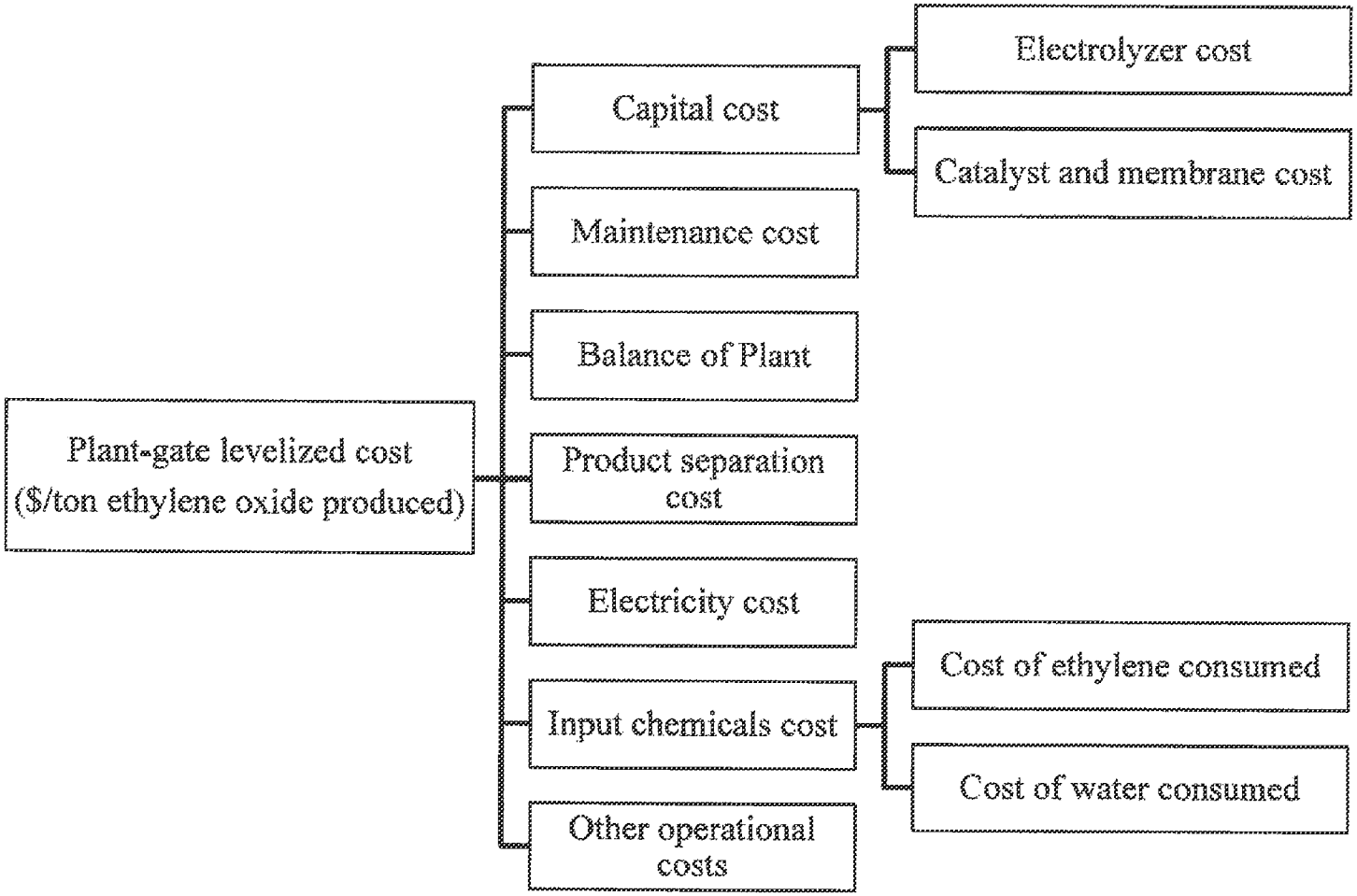
FIG. 5. Model used for the techno-economic analysis of ethylene oxide production from ethylene using electricity. Units are US$ per ton of ethylene oxide.

Techno-economic analysis (TEA) indicates conditions that could enable the profitable synthesis of a renewable-energy-powered anodic partial oxidation of ethylene to ethylene oxide (see Supplementary Materials for full details of TEA, FIG. 5). For the TEA, this work set a base electricity cost of 10¢/kWh, which is at least twice the average present-day industrial electricity cost (6) (FIG. 1B): recent advances in renewable technology have driven prices lower in many jurisdictions (15). Sensitivity analysis reveals that the greatest dependency of the plant-gate levelized cost is on electrochemical parameters such as current density and Faradaic efficiency (FIG. 1B, see Table 1 for range of values considered for each parameter). Based on the current market price per ton of ethylene oxide and the corresponding quantity of hydrogen produced at the cathode, it was determined that for a current density of 300 mA/cm$^2$, the minimum energy efficiency required for the renewable energy-powered process to be profitable is ~30%. This work also calculated the minimum energy efficiencies required to be profitable for different electricity costs up to 20¢/kWh, showing profitable regions as a function of energy efficiency and electricity cost (FIG. 1C).

The electrosynthesis of ethylene oxide involves the partial oxidation of ethylene, an anodic reaction. Reactions of this nature at high current density and Faradaic efficiency are hampered by two challenges. Firstly, the large positive potentials applied mean that uncontrolled over-oxidation often occurs, generating undesired byproducts such as $CO_2$. Currently, reported anodic upgrading reactions such as the oxidation of 5-hydroxymethylfurfural (16-18), alcohol (19-21) and glycerol (22-24), are conducted at low current densities (<100 mA/cm$^2$), since at these low current densities, high Faradaic efficiencies toward the target product have been obtained (FIG. 1D). However, the production of industrially-relevant quantities of the product at such low current densities would require unreasonably high electrolyzer surface areas, leading to high capital costs per unit of productivity (FIG. 1E). Secondly, if the reactant has limited solubility in the aqueous electrolyte (in this case, ethylene), the system quickly becomes mass-transport-limited, resulting in poor Faradaic efficiency at high current density.

TABLE 1

Range of values for sensitivity analysis.

| | Better | Base | Worse |
|---|---|---|---|
| Ethylene cost ($/ton) | 800 | 900 | 1000 |
| Renewable electricity cost (¢/kWh) | 5 | 10 | 15 |
| Faradaic efficiency (%) | 80 | 70 | 40 |
| Current density (mA/cm$^2$) | 1000 | 300 | 50 |
| Cell potential (V) | 2.5 | 3.0 | 5.0 |
| Catalyst life time (years) | 5 | 3 | 1 |
| Electrolyzer cost ($/m$^2$) | 9000 | 10000 | 11000 |

Figure 2A:
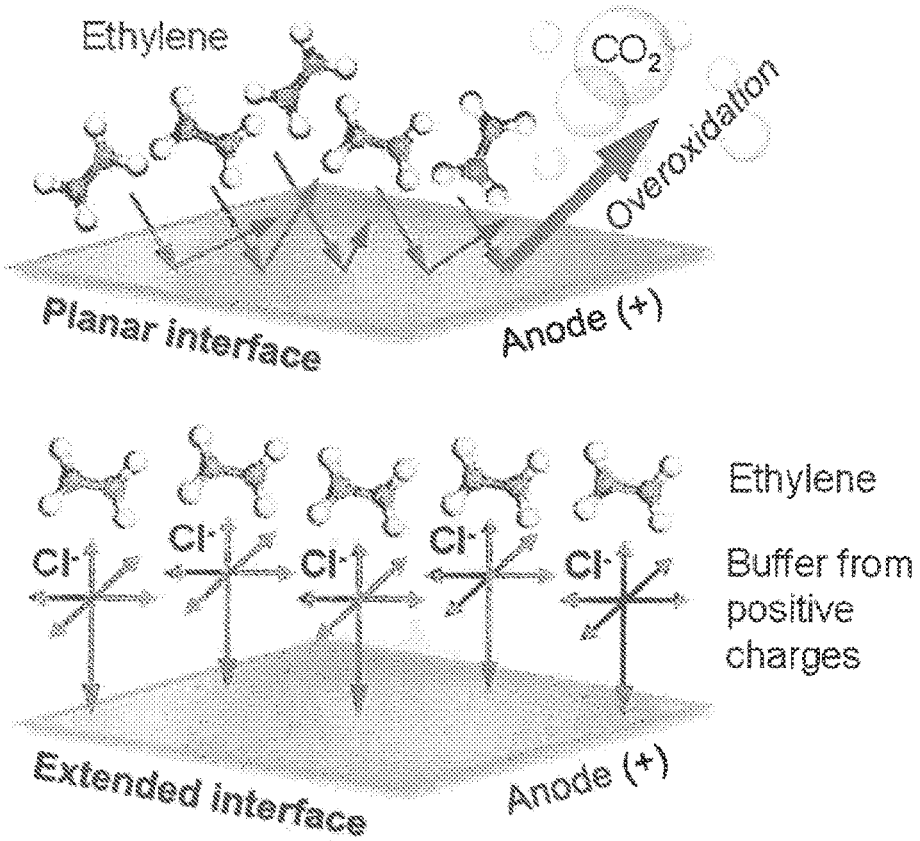
FIG. 2. Selective ethylene oxide production from ethylene enabled by an extended heterogenous:homogenous interface. (A) Schematic illustrating ethylene oxidation at planar versus extended interfaces. (B) Schematic of the ethylene-to-ethylene oxide electrochemical system. For detailed schematic see FIG. 7. (C) Faradaic efficiencies of ethylene oxide and ethylene chlorohydrin at different current densities. (D) $^{13}C$ NMR spectra of ethylene oxide and ethylene chlorohydrin. (E) Faradaic efficiencies of propylene oxide and propylene chlorohydrin at different current densities.

The view was taken that, desirably, a new, selective, production strategy would avoid directly oxidizing the organic reactant molecules on the electrode surface so as to prevent over-oxidation at high current densities. This work reasoned that a positive charge reservoir that facilitates the indirect exchange of electrons between the electrode and the substrate molecules would allow this. Furthermore, in such a scheme, the space in which the reaction takes place is not limited to the planar electrode:electrolyte interface, but in fact extends into the bulk electrolyte, constituting an extended heterogeneous:homogeneous interface (FIG. 2A). This allows mass transport limitations to be overcome. Utilizing this strategy, it was demonstrated that ethylene oxide production at high current density (up to 1 A/cm$^2$) and Faradaic efficiency (~70%).

Figure 2B:
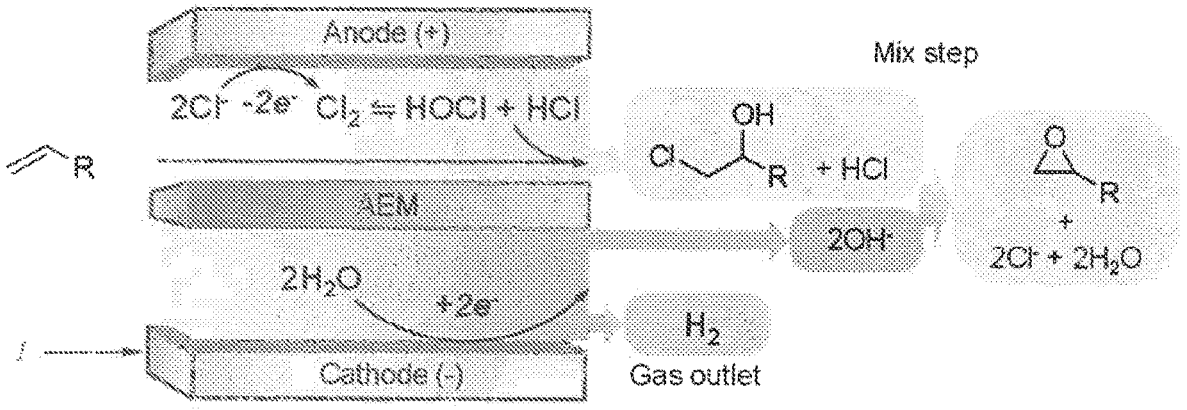
Figure 6A:
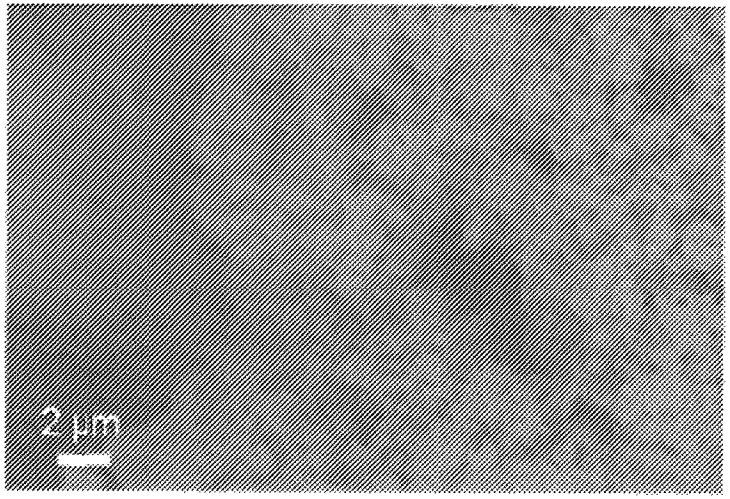
FIG. 6. (A) SEM and EDX images showing the nanostructured surface and distribution of Ti and Pd on the Pd/Ti mesh, respectively. (B) Faradaic efficiencies obtained with various strategies at 300 $mA/cm^2$. (C) Increasing half-cell potential due to Pd dissolution.
Figure 6B:
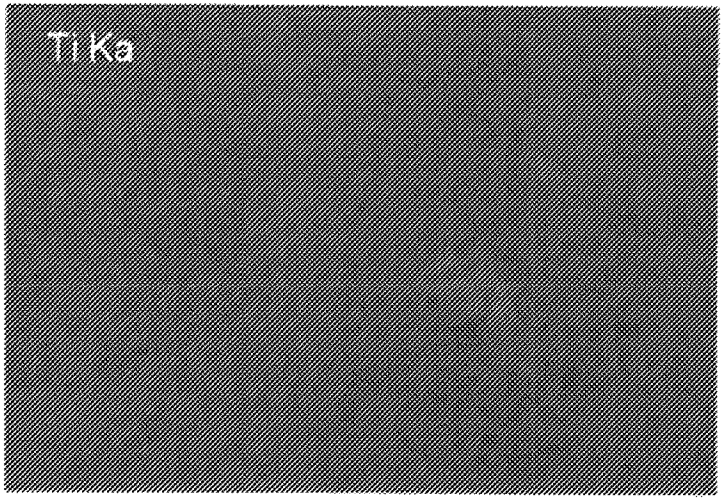
Figure 6C:
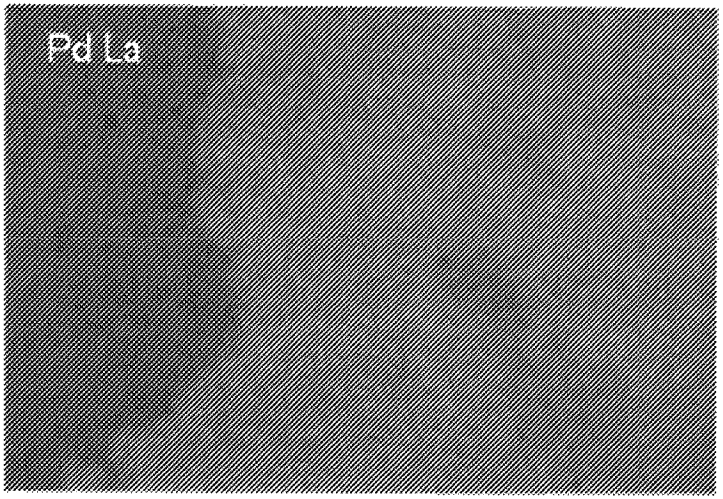
Figure 6D:
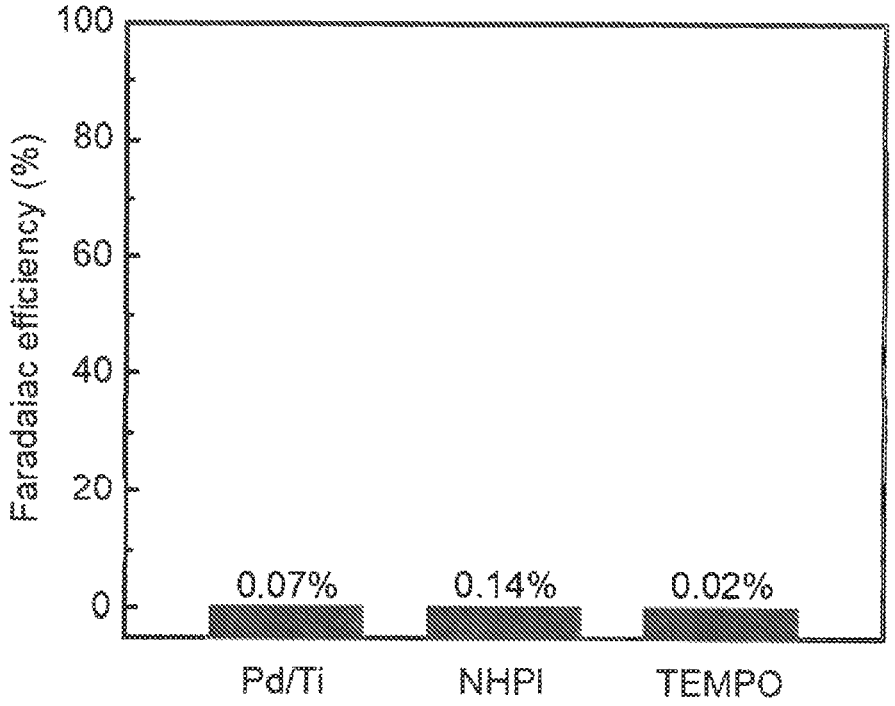
Figure 6E:
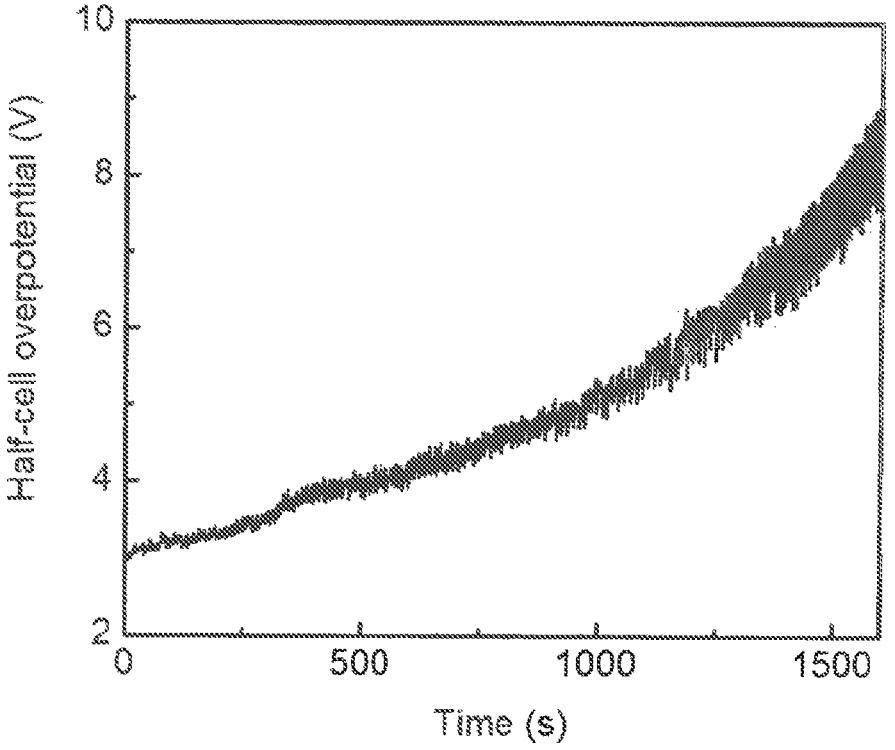

Initially it was attempted to oxidize ethylene directly to ethylene oxide using a nanostructured palladium anode (FIG. 6A). This was based on a recent study in which olefins such as propylene were oxidized at low current densities. This method did not translate to the high current densities: at 300 mA/cm$^2$, a negligible Faradaic efficiency was obtained toward ethylene oxide (FIG. 6B). Operating at this high current density resulted in dissolution of the Pd anode, as can be observed from the rapidly increasing potential with time (FIG. 6C). Additionally, the use of organic mediators such as TEMPO and NHP—a method to obtain high selectivities for partial oxidation products at the anode—failed in the generation of ethylene oxide and yielded instead only small amounts of acetate (FIG. 2B).

Figure 7:
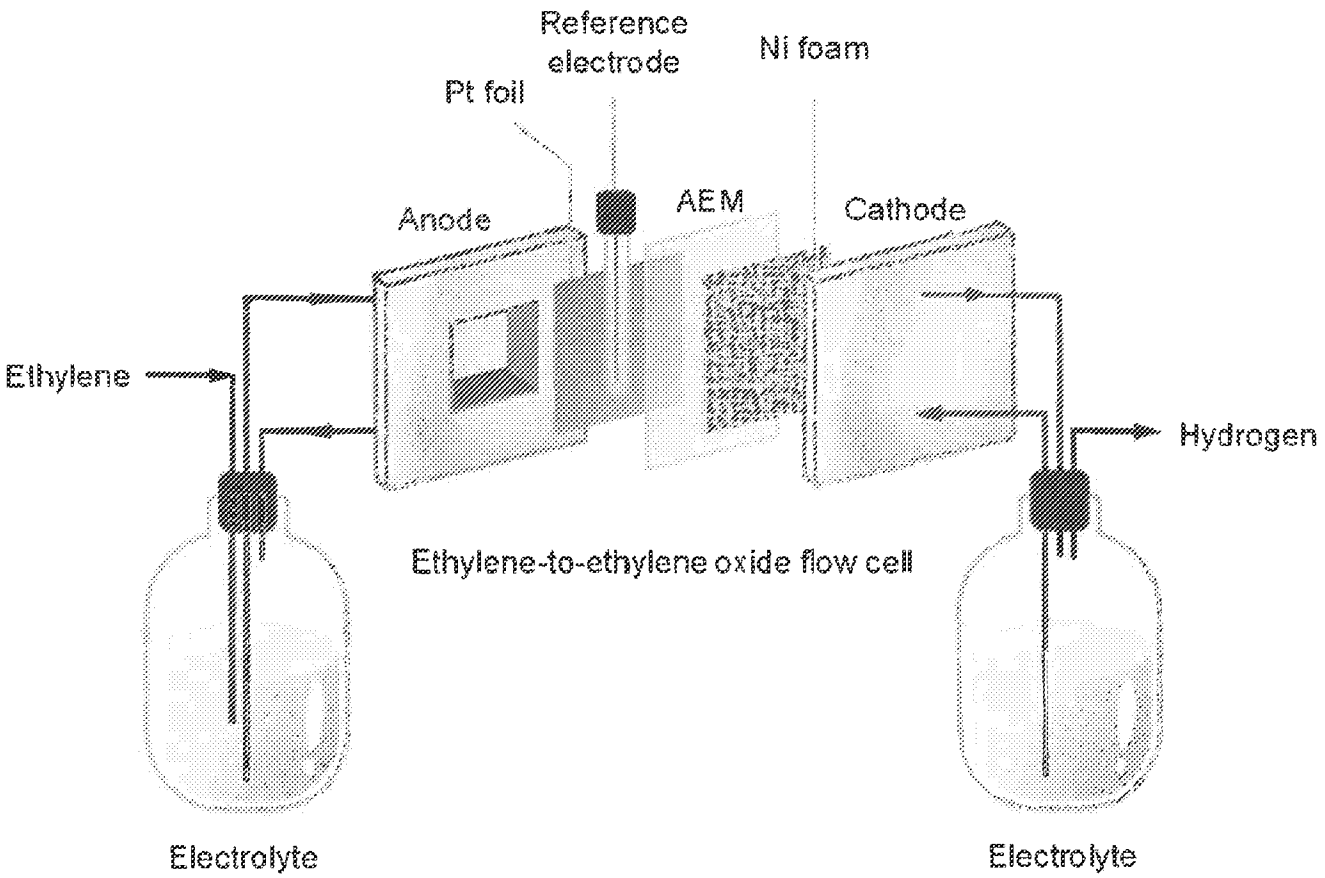
FIG. 7. Detailed schematic of the ethylene-to-ethylene oxide electrochemical flow cell system employed in this work.

It was postulated that $Cl^-$ can be a reservoir for positive charges from the anode and create an extended heterogeneous:homogeneous interface. $Cl^-$ stores and redistributes positive charges to ethylene, thereby buffering it from uncontrolled oxidation and facilitating ethylene oxide production. This idea was tested in a flow-cell setup with 1.0 M KCl electrolyte, in which ethylene was continuously sparged into the anolyte, with Pt foil as the working electrode (anode), Ni foam as the counter electrode (cathode), Ag/AgCl (3.0 M KCl) as the reference electrode (FIG. 7). An anion exchange membrane (AEM) separates the anolyte and catholyte chambers. Unless otherwise stated, all electrolysis experiments were run for a duration of 1 h.

In this case, $Cl^-$ is oxidized to $Cl_2$ at the Pt anode (Equation 1), which disproportionates in the aqueous environment to form HOCl and HCl (Equation 2) (32). HOCl then reacts with ethylene dissolved in the electrolyte to form ethylene chlorohydrin (Equation 3) (33). Since HCl is not consumed, the pH of the anolyte becomes acidic at the end of electrolysis (pH 1.1).

$$2Cl^- \rightarrow Cl_2 + 2e^- \quad (1)$$

$$Cl_2 + H_2O \leftrightarrows HOCl + HCl \quad (2)$$

$$C_2H_4 + HOCl \rightarrow HOCH_2CH_2Cl \quad (3)$$

$$HOCH_2CH_2Cl + OH^- \rightarrow C_2H_4O + Cl^- \quad (4)$$

Figure 2D:
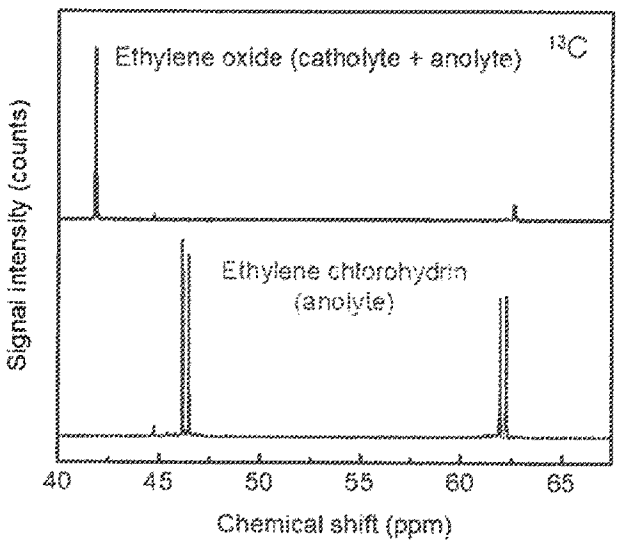
Figure 2E:
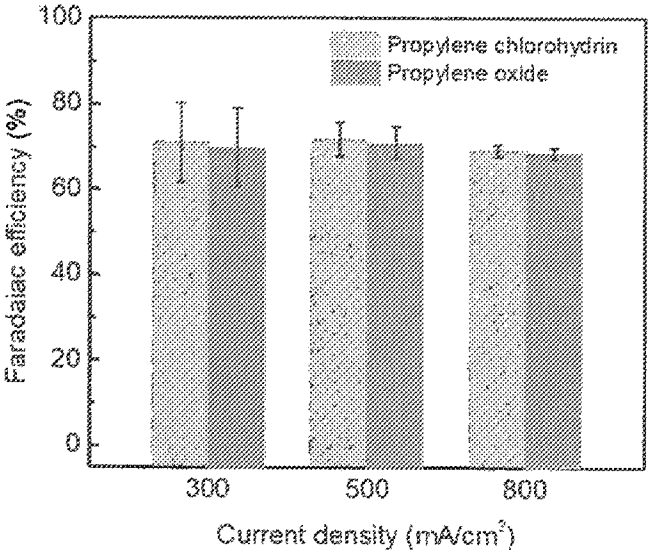
Figure 2C:
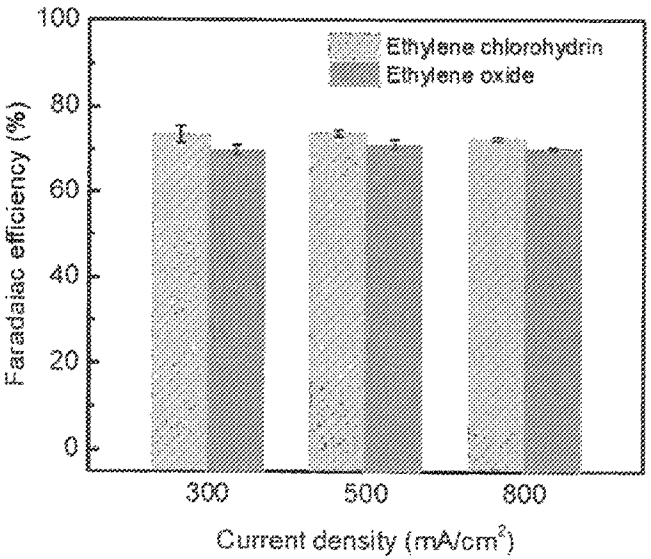
Figure 8A:
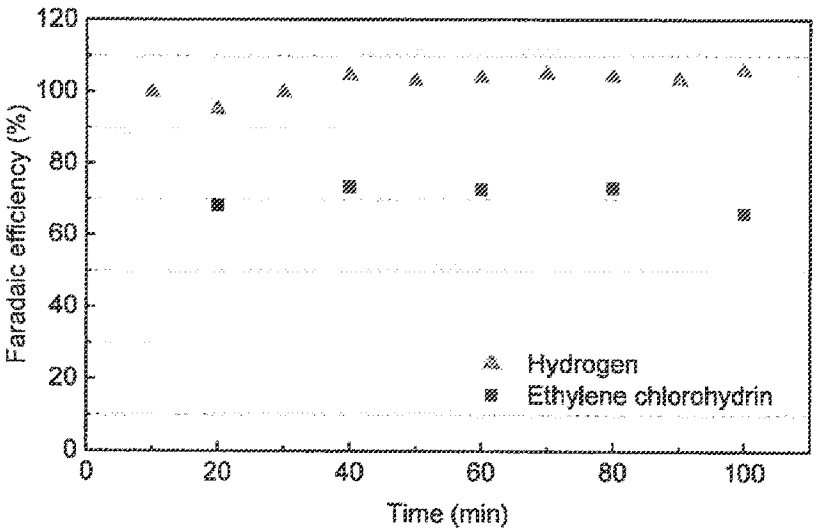
FIG. 8. (A) Faradaic efficiencies of $H_2$ and ethylene chlorohydrin as a function of time. (B) Faradaic efficiencies of ethylene oxide and ethylene chlorohydrin with different membrane types. The bipolar membrane (BPM) introduces $OH^-$ into the anolyte, which reacts with dissolved $Cl_2$ to form hypochlorite $ClO^-$, thus inhibiting the formation of ethylene chlorohydrin. The cation exchange membrane (CEM), Nafion, inhibits $OH^-$ crossover and therefore has a higher faradaic efficiency than that of the anion exchange membrane (AEM) by ~8%, indicating a small amount $OH^-$ crossover with the latter. (C) Increasing half-cell potential when the Nafion membrane is used. This is due to decreasing electrolyte conductivity from depletion of $Cl^-$ and $K^+$ (transported across membrane) in the anolyte. Hence the use of AEM is still favored for preventing conductivity loss and maintaining a steady supply of $Cl^-$.
Figure 8C:
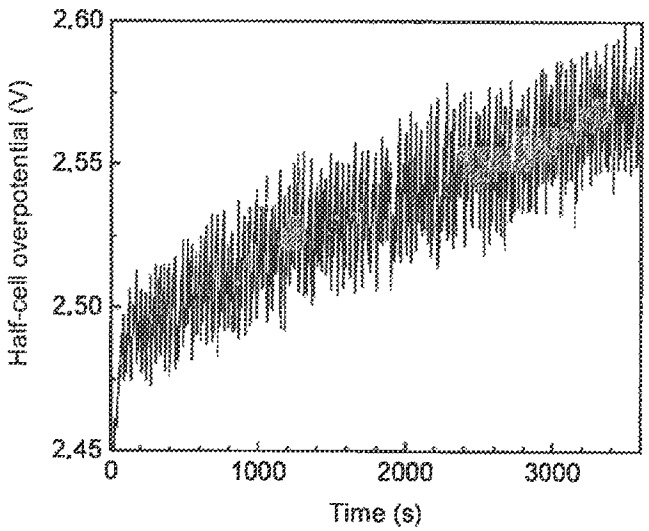
Figure 8B:
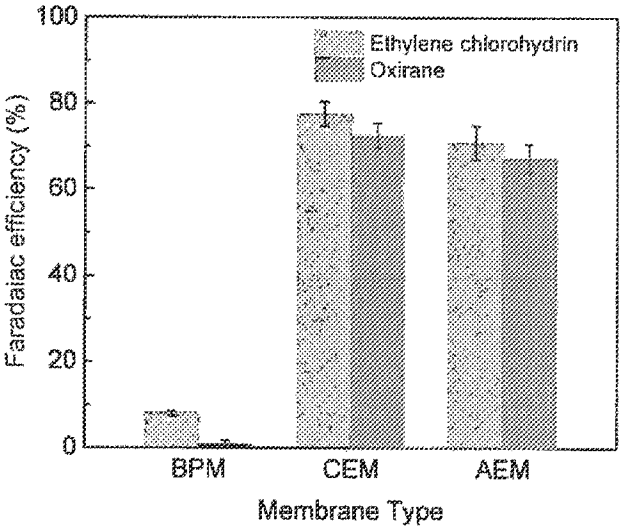

The final step (Equation 4) involves addition of alkali ($OH^-$), which then reacts with ethylene chlorohydrin to yield the desired ethylene oxide and regenerate $Cl^-$ (33): the hydrogen evolution reaction (FIG. 8A) at the cathode during electrolysis generates the $OH^-$ needed to do this. In this electrochemical system, an AEM is used, which prevents complete mixing of the catholyte and the anolyte. Consequently, at the end of electrolysis, the pH of the catholyte becomes alkaline with a pH value of 13.8. This means that by merging the catholyte and anolyte output streams (performed post electrolysis), ethylene oxide can be generated from the reaction between ethylene chlorohydrin and $OH^-$ (FIG. 2C). It can be noted that in principle, a cation exchange membrane would be better in preventing crossover of $OH^-$ (FIG. 8B). However, this leads to a continuous decrease in electrolyte (anolyte) conductivity during operation, resulting in lowered performance (see FIG. 8C).

Figure 9A:
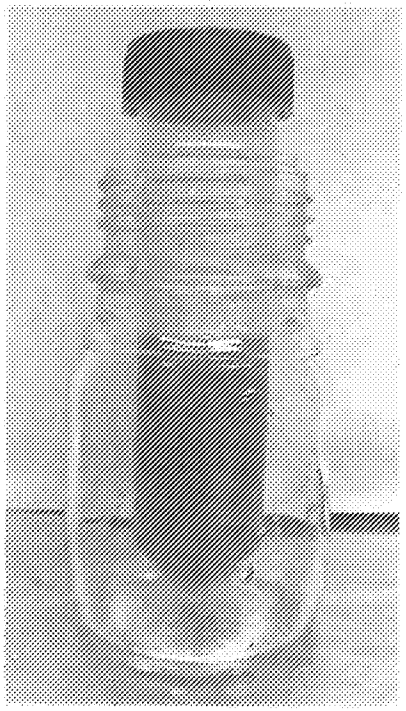
FIG. 9. (A) Digital photograph of the anolyte after addition of excess 10% KI solution. A brown coloration is observed due to oxidation of $I^-$ to form $I_2$. (B) Digital photograph of the same anolyte after starch solution was added, forming a dark blue starch-iodine complex. (C) Digital photograph of the anolyte after titration with $Na_2S_2O_3$, yielding a clear colorless solution.
Figure 9B:
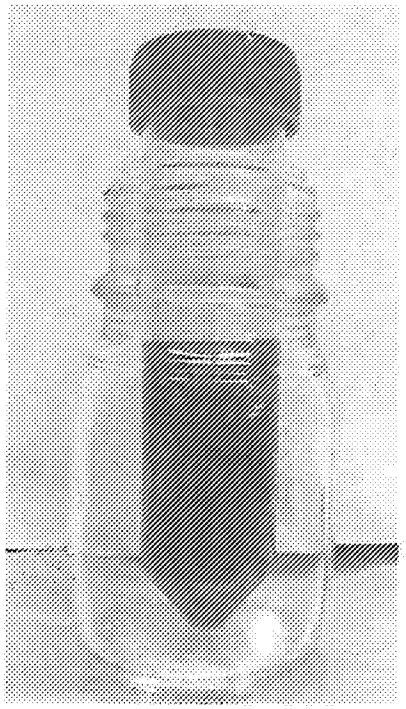
Figure 9C:
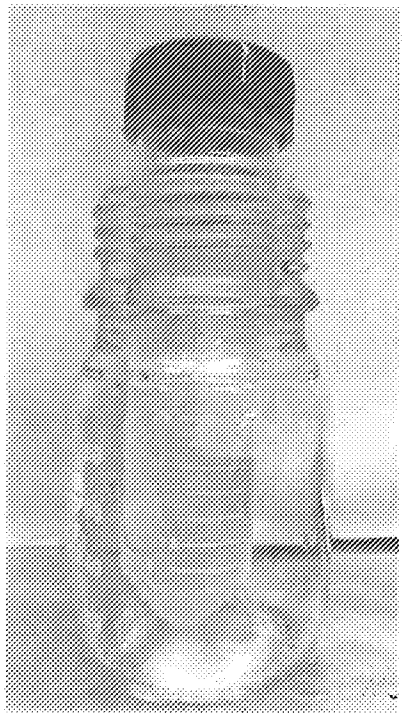

In sum, this system enables the generation of ethylene oxide in a single electrolyzer under ambient temperatures and pressures: ethylene, water and electricity are the consumables. Using this method, this work achieved a Faradaic efficiency of 70 (±1) % toward ethylene oxide (FIG. 2D) with 1.0 M KCl at 300 mA/cm$^2$. Similar Faradaic efficiencies of 71 (±1) % and 70 (±1) % are maintained even at current densities of 500 and 800 mA/cm$^2$, respectively (FIG. 2D). A possible explanation for the missing charge could be $O_2$ evolution or complete oxidation of ethylene to form $CO_2$; however, when this work performed gas chromatography on the output gas stream, one did not detect $O_2$ nor $CO_2$. This work hypothesized that the missing charge could be due to unreacted chlorine/hypochlorite species in the electrolyte: this was confirmed using iodometric titration (see FIG. 9 and Table 2).

Figure 10A:
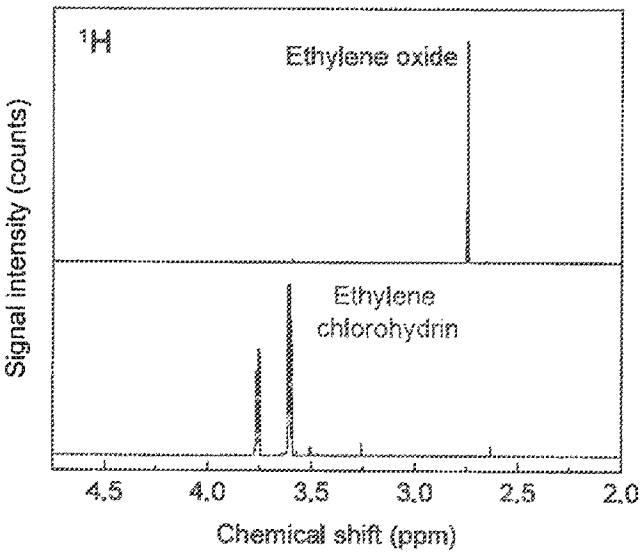
FIG. 10. (A) $^1H$ NMR spectra of ethylene oxide and ethylene chlorohydrin. (B) Close-up of the characteristic features of ethylene chlorohydrin in the $^1H$ NMR spectra. (C) $^1H$ NMR spectra of $^{13}C_2H_4O$ (ethylene oxide) and $^{13}C_2H_5ClO$ (ethylene chlorohydrin) generated from electrolysis experiments using $^{13}C_2H_4$.
Figure 10B:
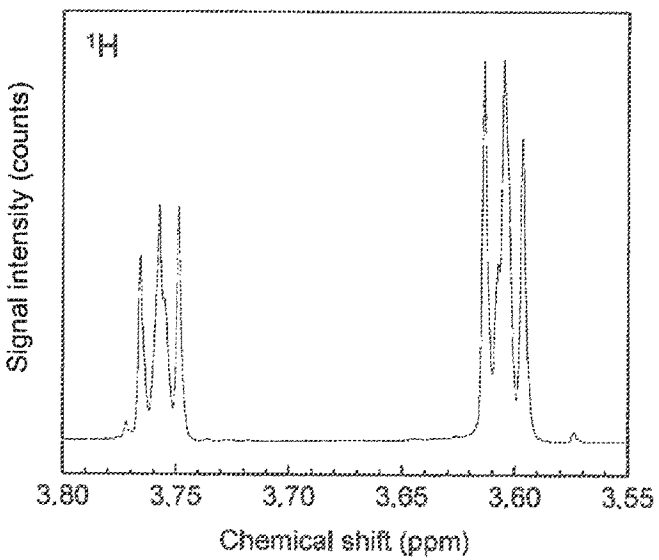
Figure 10C:
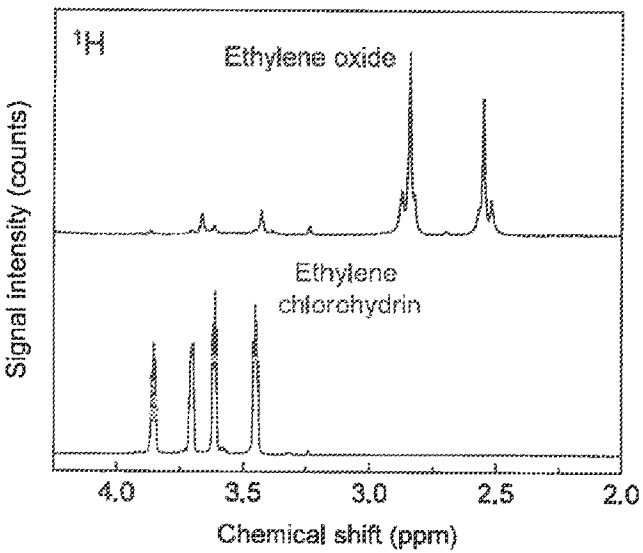
Figure 11A:
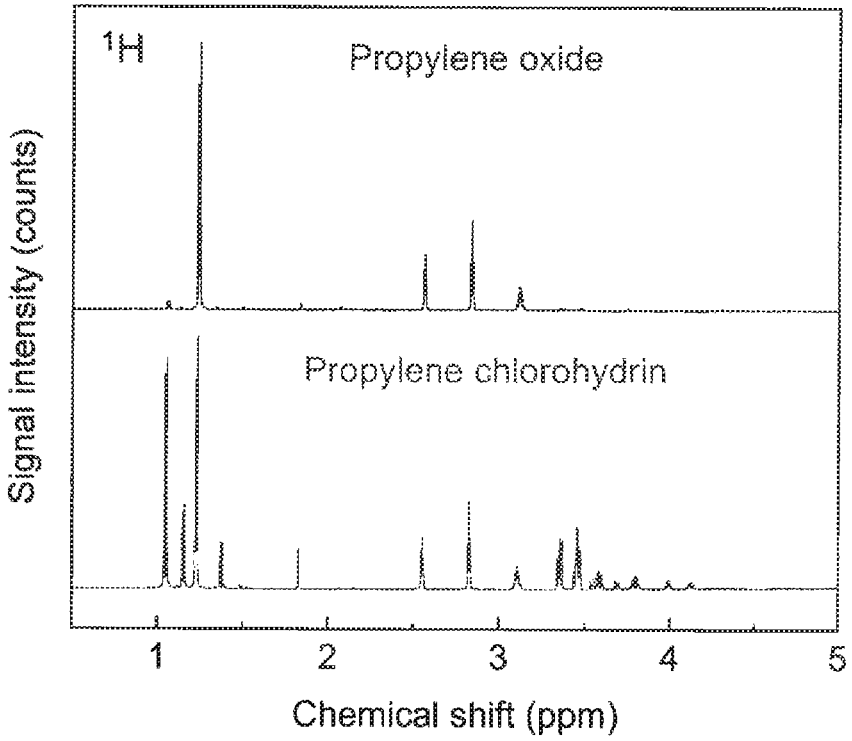
FIG. 11. (A) $^1H$ NMR spectra of propylene oxide and propylene chlorohydrin. (B) Techno-economic analysis (TEA) of propylene oxide production showing plant-gate levelized cost as a function of energy efficiency and renewable energy cost.
Figure 11B:
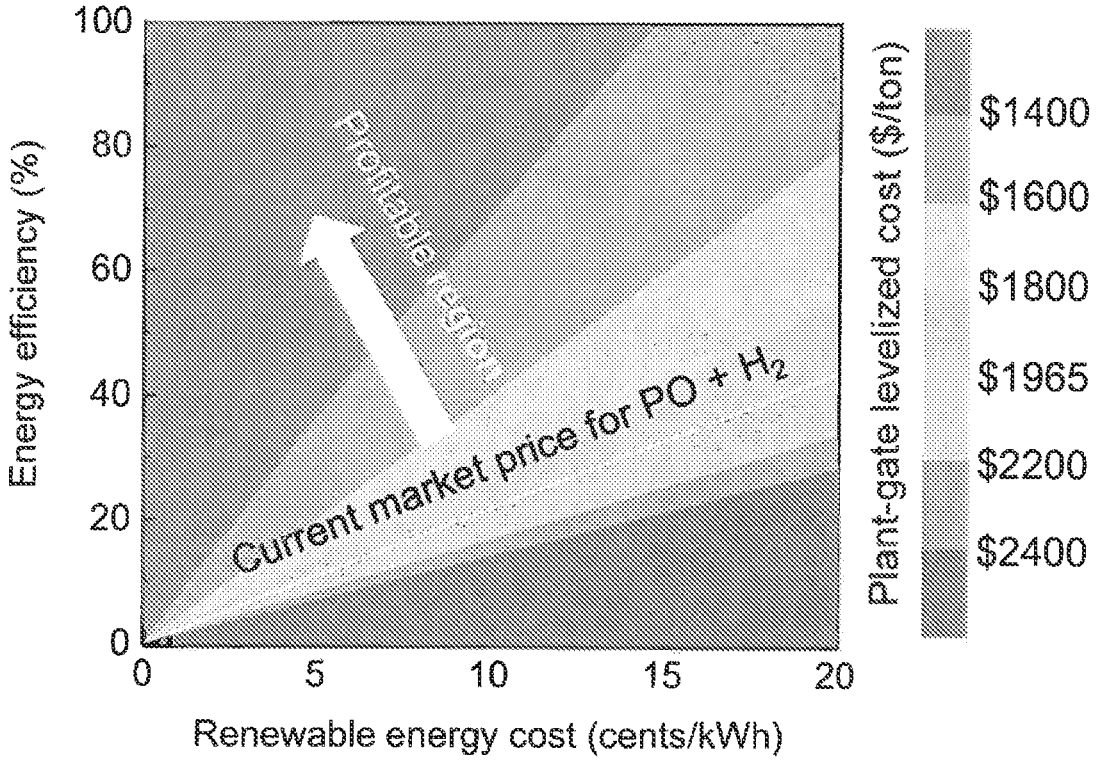

This work performed the same experiments but using carbon-13 labelled ethylene ($^{13}C_2H_4$): $^{13}C$ NMR and $^1H$ NMR results confirm that the products observed are indeed due to the partial oxidation of ethylene (FIG. 2E and FIG. 10). The method could also be used for the epoxidations of other olefins; for instance, when one replaces ethylene with propylene, Faradaic efficiencies are 69-71% toward propylene oxide—a commodity chemical with a 10 million ton per annum market in the plastics industry (34)—at current densities of 300-800 mA/cm$^2$ (FIG. 2F and FIG. 11).

Figure 1B:
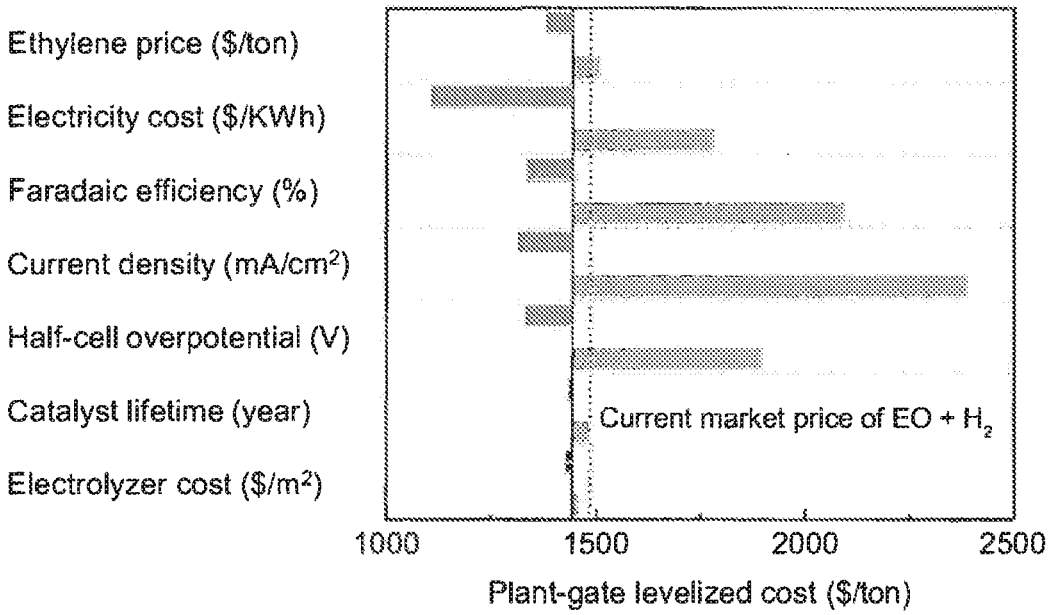
Figure 1D:
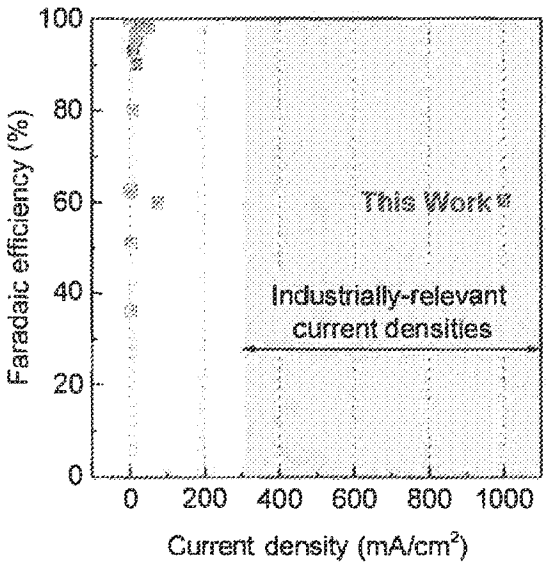
Figure 1C:
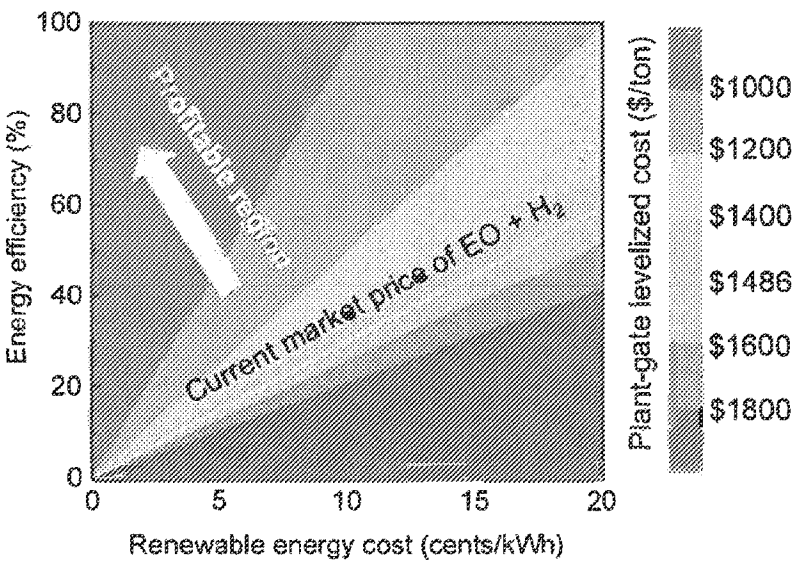
Figure 1E:
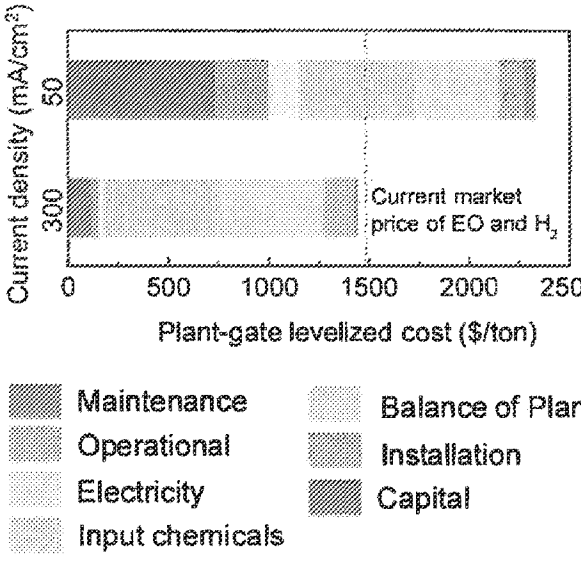
Figure 3A:
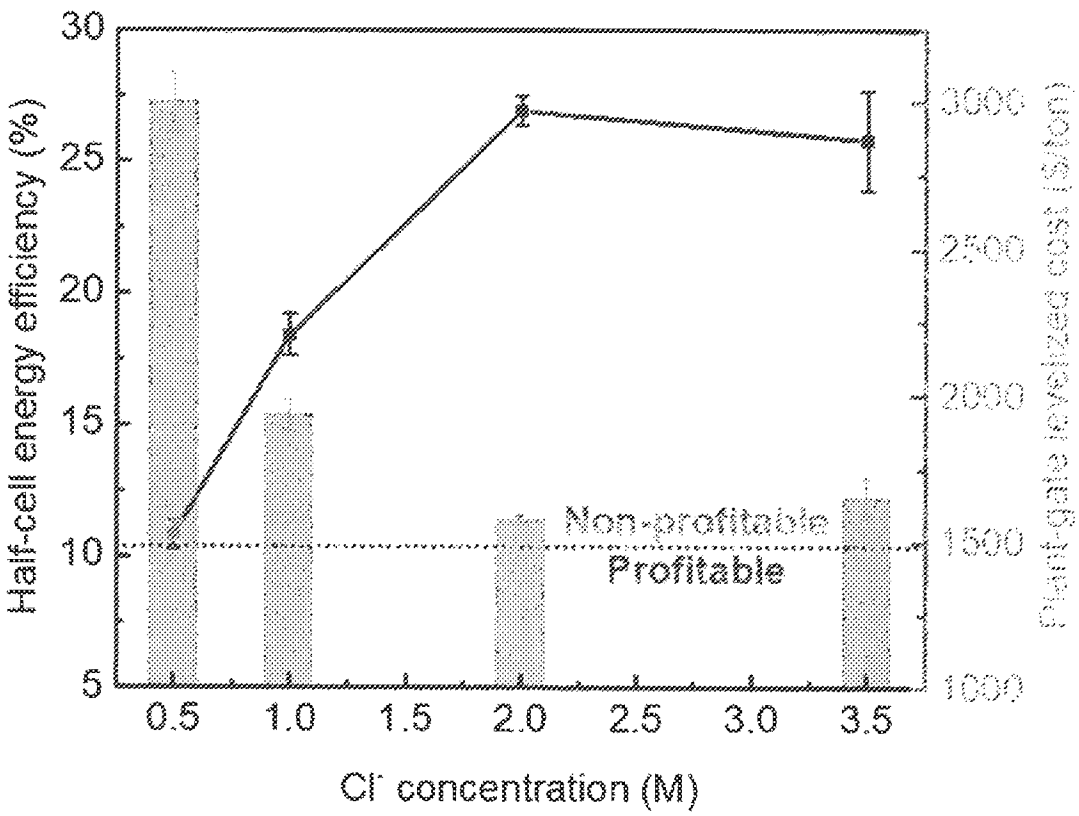
FIG. 3. Optimization of energy efficiency to reduce energy cost and maximize technoeconomic benefit. (A) Half-cell energy efficiency and the corresponding plant-gate levelized cost as a function of $Cl^-$ concentration. XPS spectra of (B) Ir 4f, (FIG. 3C) Ti 4f and (D) O 1s. (E) SEM image of the $IrO_2$/Ti mesh. (F) EDX images showing the distribution of Ir, Ti and O on the $IrO_2$/Ti mesh. (G) Half-cell energy efficiency and the corresponding plant-gate levelized cost as a function of current density. Note: our half-cell energy efficiencies are based on our reported potentials vs. Ag/AgCl, which are not IR-corrected. Additionally, it was assumed that no losses occurred at the cathode side, where hydrogen evolution occurs.

The sensitivity analysis of FIG. 1B revealed that the plant-gate levelized cost is sensitive to electrochemical parameters such as Faradaic efficiency and cell potential (FIGS. 1B and 1C). To reduce energy cost, it was sought to increase the energy efficiency of the reaction by varying the electrolyte concentration while operating at 300 mA/cm$^2$. This work began at lower $Cl^-$ concentration (0.5 M); however, oxygen evolution from water dominates the anodic reaction, resulting in a low Faradaic efficiency of 30 (±1) % and energy efficiency of 11 (±1) % (FIG. 3A). As the $Cl^-$ concentration increases (1.0 M and 2.0 M), the overpotential decreases (5.8 (±0.2) V and 4.0 (±0.1) V) due to improved $Cl^-$ oxidation kinetics and increased electrolyte conductivity, leading to increased Faradaic efficiencies (70 (±1) % and 67(±1) %) and half-cell energy efficiencies (18(±1) % and 27 (±1) %. At 3.5 M, however, the energy efficiency was unimproved at 26 (±1.9) % as the reduced potential (3.6 (±0.2) V) is negated by a slight decrease in Faradaic efficiency to 55 (±1) %, likely because the increased $Cl^-$ concentration is unfavorable for the disproportionation of $Cl_2$ into HOCl and HCl (equation 2). Thus, based on the corresponding plant-gate levelized costs, this work determined the optimal $Cl^-$ concentration to be 2.0 M. In this work all potentials are reported vs. Ag/AgCl and are not IR-corrected.

Figure 3B:
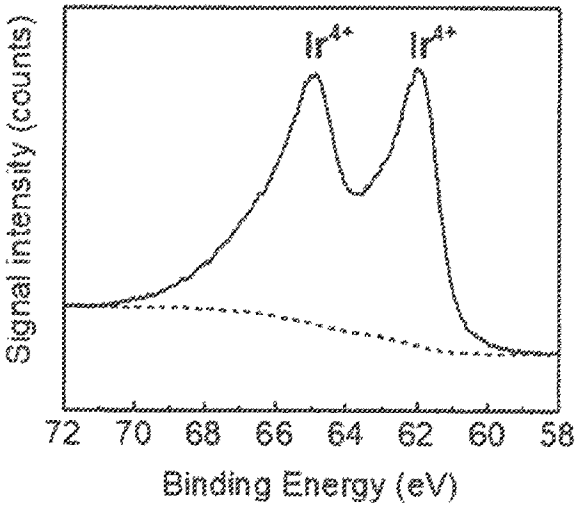
Figure 3C:
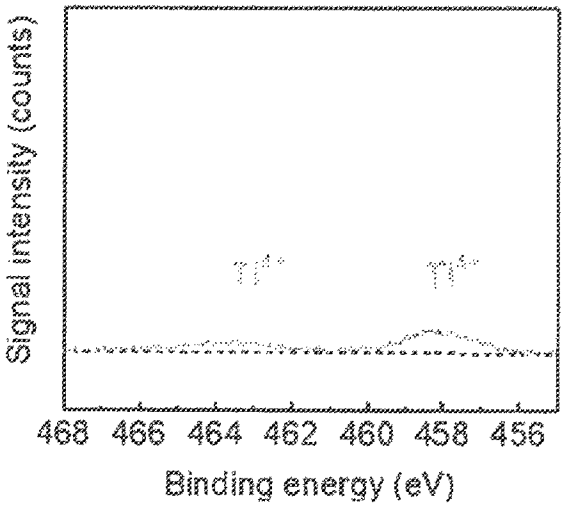
Figure 3D:
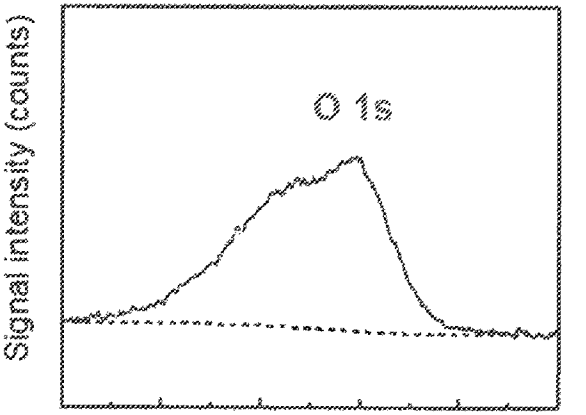
Figure 3E:
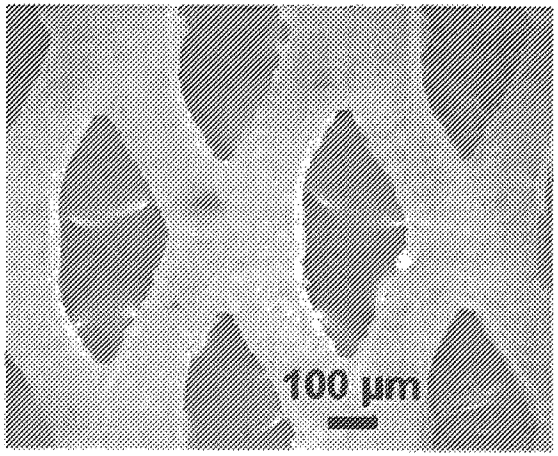
Figure 12A:
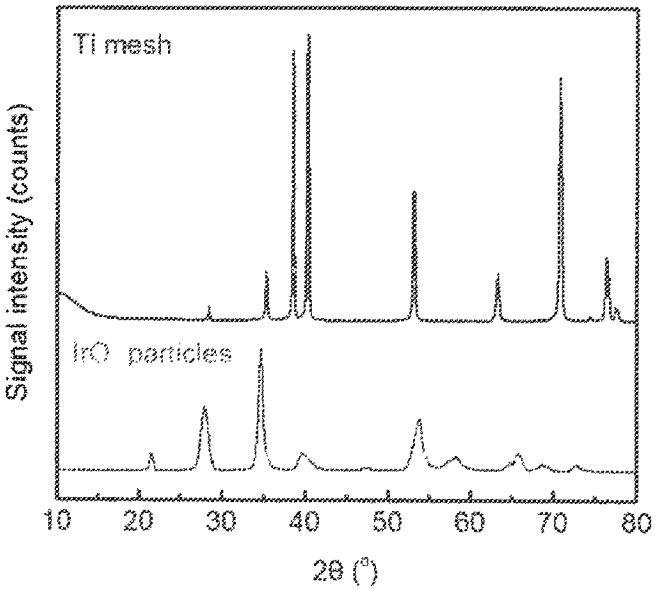
FIG. 12. (A) XRD spectra of the $IrO_2$/Ti mesh and $IrO_2$ particles. (B) and (C): TEM images of the $IrO_2$ particles at different degrees of magnification.
Figure 12B:
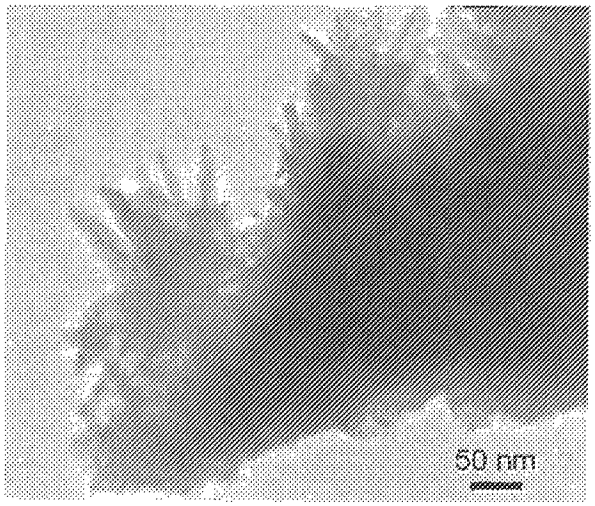
Figure 12C:
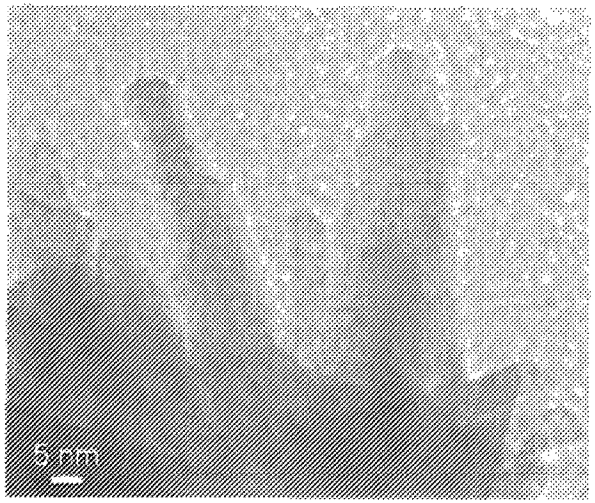
Figure 13A:
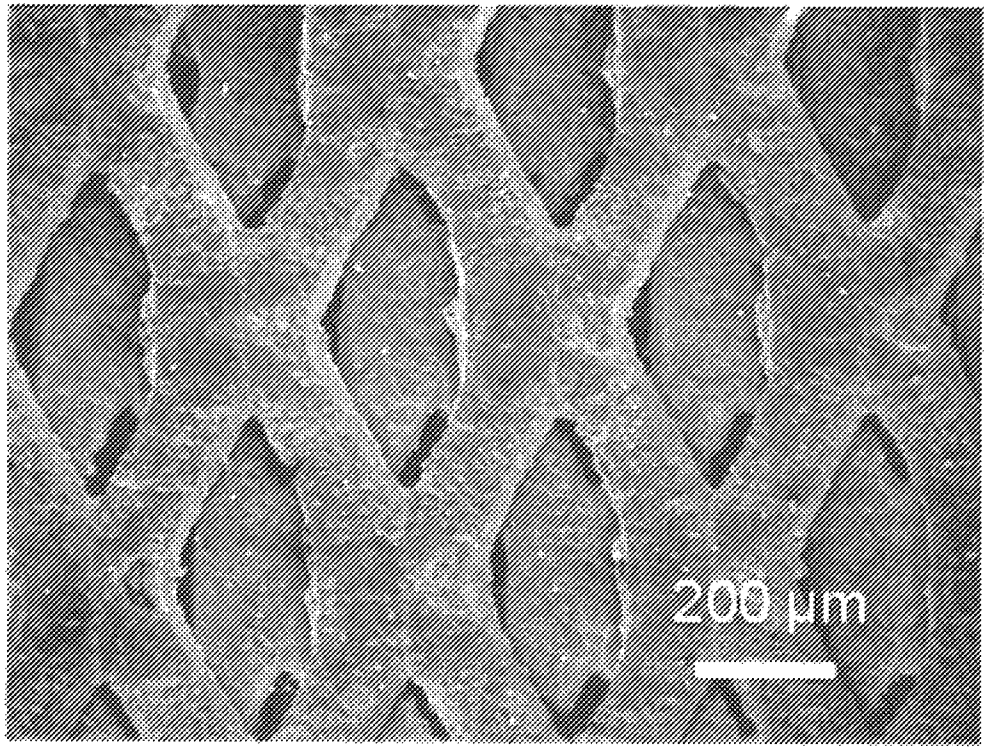
FIG. 13. (A) SEM image of the $IrO_2$/Ti mesh after electrochemical ethylene oxide production at 300 mA/cm$^2$ for 100 h.
(FIGS. 13B-13E) EDX images showing the distribution of Ir, Ti and O on the $IrO_2$/Ti mesh after reaction.
Figure 13B:
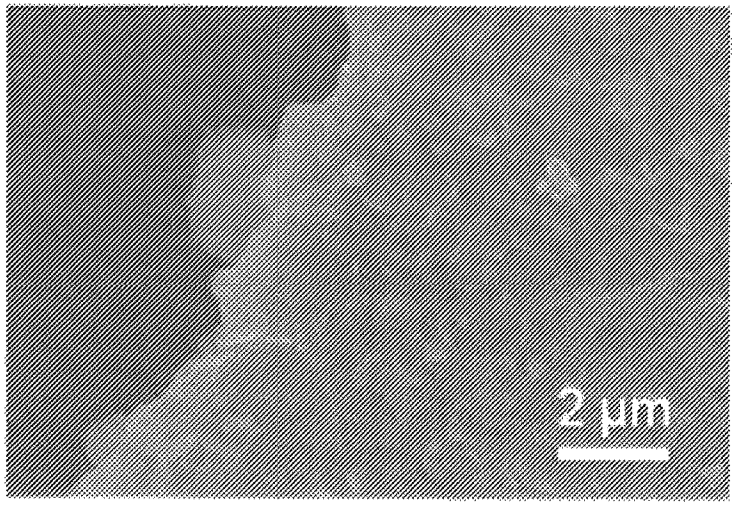
Figure 13C:
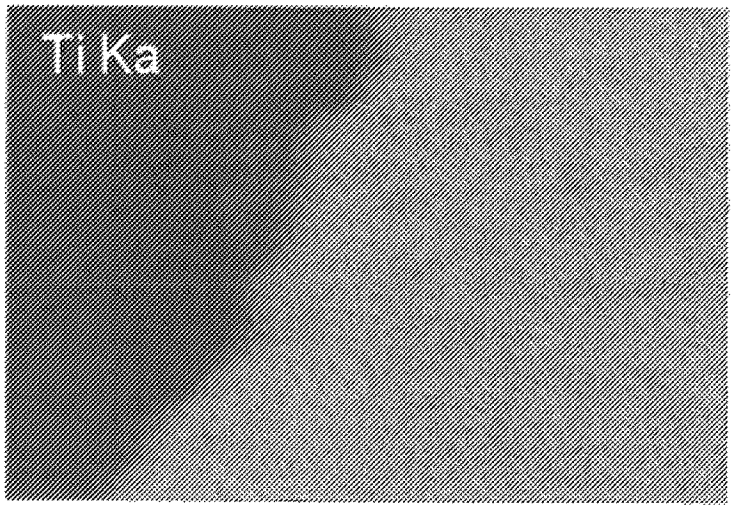
Figure 13D:
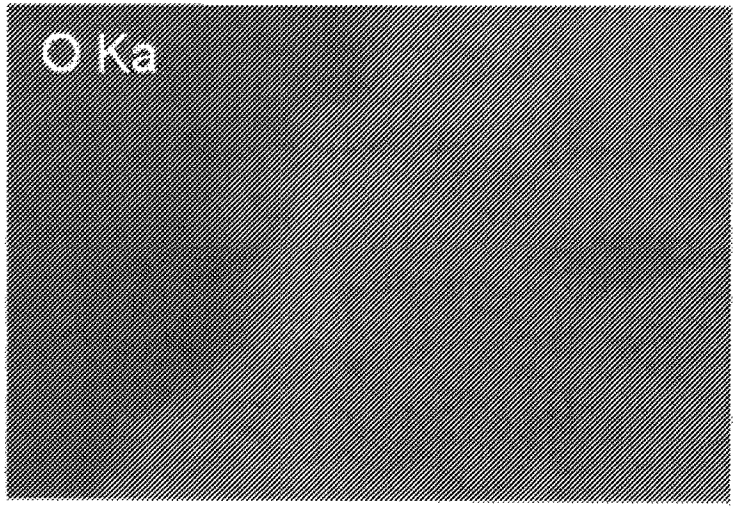
Figure 13E:
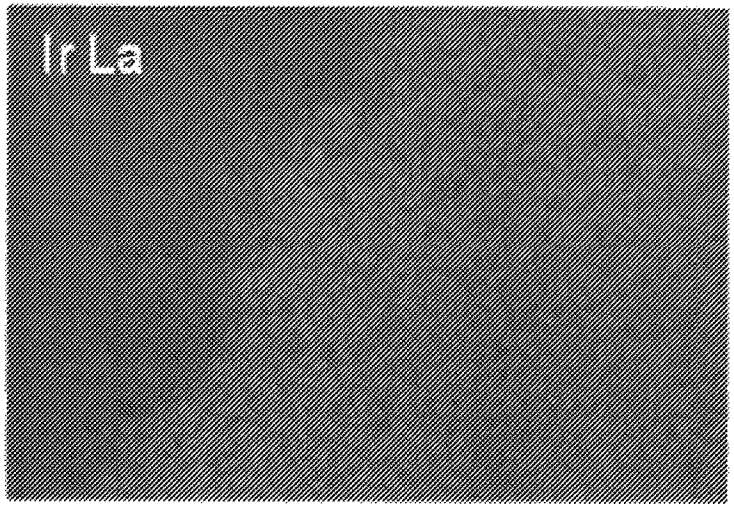

Even at the optimal $Cl^-$ concentration, the renewable electricity-based plant-gate levelized cost remains higher than the current market price per ton of ethylene oxide and the corresponding quantity of hydrogen (FIG. 3A). This work turned to the working electrode (catalyst) as another degree of freedom to decrease the overpotential. This work prepared $IrO_2$ deposited on Ti mesh (FIG. 3A) using a dip coating and thermal decomposition procedure (35). X-ray photoelectron spectroscopy (XPS) results confirm the presence of Ir in an oxidation state of 4+(FIG. 3B-3D). SEM images show the microscale mesh structure of the $IrO_2$ coated Ti mesh (FIG. 3E). Energy-dispersive X-ray spectroscopy (EDX) confirmed the presence of Ir and O on the Ti mesh, indicating the loading of $IrO_2$ on Ti (FIG. 3F). X-ray diffraction was also performed on the $IrO_2$ coating as well as the bare Ti mesh (FIG. 12A). Additionally, TEM images of the $IrO_2$ were taken as well (FIGS. 12B and 12C). Using this, this work reduced the required applied potential from 3.4 (±0.1) V to 3.0 (±0.1) V, thus further raising the half-cell energy efficiency to 30 (±1) % at 300 mA/cm$^2$.

Figure 3G:
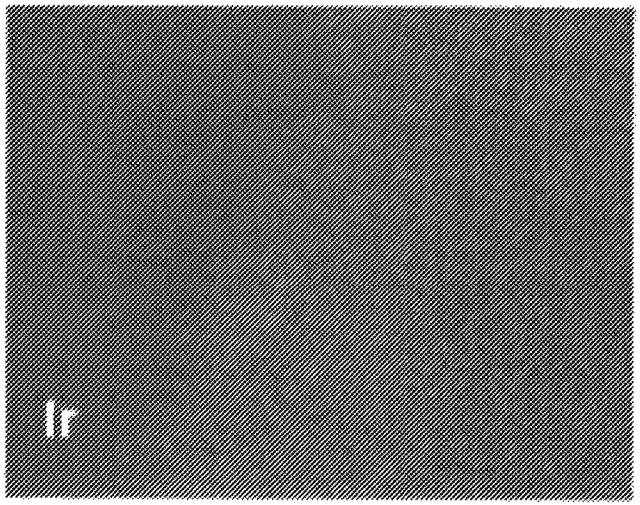
Figure 3F:
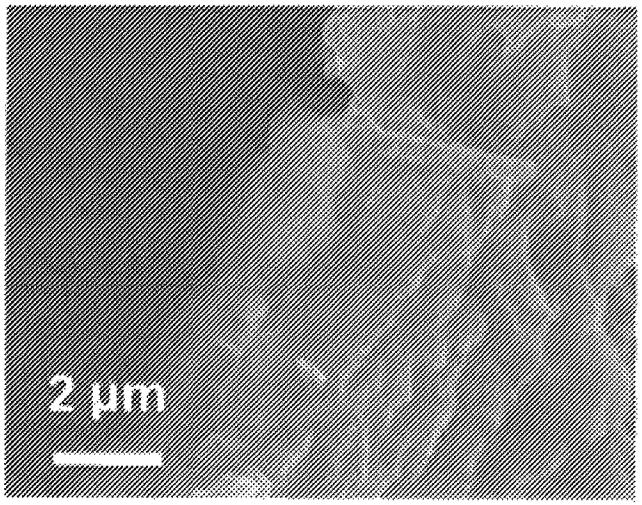
Figure 3I:
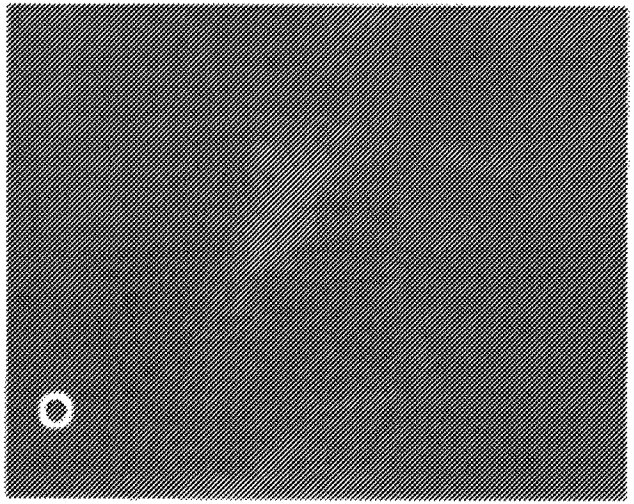
Figure 3H:
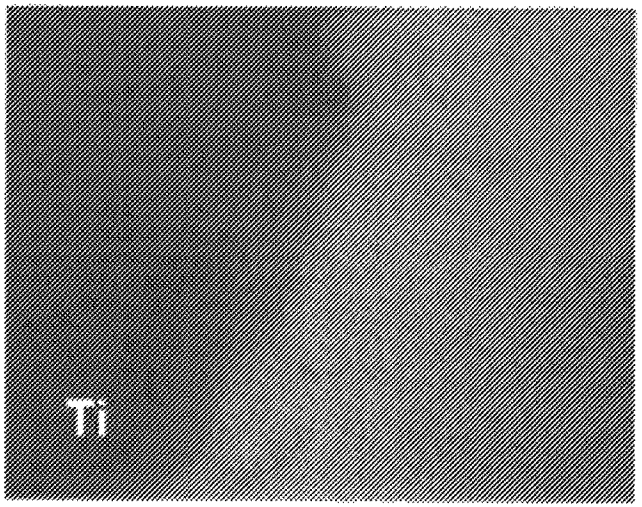
Figure 3J:
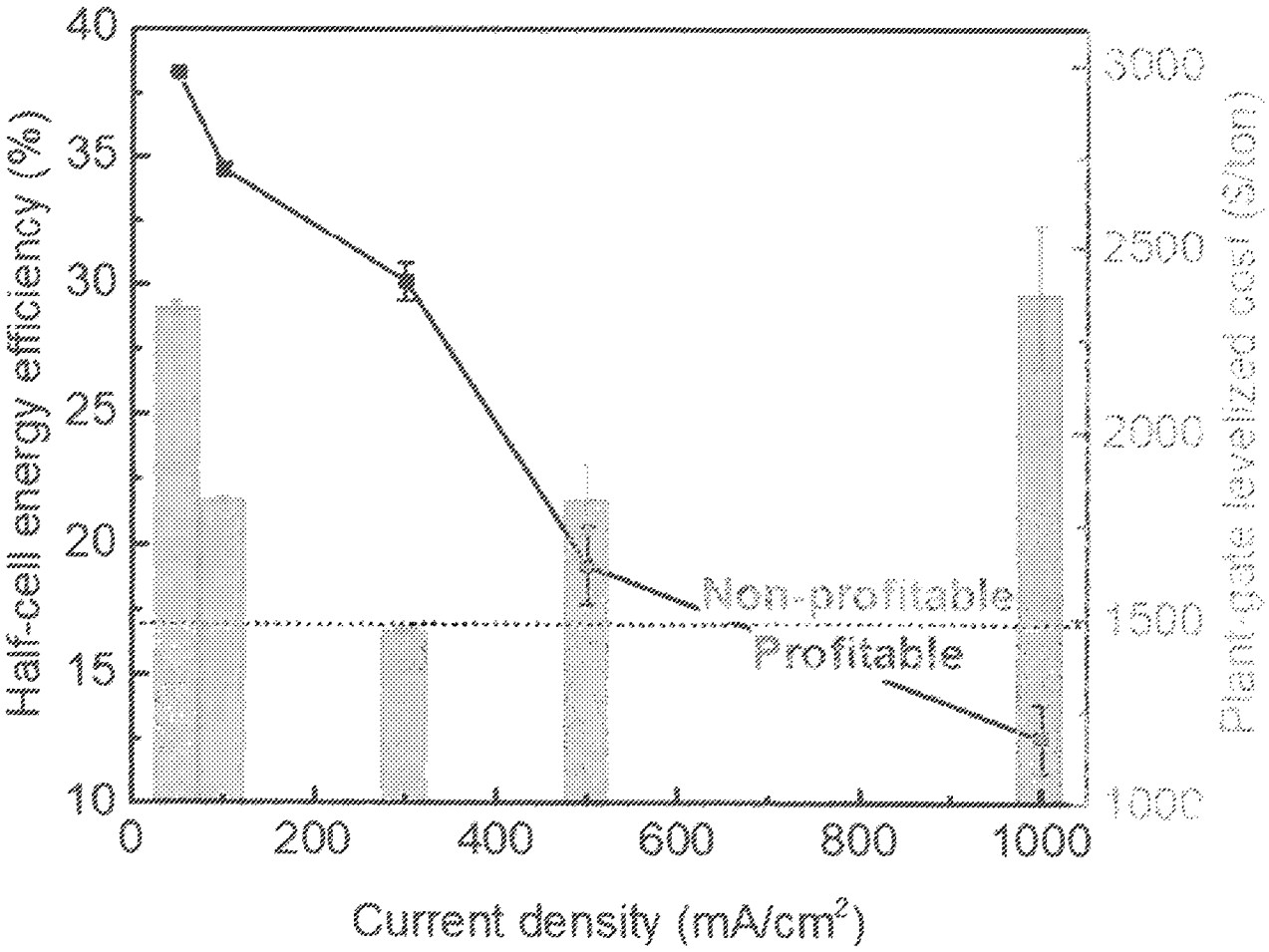

Having optimized the electrochemical system, we measured the energy efficiencies and plant-gate levelized costs under different current densities to determine the most economical conditions for industrial manufacturing (FIG. 3G). Faradaic efficiencies were maintained even at a current density of 1 A/cm$^2$ (60 (±4) %). However, a much higher potential of 6.5(±0.5) V was required to drive the larger current, leading to a low half-cell energy efficiency (12(±1) %). On the other hand, the half-cell energy efficiency is high at 38.3(±0.1) % under 50 mA/cm$^2$, thus the electricity cost per ton of ethylene oxide is at the lowest. However, the high capital cost associated with electrolyzer surface area resulted in an uneconomical plant-gate levelized cost. The plant-gate levelized cost is the lowest at 300 mA/cm$^2$; with good energy efficiency of 30 (±1) % and acceptably low capital costs.

Figure 4A:
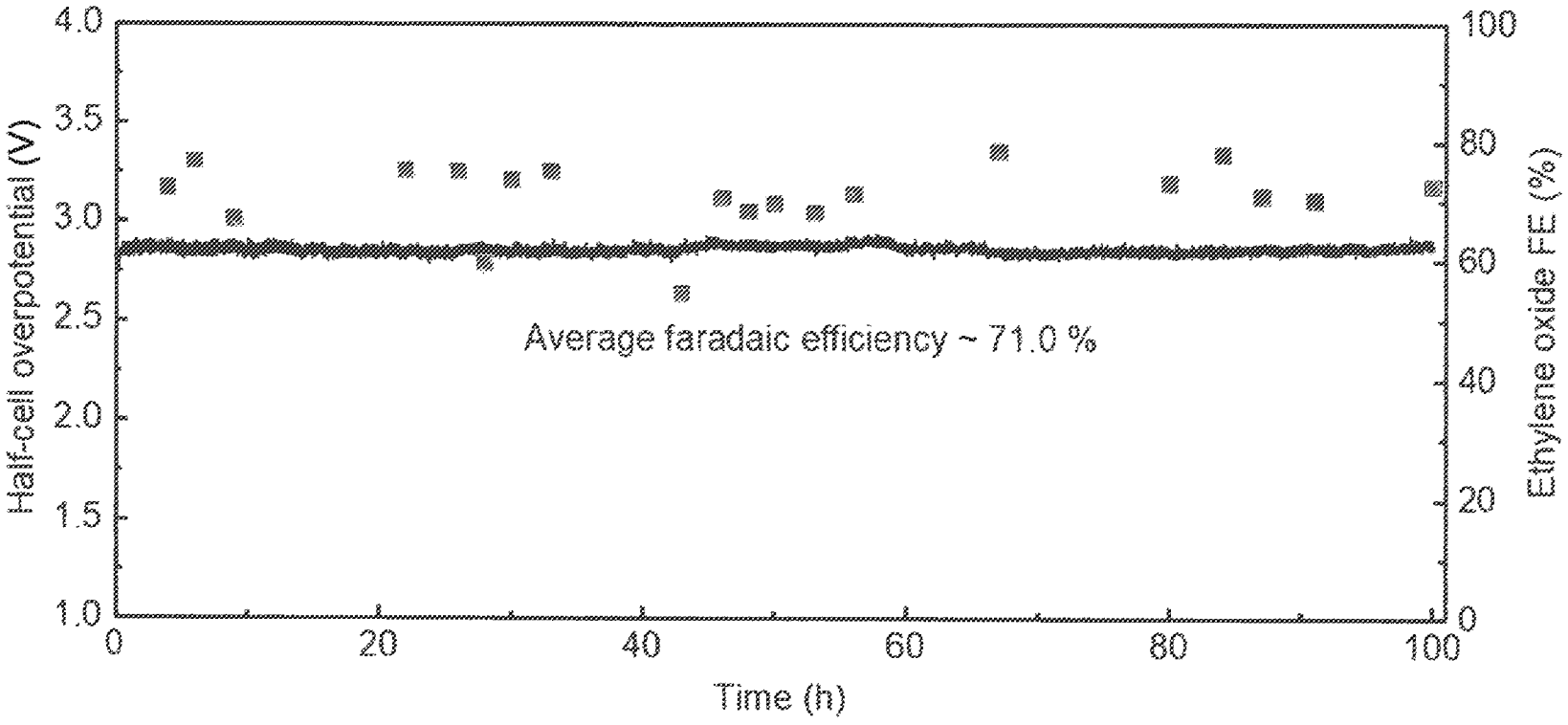
FIG. 4. Evaluation of ethylene-to-ethylene oxide performance. (A) Half-cell overpotential and Faradaic efficiency of ethylene oxide over 100 h at 300 $mA/cm^2$. (B) Comparison of current density, product generation rate, reported operation time, Faradaic efficiency and product selectivity against state-of-art anodic upgrading reactions. Specificity refers to the percentage of all reacted substrate going towards the desired product. (C) Schematic of the $CO_2$-to-ethylene oxide (EO) process in which the ethylene-to-EO cell was directly supplied with the gas output from a $CO_2$-to-ethylene MEA. (D) Faradaic efficiencies of ethylene (in MEA) and ethylene oxide (in flow cell) as a function of the gas flow rate. For all cases, the MEA was run at 240 $mA/cm^2$ and the ethylene oxidation flow cell was operated at 300 $mA/cm^{-2}$ for a duration of 1 h.
Figure 4B:
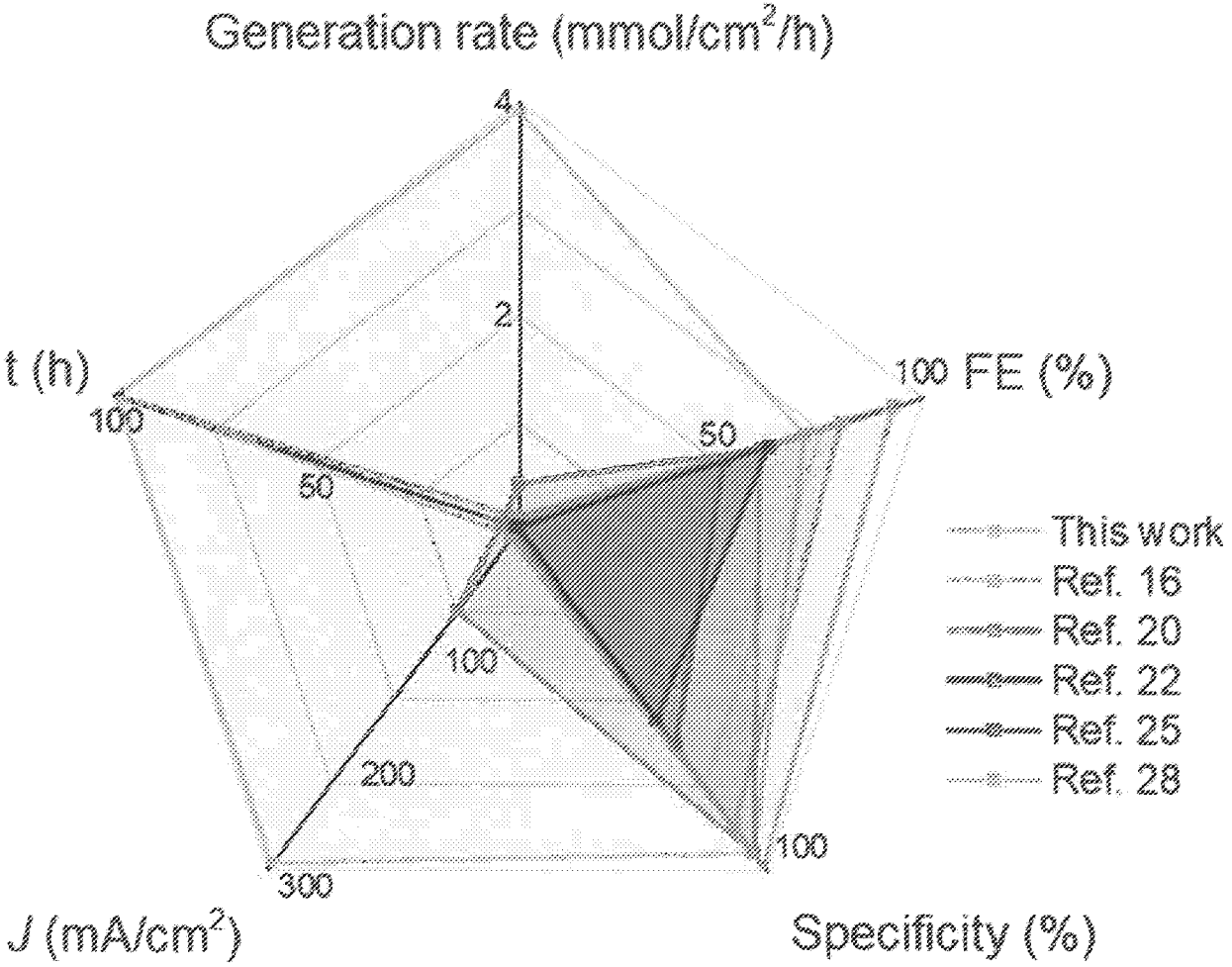

Based on this analysis, this work investigated the stability of the catalyst system at the most profitable current density of 300 mA/cm$^2$, during which portions of the electrolyte are periodically removed for analysis and replaced with fresh electrolyte. The system maintained a stable applied potential of 2.86(±0.02) V and Faradaic efficiency averaging 71(±0.6) % for 100 hours continuously. Post-reaction analysis of the anode through SEM and EDX revealed no obvious structural changes of the Ti mesh surface nor loss of $IrO_2$ (FIG. 13). The method significantly outperforms other reported anodic upgrading reactions in current density, product generation rate and reported operation time, while maintaining Faradaic efficiency and ethylene oxide specificity (FIG. 4B). In this case, specificity refers to the percentage of reacted substrate (ethylene) that goes to the desired product. The specificity in this case is 100%, since one does not observe the conversion of ethylene to other products (e.g. $CO_2$). This is important in an industrial process, since the ethylene will likely be continuously recirculated to maximize usage.

Figure 4C:
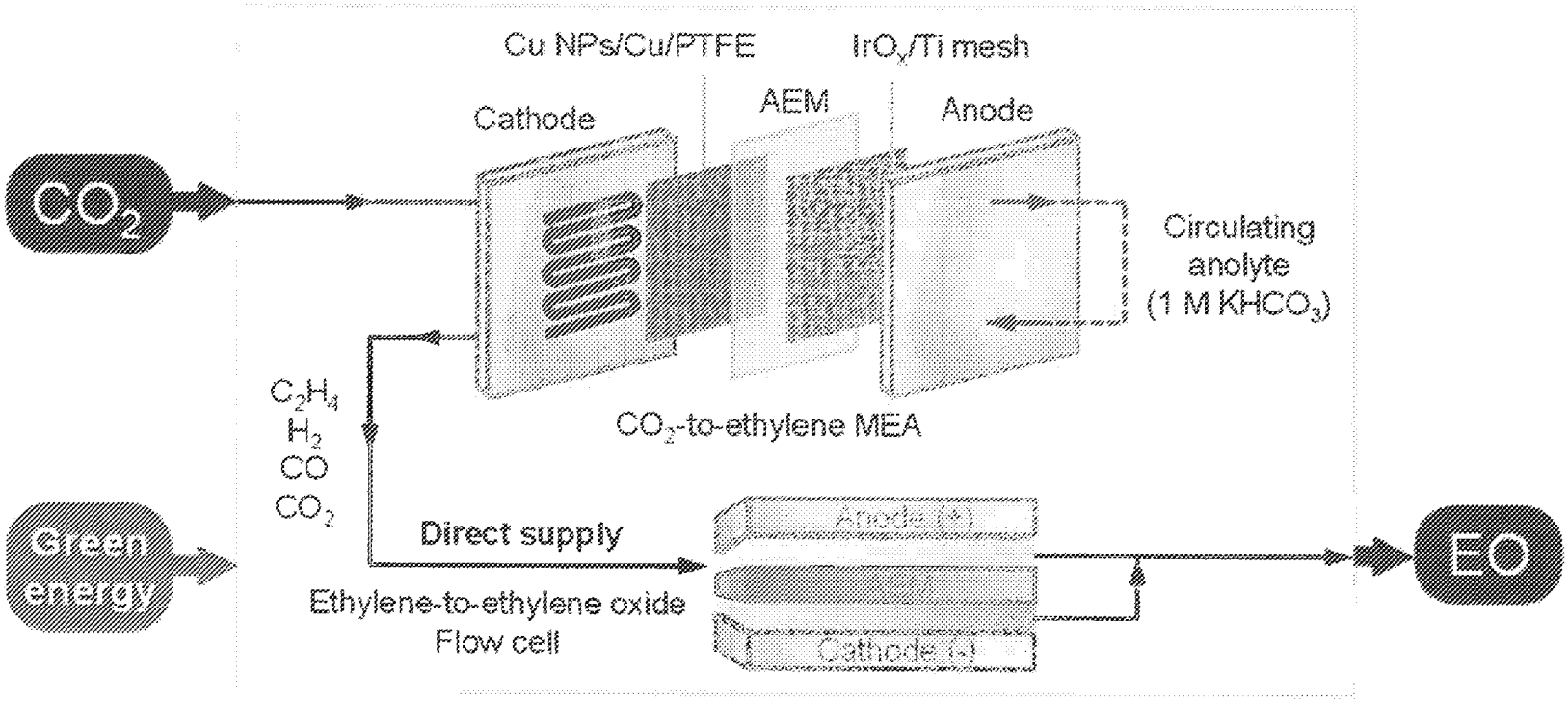
Figure 4D:
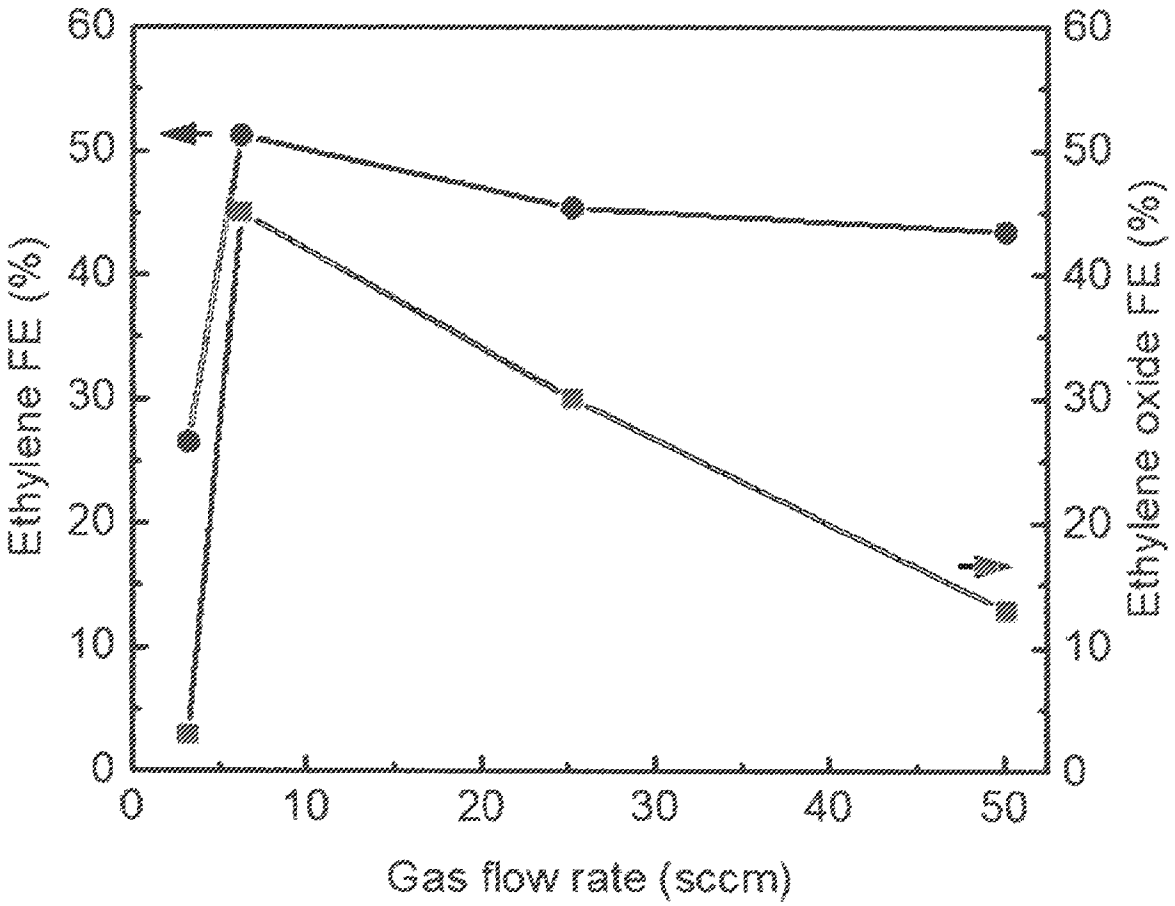

Finally, this work sought to develop an integrated system to perform the electrosynthesis of ethylene oxide from $CO_2$ (rather than ethylene) as the starting feedstock. This provides a route to directly use renewable electricity for recycling $CO_2$ into a valuable commodity chemical. In this integrated system, $CO_2$ reduction to ethylene is first performed using a membrane electrode assembly (MEA) in a gas diffusion configuration (FIG. 4C). The MEA comprises a copper nanoparticle/copper/polytetrafluoroethylene (Cu NPs/Cu/PTFE) cathode and an $IrO_x$/Ti mesh anode separated by an AEM, through which 0.1 M $KHCO_3$ anolyte was continuously circulated. The operating current density was kept at 240 mA/cm$^2$ and the ethylene Faradic efficiency is generally maintained at 43-52% (FIG. 4D). The flow rate of the output gas was measured using a flow meter at the cathode gas outlet, and directly sparged into the anolyte of the ethylene-to-ethylene oxide flow cell (operated at 300 mA/cm$^{-2}$) without further purification.

Figure 14B:
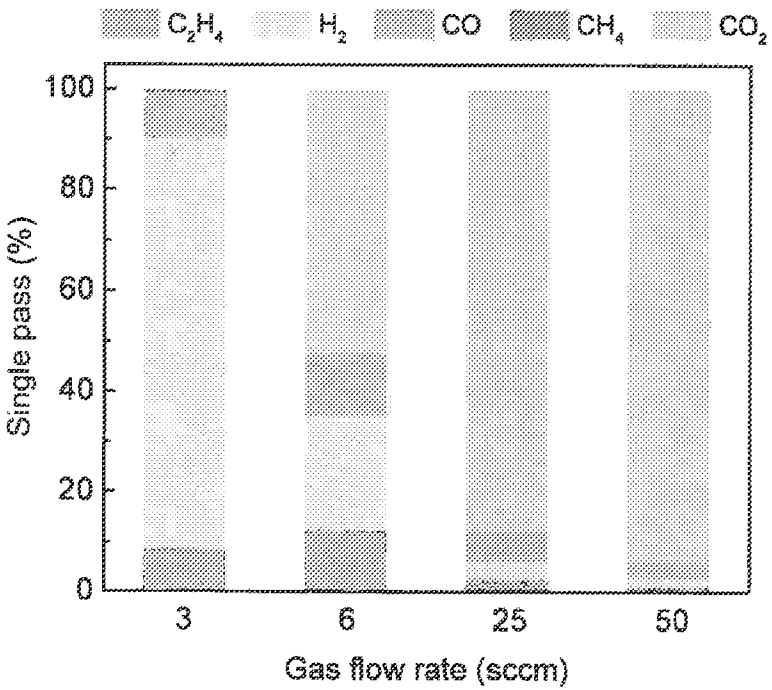
FIG. 14. (A) Faradaic efficiencies and (B) composition of the MEA outlet gas stream at different gas flow rates.
Figure 14A:
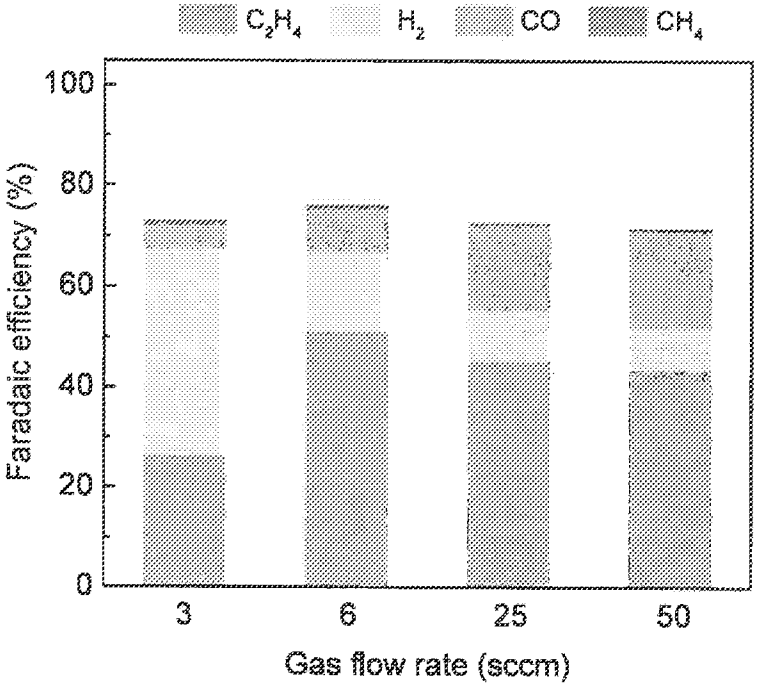

Through this method, this work achieves a Faradaic efficiency of 45% toward ethylene oxide under a gas flow rate of 6 sccm (FIG. 4D), despite the presence of other easily oxidizable gases such as $H_2$ and CO relative to ethylene (23% $H_2$, 12% CO and 12% ethylene, see FIG. 14). It is noted that the oxidation of these gases requires direct contact with the anode, whereas ethylene oxidation is mediated by the extended heterogeneous:homogeneous interface and thus occurs in the bulk electrolyte at a much higher rate. The Faradaic efficiency towards ethylene oxide is reduced at a higher gas flow rate due to lowered ethylene concentration in the MEA output stream (see FIG. 14). However, decreasing the flow rate even further (3 sccm) results in a lowered Faradaic efficiency towards ethylene in the MEA. This reduces the ethylene supply available for conversion in the flow cell, resulting in a drop in the Faradaic efficiency towards ethylene oxide. Thus, both concentration and molar quantity of ethylene in the MEA output stream are important determinants for the Faradaic efficiency toward ethylene oxide in the flow cell.

In conclusion, this work reports a strategy to produce ethylene oxide, with ethylene, renewable energy, and water as the raw inputs. An extended heterogeneous:homogeneous interface, using $Cl^-$ as a reservoir for positive charges from the anode, enables us to overcome the problems of over-oxidation and mass transport limitations, which enables a stable Faradaic efficiency of 71(±1) % toward ethylene oxide at a high current density of 300 mA/cm$^2$ for 100 h. This work achieved a Faradaic efficiency of 45% to ethylene oxide in an integrated system using ethylene generated from a $CO_2$-to-ethylene MEA. This demonstration shows the viability of an integrated system for complete $CO_2$-to-ethylene oxide conversion. Further improvements are expected by optimizing the ethylene Faradaic efficiency and single pass conversion in the MEA. In light of the energy-to-product efficiency and operating stability, this strategy is one platform to develop processes that utilize renewable electricity for the production of chemicals with the aim of a decarbonized chemicals industry.

INITIAL REFERENCES AND NOTES

1. "Energy use in industry," *Use of energy explained* (U.S. Energy Information Administration, 2019).
2. S. Chu, Y. Cui, N. Liu, The path towards sustainable energy. *Nat. Mater.* 16, 16 (2016).
3. Z. W. Seh et al., Combining theory and experiment in electrocatalysis: Insights into materials design. *Science* 355, eaad4998 (2017).
4. J. Zheng, S. Suh, Strategies to reduce the global carbon footprint of plastics. *Nat. Clim. Change.* 9, 374-378 (2019).
5. P. De Luna et al., What would it take for renewably powered electrosynthesis to displace petrochemical processes? *Science* 364, eaav3506 (2019).
6. M. Jouny, W. Luc, F. Jiao, General Techno-Economic Analysis of $CO_2$ Electrolysis Systems. *Ind. Eng. Chem. Res.* 57, 2165-2177 (2018).
7. C. Xia, Y. Xia, P. Zhu, L. Fan, H. Wang, Direct electrosynthesis of pure aqueous $H_2O_2$ solutions up to 20% by weight using a solid electrolyte. *Science* 366, 226-231 (2019).
8. R. F. Service, Renewable bonds. *Science* 365, 1236-1239 (2019).
9. S. Rebsdat, D. Mayer, in *Ullmann's Encyclopedia of Industrial Chemistry*. (2001).
10. "Ethylene," *WP Report*. (SRI Consulting., 2009).
11. "Ethylene oxide," *WP Report*. (SRI Consulting., 2009).
12. "Bio-Mono Ethylene Glycol (MEG) from renewable source—An India Glycols Limited case study," (International Council of Chemical Associations, 2017).
13. S. T. Wismann et al., Electrified methane reforming: A compact approach to greener industrial hydrogen production. *Science* 364, 756-759 (2019).
14. K. M. Van Geem, V. V. Galvita, G. B. Marin, Making chemicals with electricity. *Science* 364, 734-735 (2019).
15. D. Dudley, "Renewable Energy Costs Take Another Tumble, Making Fossil Fuels Look More Expensive Than Ever," (Forbes, 2019).

16. H. G. Cha, K.-S. Choi, Combined biomass valorization and hydrogen production in a photoelectrochemical cell. *Nat. Chem.* 7, 328 (2015).
17. N. Jiang, B. You, R. Boonstra, I. M. Terrero Rodriguez, Y. Sun, Integrating Electrocatalytic 5-Hydroxymethylfurfural Oxidation and Hydrogen Production via Co—P-Derived Electrocatalysts. *ACS Energy Lett.* 1, 386-390 (2016).
18. B. You, N. Jiang, X. Liu, Y. Sun, Simultaneous H2 Generation and Biomass Upgrading in Water by an Efficient Noble-Metal-Free Bifunctional Electrocatalyst. *Angew. Chem. Int. Ed.* 55, 9913-9917 (2016).
19. T. Li, Y. Cao, J. He, C. P. Berlinguette, Electrolytic CO2 Reduction in Tandem with Oxidative Organic Chemistry. *ACS Cent. Sci.* 3, 778-783 (2017).
20. R. S. Sherbo, R. S. Delima, V. A. Chiykowski, B. P. MacLeod, C. P. Berlinguette, Complete electron economy by pairing electrolysis with hydrogenation. *Nat. Catal.* 1, 501-507 (2018).
21. J. Zheng et al., Hierarchical Porous NC@CuCo Nitride Nanosheet Networks: Highly Efficient Bifunctional Electrocatalyst for Overall Water Splitting and Selective Electrooxidation of Benzyl Alcohol. *Adv. Funct. Mater.* 27, 1704169 (2017).
22. D. Liu et al., Selective photoelectrochemical oxidation of glycerol to high value-added dihydroxyacetone. *Nat. Commun.* 10, 1779 (2019).
23. Y. Kwon, Y. Birdja, I. Spanos, P. Rodriguez, M. T. M. Koper, Highly Selective Electro-Oxidation of Glycerol to Dihydroxyacetone on Platinum in the Presence of Bismuth. *ACS Catal.* 2, 759-764 (2012).
24. C. Dai et al., Electrochemical production of lactic acid from glycerol oxidation catalyzed by AuPt nanoparticles. *J. Catal.* 356, 14-21 (2017).
25. A. Winiwarter et al., Towards an atomistic understanding of electrocatalytic partial hydrocarbon oxidation: propene on palladium. *Energy Environ. Sci.* 12, 1055-1067 (2019).
26. Y. Huang, X. Chong, C. Liu, Y. Liang, B. Zhang, Boosting Hydrogen Production by Anodic Oxidation of Primary Amines over a NiSe Nanorod Electrode. *Angew. Chem. Int. Ed.* 57, 13163-13166 (2018).
27. C. Huang, Y. Huang, C. Liu, Y. Yu, B. Zhang, Integrating Hydrogen Production with Aqueous Selective Semi-Dehydrogenation of Tetrahydroisoquinolines over a Ni2P Bifunctional Electrode. *Angew. Chem. Int. Ed.* 58, 12014-12017 (2019).
28. Y. Lum et al., Tuning OH binding energy enables selective electrochemical oxidation of ethylene to ethylene glycol. *Nature Catalysis* 3, 14-22 (2020).
29. M. Rafiee, K. C. Miles, S. S. Stahl, Electrocatalytic Alcohol Oxidation with TEMPO and Bicyclic Nitroxyl Derivatives: Driving Force Trumps Steric Effects. *J. Am. Chem. Soc.* 137, 14751-14757 (2015).
30. E. J. Horn et al., Scalable and sustainable electrochemical allylic C—H oxidation. *Nature* 533, 77 (2016).
31. M. Rafiee, F. Wang, D. P. Hruszkewycz, S. S. Stahl, N-Hydroxyphthalimide-Mediated Electrochemical Iodination of Methylarenes and Comparison to Electron-Transfer-Initiated C—H Functionalization. *J. Am. Chem. Soc.* 140, 22-25 (2018).
32. M. Eigen, K. Kustin, The Kinetics of Halogen Hydrolysis. *Journal of the American Chemical Society* 84, 1355-1361 (1962).
33. C. L. McCabe, J. C. Warner, The Kinetics of the Reaction between the Ethylene Halohydrins and Hydroxyl Ion in Water and Mixed Solvents1a. *Journal of the American Chemical Society* 70, 4031-4034 (1948).
34. "Market Analytics: Propylene Oxide—2018," *Markets & Profitability* (Nexant, Inc., 2018).
35. W. Luc, J. Rosen, F. Jiao, An Ir-based anode for a practical CO2 electrolyzer. *Catal. Today* 288, 79-84 (2017).

The following supplementary information is also provided and includes Materials and Methods, reference to FIGS. 5-14, additional References (1-5):

Materials and Methods

Preparation of Catalyst

The nanostructured palladium anode was deposited on a Ti mesh (100 mesh, Stanford Advanced Materials) using a solution of 2 mM potassium hexachloropalladate(IV) (99%, Sigma-Aldrich) in 0.5 M $H_2SO_4$ (99.999%, Sigma-Aldrich), with Pd foil as the counter and Ag/AgCl (3.0 M KCl) as the reference electrode. The potential of −1.0 V vs. Ag/AgCl was applied for a duration of 1000 s. The Pd anode was then rinsed with DI water and dried in a nitrogen stream.

The $IrO_2$/Ti anode was fabricated by etching the Ti mesh in boiling 6 M HCl (≥98%, Sigma-Aldrich) for 40 min, followed by dip-coating in a solution comprised of 2 mL HCl, 18 mL isopropanol, and 60 mg iridium (IV) oxide dihydrate (99.99%, Alfa Aesar) (1). The resultant catalyst was dried in a preheated oven at 100° C. for 10 min and calcined in air at 500° C. for 10 min. The procedure was repeated 10 times to achieve an $IrO_2$ loading of ~1 mg/cm$^2$.

The Cu NPs/Cu/PTFE cathode for the $CO_2$-to-ethylene membrane-electrode assembly (MEA) were fabricated by sputtering the commercially available Copper (Cu) target onto a PTFE substrate with an average pore size of 450 μm. A constant sputtering rate of 0.55 Å/sec was applied under 10-6 Torr until the ideal thickness of 150 nm was achieved. To increase the active catalytic surface area of the Cu/PTFE, a catalyst slurry composed of Cu NPs (25 nm average particle size, Sigma Aldrich®), polymeric binder (Aquivion® D-7925BS, Sigma Aldrich®), and methanol was spray-deposited layer-by-layer until the nominal catalyst loading of 1.25 mg/cm$^2$ was achieved. The weight ratio (wt %) between the polymeric binder and Cu NPs was 1:4. The resulting electrode was dried overnight under vacuum prior to electrochemical experiments.

Electrochemical Measurements

All olefin oxidation experiments were conducted in a flow-cell configuration consisting of the anode catalyst, anion exchange membrane (Fumasep FAB-PK-130) and Ni foam cathode (1.6 mm thickness, MTI Corporation). These were positioned and clamped together with polytetrafluoroethylene (PTFE) spacers to enable the introduction of liquid electrolyte into the anodic and cathodic chambers. The electrolyte was circulated through the cell at 10 ml/min using peristaltic pumps with a silicone Shore A50 tubing, during which ethylene or propylene gas (Gr 2.5, 99.5%, Linde Gas) was continuously sparged into the anolyte at a constant flow rate (15 sccm). For carbon-13 experiments, $^{13}C_2H_4$ (99%, Cambridge Isotope Laboratories, Inc) was used instead. Electrochemical measurements were carried out using an Autolab PGSTAT204 in a amperostatic mode and an Ag/AgCl reference electrode (3.0 M KCl). The reported current densities are based on the geometric electrode area (cm$^2$).

For ethylene oxidation on the Pd anode, 1 M $NaClO_4$ electrolyte (98%, Sigma-Aldrich) was used. The organic mediators TEMPO (98%, Sigma-Aldrich) and NHPI (97%, Sigma-Aldrich) were used in conjunction with the same electrolyte and Pt foil anode (0.1 mm, Alfa Aesar).

The liquid products were analyzed using HPLC (Thermo Scientific Dionex UltiMate 3000) and $^1$H NMR spectroscopy (600 MHz Agilent DD2 NMR Spectrometer) using water 400 suppression techniques. For $^{13}C$ NMR spectroscopy, the products were analyzed continuously for 4 h to accumulate sufficient signal and proton decoupling techniques were employed to prevent $^{1}H$ protons from splitting the $^{13}C$ nuclei. All reported Faradaic efficiencies were averaged from at least three different runs.

The electrochemical performance testing of the MEA electrolyser was performed by using an electrochemical test station, equipped with a commercial software, current booster and potentiostat, mass flow controller, peristaltic pump with silicon tubing, and humidified. The MEA electrolyser used was commercially available and composed of three main constituents: as-prepared cathode electrode, anode electrode (Ti—$IrO_2$), and anion exchange membrane (AEM, Dioxide Materials, Classic Sustainion® 37-50). The cathode electrode was mounted onto the metallic surface of the cathode flow-field via a frame made of Cu tape for electrical connection between the electrode and flow-field, while the Ti—$IrO_2$ mesh was mounted onto the anode flow field, and the anode and cathode flow fields were separated by the AEM. The commercial AEM was activated for at least 24 hours earlier prior to being used for performance testing. The electrolyser was then assembled by applying an equal compression torque to the each of four bolts. After the assembly, 0.1 M $KHCO_3$ was circulate through the anode side while humidified $CO_2$ with the flow rate of test-of-interest flow rates (3 sccm, 6 sccm, 25 sccm, and 50 sccm) was supplied to the cathode side. Upon completion of 3-min of initial reactant and anolyte supply, a constant current density of −240 mA/cm$^2$ was applied to the working electrode, and the electrolyser was operated under these initially set conditions throughout the course of the experiments.

Faradaic efficiency (FE) calculation towards ethylene was made according to the following expression:

$$\text{Faradaic Efficiency} = \frac{F n_a V_{gas} c_a}{i_{overall} V_m}$$

where F is the Faraday constant, $n_a$ is the number of electron transfer required for 1 mol ethylene production, $V_{gas}$ stands for the flow rate of $CO_2$, $V_{gas}$ is the volume of the gas sample collected for injection into the gas chromatography (p.p.m.), $c_a$ is the concentration of ethylene measured by via GC, $i_{overall}$ is the overall current measured, and $V_m$ is the unit molar volume of $CO_2$.

Materials Characterization

The morphologies of the electrodes were investigated through SEM using a Hitachi S-5200 apparatus at a 15 kV beam voltage and TEM on a Hitachi HF-3300 equipped with a Bruker energy dispersive x-ray spectroscopy detector at an acceleration voltage of 300 kV. The XPS measurements were conducted with a Thermofisher Scientific K-Alpha with a monochromated Al Kα X-ray source. XRD measurements were performed on a Rigaku MiniFlex 600.

Iodometric Titration

Iodometric titration of the anolyte was conducted by first adding an excess of 10% Kl solution to react with the unreacted chlorine/hypochlorite species and form iodine, followed by starch solution to form a dark blue starch-iodine complex. This was then titrated with 1 M $NaS_2O_3$ solution until the anolyte turned clear again, and the amount of $NaS_2O_3$ was recorded and used to determine the Faradaic efficiency of unreacted chlorine/hypochlorite species.

Additional Comments

Techno-Economic Analysis

To determine the economic potential of renewable electricity powered production of ethylene oxide from ethylene, this work conducted a techno-economic analysis (TEA) based on a modified model from our previous work (2). FIG. 5 shows the model used to calculate the plant-gate levelized cost of ethylene oxide production (US$ per ton of ethylene oxide).

Below is the list of assumptions made for the calculations.

1. The production capacity of the plant is 1 ton of ethylene oxide per day.
2. The total catalyst and membrane cost is 5% of the total electrolyzer cost.
3. The total cost of the electrolyzer is $10,000 per m$^2$.
4. The price of electricity, unless otherwise stated, is 10¢/kWh, which is the upper bound to the current cost of renewable electricity.
5. The separation cost comprises 2 components, gas stripping costs for separation of ethylene oxide (3) and an ethylene gas separation and recycle system. Their combined cost is assumed to be 20% of the electricity cost.
6. Other operation costs are assumed to be 10% of the electricity cost.
7. The capacity factor, i.e., the fraction of time the plant is expected to be operational on any given day, is assumed to be 0.8, which means the plant will be operational 19.2 hours a day.
8. The faradaic efficiency to ethylene oxide is 70%, the cell operating voltage is 3.0 V and the total operating current density is 300 mA/cm$^2$.
9. The prices of ethylene and ethylene oxide are assumed to be $900 per ton and $1400 per ton respectively (4).
10. The price of hydrogen is $1,900 per ton (5). The faradaic efficiency for hydrogen generation is assumed to be 100%.

TEA Cost Components

To calculate the cost components shown in FIG. 5, the following equations are used:

$$\text{Catalyst and membrane cost } (\$/\text{ton}) = \frac{\text{Total cost of electrolyzer } (\$) \times 5\%}{\text{Catalyst lifetime (year)} \times 365\ (\text{day/year}) \times \text{Production of product } (\text{ton/day})}$$

$$\text{Electrolyzer cost } (\$/\text{ton}) = \frac{\text{Total cost of electrolyzer } (\$) \times \text{Capital recovery factor}}{\text{Capacity factor} \times 365\ (\text{day/year}) \times \text{Production of product } (\text{ton/day})}$$

$$\text{Total cost of electrolyzer } (\$) = \text{Total surface area needed } (\text{m}^2) \times \text{Price per m}^2 (\$/\text{m}^2)$$

$$\text{Total surface area needed } (\text{m}^2) = \frac{\text{Total current needed (A)}}{\text{Current density } (\text{A/m}^2)}$$

$$\text{Total current needed } (A) = \frac{\text{Plant capacity } (\text{ton/day}) \times \text{No. of } e^- \text{ transferred in reaction} \times 96485 (\text{C/mol})}{\text{Product molecular weight } (\text{ton/mol}) \times 24 (\text{hour/day}) \times 3600\ (\text{s/hour}) \times \text{Faradaic Efficiency } (\%)}$$

-continued $$\text{Capital recovery factor} = \frac{\text{Discount rate} \times (1 + \text{Discount rate})^{Lifetime}}{(1 + \text{Discount rate})^{Lifetime} - 1}$$

$$\text{Electricity cost}(\$/\text{ton}) = \frac{\text{Power consumed (kW)} \times 24\ (\text{hour/day}) \times \text{Electricity cost}\ (\$/\text{kwh})}{\text{Plant capacity (ton/day)}}$$

$$\text{Power consumed (kW)} = \frac{\text{Total current needed } (A) \times \text{Cell voltage (V)}}{1000(\text{W/kW})}$$

$$\text{Maintenance cost } (\$/\text{ton}) = \text{Maintenance frequency} \times \text{Maintenance factor (\% of Capital cost)} \times \text{Total capital cost } (\$/\text{ton})$$

$$\text{Balance of plant } (\$/\text{ton}) = \text{Balance of plant factor (\%)} \times \text{Capital cost } (\$/\text{ton})$$

$$\text{Installation cost } (\$/\text{ton}) = \text{Lang factor (\%)} \times \text{Capital cost } (\$/\text{ton})$$

TABLE 2

Iodometric titration of the anolyte solution

| Current density ($mA/cm^2$) | Amount of $Na_2S_2O_3$ added (mmol) | Amount of unreacted chlorine/hypochlorite species (mmol) | Faradaic efficiency loss due to unreacted hypochlorite (%) |
|---|---|---|---|
| 300 | 2.8 | 1.4 | 25 |

SUPPLEMENTARY REFERENCES

1. W. Luc, J. Rosen, F. Jiao, An Ir-based anode for a practical $CO_2$ electrolyzer. *Catal. Today* 288, 79-84 (2017).
2. P. De Luna et al., What would it take for renewably powered electrosynthesis to displace petrochemical processes? *Science* 364, eaav3506 (2019).
3. "Ethylene Oxide Production by Nippon Shokubai Process," *PEP Review* 2010-12 (IHS Markit, 2010).
4. "Ethylene oxide (EO) Prices and Information," (ICIS Ltd., 2011).
5. O. S. Bushuyev et al., What Should We Make with CO2 and How Can We Make It? *Joule* 2, 825-832 (2018).
6. Electrolysis System and Method for Electrochemical Ethylene Oxide Production, United States Patent Application 20190032228.

Enhancements, Variants & Further Implementations

This section provides additional information regarding enhancements to and variants of the technology as well as further implementations and experiments.

The enhancements and variants include the use of period-6 metal oxides associated with the iridium oxide catalyst; providing the ORR instead of HER at the cathode during the conversion of olefins to ethylene chlorohydrin at the anode; and using a paired electrocatalytic system for the conversion of $CO_2$ into oxirane instead of the previous two-electrolyzer setup. It should be noted that one or more of these features can be used together and/or in conjunction with other aspects described herein.

Regarding compositional modifications to the anodic electrocatalyst, the present work explored the use of period-6-metal oxides, including barium, lanthanum, cerium, and bismuth oxides, which have high stability in chlorine solution, as HOCl— cleavage-inhibitors on $IrO_2$. The work found that barium oxide ($BaO_x$) loaded catalysts showed remarkable performance, including the following: (i) achieving ethylene oxide (EO) electrosynthesis using ethylene electrocatalytically synthesized via $CO_2$ reduction, reporting a total FE of 35% at gas flow rate of 50 sccm, a 6× higher FE for $CO_2$-to-EO compared to the best prior electrochemical report [P2137, FIG. 4D]; and (ii) limiting the FE toward unreacted $ClO^-$ to below 10% on $BaO_x/IrO_2$ electrocatalyst, reducing the aqueous waste streams by >3 times compared to previous work (~30% of unreacted $ClO^-$ FE). The period-6 metal oxides can be loaded onto and/or into the iridium oxide and can advantageously suppress the HOCl cleavage and thus, in turn, promote the final EO FE to a higher level such as 90%. It was found that the ΔG of HOCl cleavage on $BaO_x/IrO_2$ interface, for example, is equal to +0.11 eV, indicating that HOCl cleavage becomes no longer spontaneous.

Regarding the use of ORR instead of HER at the cathode, the reaction potential to drive the cathodic ORR together with the anodic CIER was notably decreased and thus energy savings are facilitated. For example, using HER-CIER the theoretical reaction potential is 1.36 V, whereas ORR-CIER had a lower theoretical reaction potential of 0.13 V. It followed that the actual operating full-cell voltage was reduced, e.g., by 1.2 V from 3.2 V to 2.0 V at 100 $mA/cm^2$ current density, when using ORR instead of HER. The paring of cathodic ORR with anodic CIER facilitates a reduction in the theoretical reaction potential and energy requirements are therefore reduced. The cathodic ORR can be implemented in various ways using certain electrocatalysts and operating conditions.

It was particularly found that operation of the cathode with ORR instead of HER enabled a record low energy input of 5.3 MJ/kg of EO, which is comparable to that of the emissions-intensive industrial process (4 MJ/kg of EO), and well below the energy input of 19 MJ/kg of EO using HER based methods. In addition, when using ORR at the cathode, the process can use the same feed gasses as industrial direct oxidation processes: air and $C_2H_4$. An example of the electrochemical process also provided an EO selectivity of 98%, well above the industrial direct oxidation process which exhibits <80%.

Regarding the paired electrocatalytic system for the conversion of $CO_2$ into EO, previous work described herein utilized independent electrolyzers and enhancements were made in the development of an integrated or paired system. The paired system can be understood with reference to FIGS. 18*e*, 32 and 39, for example.

In the present section, techniques including the redox-mediated electrosynthesis of ethylene oxide from $CO_2$ and water will be described in greater detail. The electrochemical production of EO from $CO_2$, water, and renewable electricity, can enable the consumption of 2 tons of $CO_2$ per ton of EO produced, in contrast to the emission of ~2 tons of $CO_2$ per ton of EO produced in existing thermochemical routes. Unfortunately, electrochemical $CO_2$-to-EO conversion has previously shown an impractical faradaic efficiency (FE) of 6% which contributes to a high 19 MJ/kg of EO. The present work suppressed hypochlorous acid cleavage into proton and hypochlorite; and also reports a new class of period-6-metal oxide-modified iridium oxide catalysts. Among barium, lanthanum, cerium, and bismuth, it was found that barium oxide loaded catalysts enabled an ethylene-to-EO FE of 90%. When this was combined with the ORR at the cathode, the work achieved a record low energy input of 5.3 MJ/kg of EO, comparable to that of (emissions-intensive) existing industrial processes. The example redox-mediated paired system studied herein achieved a 1.5-fold higher $CO_2$-to-EO FE (35%) and used a 1.2 V lower operating voltage than literature benchmark electrochemical systems.

In some implementations, the electrocatalyst can include a primary catalyst such as iridium oxide, cobalt oxide, platinum, platinum oxide, palladium or palladium oxide. The electrocatalyst can also include an HO-halide-cleavage inhibitor and provided on a substrate. The HO-halide-cleavage inhibitor comprises a period-6 metal oxide, as noted above. The electrocatalyst can be made in various ways, e.g., providing a solution or ink that includes the primary metal and the inhibitor and then dipping, soaking and/or spraying the substrate, followed by drying and curing. One or more cycles of applying the ink, drying and curing can be performed, and the cycles can be done using the same or different ink formulations. The HO-halide-cleavage inhibitor can be provided so as to be evenly disbursed throughout the matrix of the primary metal. Alternatively, depending on the method of manufacture, the HO-halide-cleavage inhibitor could be distributed mainly at the surface of the primary catalyst matrix layer. The oxides of the primary metal and the period-6 metal can be formed during the manufacturing and/or during operation in situ when exposed to operating conditions.

The substrate can be various hydrophilic, porous, electrically conductive, oxidation resistant materials (e.g., titanium mesh, titanium felt, titanium foam, carbon felt, carbon cloth, carbon foam, porous ceramic felts, foams and meshes, etc.), with a preference for materials that have long term stability in the operating conditions (e.g., titanium based). The substrate can have a thickness between 0.1 mm and 2 mm, for example. The primary catalyst can be viewed as being "loaded" with the HO-halide-cleavage inhibitor, in the sense that the inhibitor is incorporated into the primary catalyst matrix, and this "loading" aspect should not be viewed as limiting the manner in which the inhibitor is structurally or chemically incorporated into the matrix. Various implementations and optional aspects can be used compared to the particular examples disclosed herein.

Figure 15A:
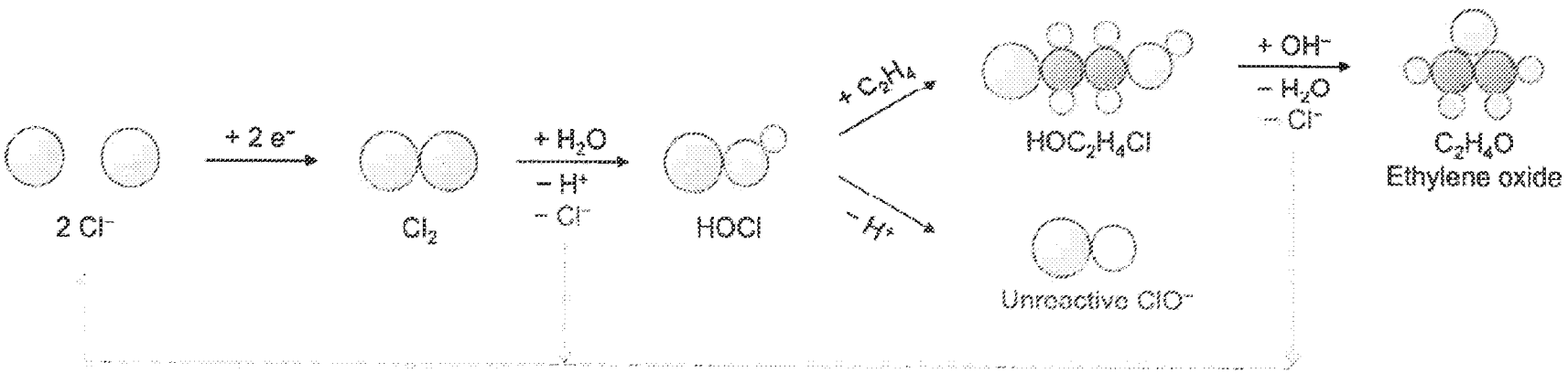
FIG. 15 | Comparison of $BaO_x/IrO_2$ and bare $IrO_2$ electrocatalysts. (a) Key reaction pathway for producing EO using HOCl as the key intermediate. The HOCl-to-$ClO^-$ cleavage will result in the EO FE loss. Green, chlorine; orange, oxygen; light blue, hydrogen; grey, carbon. (b) Gibbs free energy changes (ΔG) of the reaction *HOCl→*H+*OCl on bare $IrO_2$(200) and $Ba_3O_4$-cluster loaded $IrO_2$(200) with perfect and oxygen-vacancy ($O_v$) surfaces. (c) Schematic HOCl cleavage process on bare $IrO_2$ and $BaO_x/IrO_2$ surfaces. The undesirable HOCl cleavage can be suppressed by $BaO_x/IrO_2$ but facilitated by bare $IrO_2$. (d) Comparison of EO FE, full-cell EE, stability, EO selectivity, and energy utilization against the best results for EO electrosynthesis. All data are collected at the same applied current density of 100 mA/cm$^2$. *Normalization: For energy utilization, 100% represents the direct oxidation process (the corresponding energy consumption is ~4 MJ/kg of EO).

In terms of additional context, chemicals manufacturing exhibits a significant global carbon footprint with the direct $CO_2$ emissions from chemical conversion processes now exceeding 200 million tons Taking as an example ethylene oxide, a commodity chemical produced at 20 million tons/annum for the manufacture of polyethylene terephthalate (PET), the steam cracking process emits 1~2 tons of $CO_2$ per ton of ethylene ($C_2H_4$) produced ($t_{CO2}/t_{C2H4}$), and the direct oxidation process emits ~0.9 tons of $CO_2$ per ton of EO produced ($t_{CO2}/t_{EO}$). Renewable-electricity-powered electrochemical processes convert waste $CO_2$ emissions into valuable chemicals and fuels such as ethylene ($C_2H_4$), ethanol and acetate, enabling a reduction in net $CO_2$ emissions. Additional $CO_2$ savings can be achieved by electrifying the upgrade of chemicals to higher-value commodities such as EO. For instance, the synthesis of EO from $CO_2$, water and renewable electricity enables the consumption of 2 $t_{CO2}/t_{EO}$, in contrast to the emission of ~2 $t_{CO2}/t_{EO}$ in the existing process. However, the electrosynthesis of EO from $CO_2$ has been performed using two independent electrolyzers: $CO_2$ reduction to ethylene, and its subsequent oxidation to EO (EtOR). While the EtOR (see FIG. 15*a* and Supplementary Note 1) has been achieved at an impressive 1 A/cm$^2$ current density, the total $CO_2$-to-EO faradaic efficiency (FE) was limited to 6% when operated at a high $CO_2$ gas flow rate of 50 sccm (calculated from the FE for $CO_2$-to-$C_2H_4$ reduction multiplied by the FE for $C_2H_4$-to-EO oxidation). This literature benchmark system suffers from a relevant missing FE component in $C_2H_4$-to-EO, the loss here exceeding 80%, the result of hypochlorous acid (HOCl) cleavage to unreactive $ClO^-$ in EtOR; and, as a result, energy input of ~19 MJ/kg of EO, ~5× more energy-intensive than today's thermochemical route with the energy requirement of ~4 MJ/kg of EO.

Techniques described herein mitigate at least some of these challenges and provide enhancements in terms of EO production. Experiments were performed to test and evaluate various aspects of the technology.

Figure 15D:
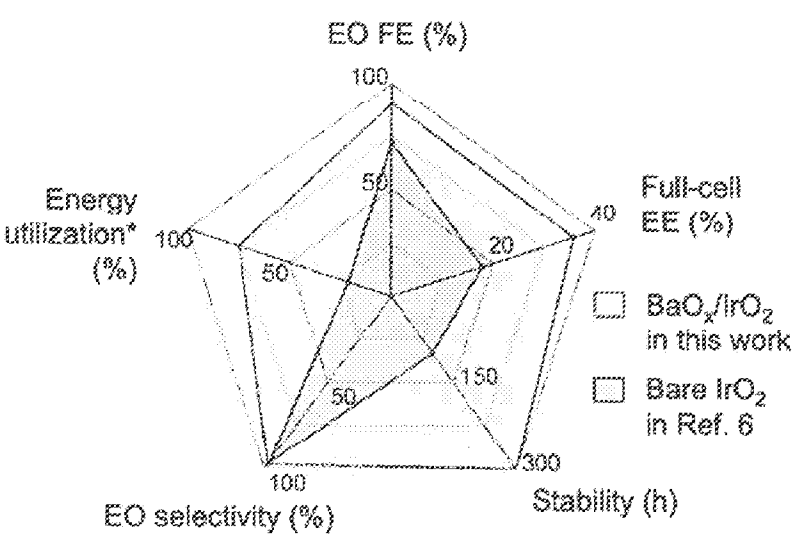
Figure 15C:
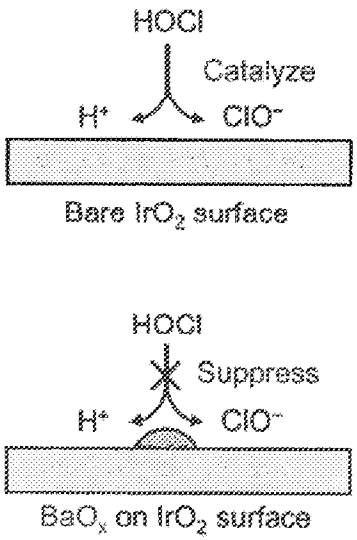
Figure 15B:
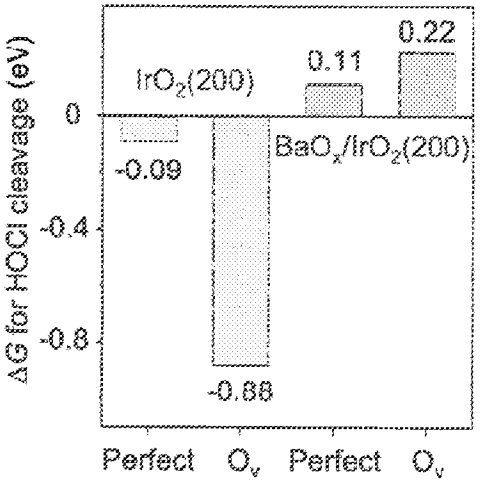

The work studied the HOCl cleavage process on bare $IrO_2$ with the aid of density functional theory (DFT) calculations: both perfect and oxygen-vacancy $IrO_2$ surfaces presented a spontaneous reaction for *HOCl→*H+*OCl with changes in Gibbs free energy (ΔG) being negative values (FIG. 15*b* and FIG. 19). The negative ΔG explains the low EO FE on bare $IrO_2$ catalyst in prior literature, which arises from HOCl-to-ClO-cleavage (FIG. 15*c*).

The work then pursued means to enhance the EO FE on $IrO_2$ catalysts. By loading period-6-metal oxides—which provide good stability in chlorine solution—as promoter candidates, the work sought to influence the thermodynamics of HOCl cleavage as well as maintain the HOCl generation capacity. The work studied four period-6-metals—barium, lanthanum, cerium, and bismuth—and investigated their performance in the electrochemical production of EO from $C_2H_4$ (FIGS. 20-23).

Of these catalysts, the barium oxide loaded iridium oxide ($BaO_x/IrO_2$) showed the best results: it limited the FE toward unreactive $ClO^-$ to below 10%, thus increasing the $C_2H_4$-to-EO FE to 90% (FIG. 15*d*). DFT results show a ΔG for HOCl cleavage on the $BaO_x/IrO_2$ interface of +0.11 eV, suggesting that this undesired reaction becomes no longer spontaneous (FIG. 15*c*), and thus enhancing the EO FE.

Figure 16A:
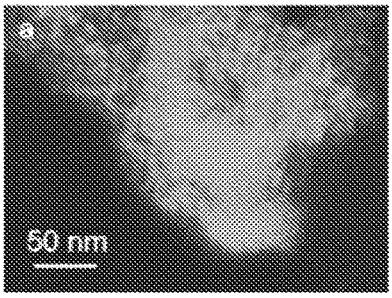
FIG. 16 | Characterization of the as-prepared $BaO_x/IrO_2$ electrocatalysts. STEM image (a) with elemental mappings of Ir (b), Ba (c), and O (d) of the as-prepared $BaO_x/IrO_2$ catalyst. The dotted cycle in c shows the existence of $BaO_x$ nanoparticle. (e) High-resolution TEM image of the as-prepared $BaO_x/IrO_2$ catalyst. Ir 4f (f), Ba 3d (g) and O 1s (h) XPS spectra of the as-prepared $BaO_x/IrO_2$ catalyst.
Figure 16B:
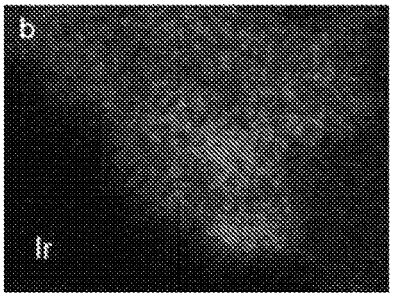
Figure 16E:
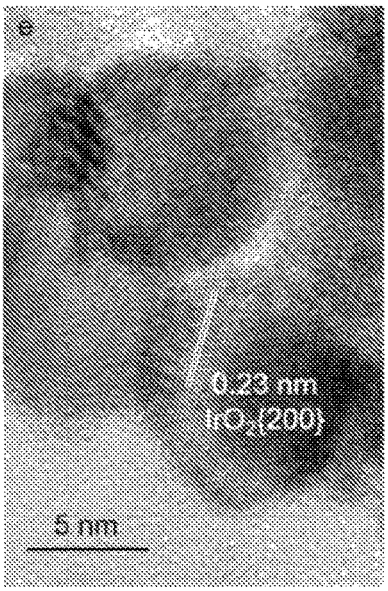
Figure 16C:
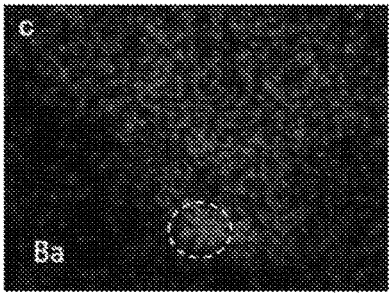
Figure 16D:
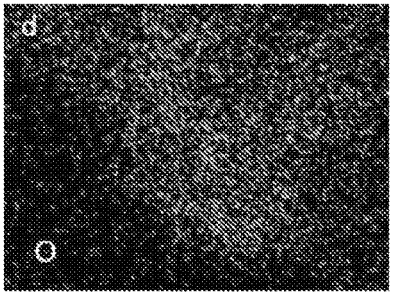
Figure 16F:
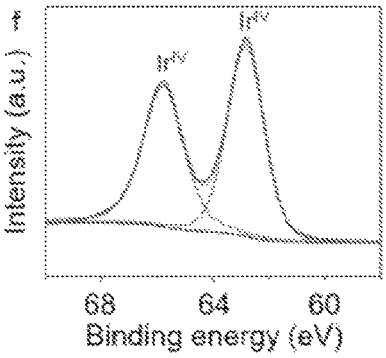
Figure 16G:
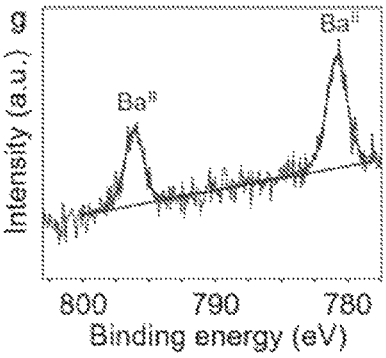
Figure 16H:
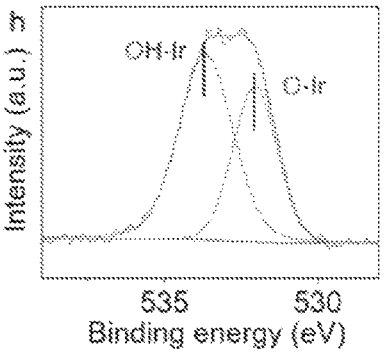
Figure 24:
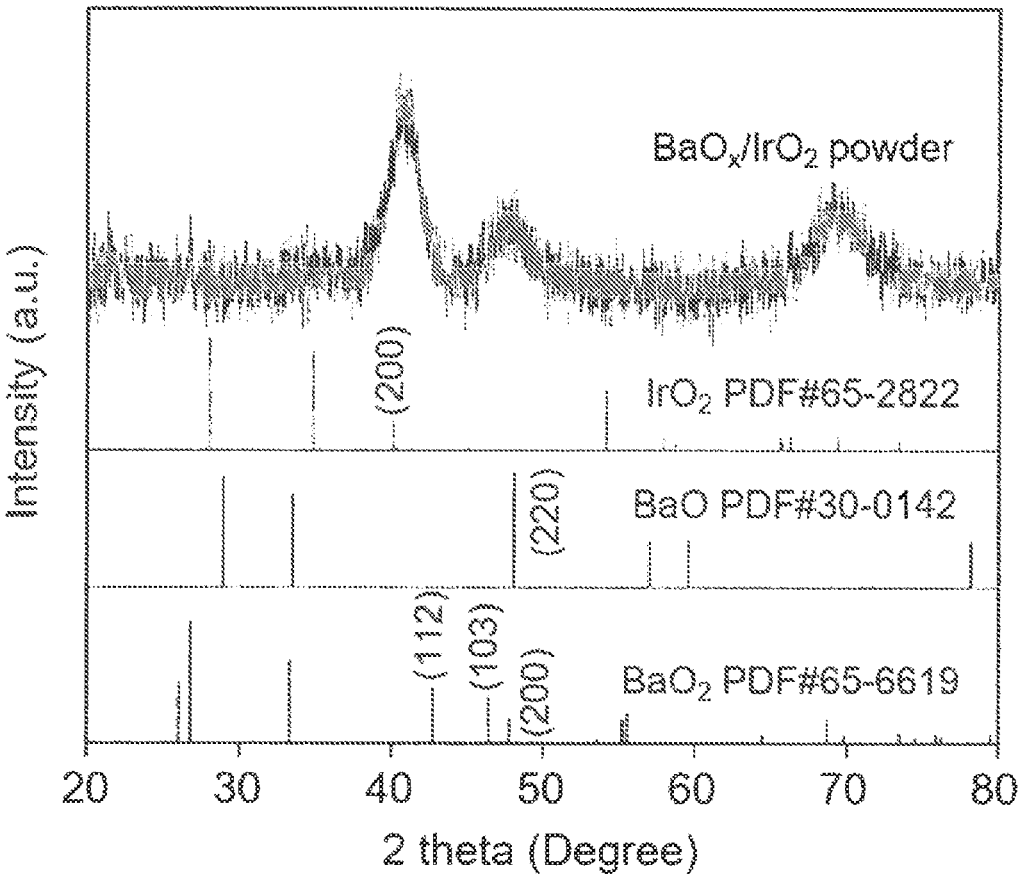
FIG. 24 | XRD pattern for the $BaO_x/IrO_2$ powder, compared with standard BaO, $BaO_2$ and $IrO_2$.

The study then characterized $BaO_x/IrO_2$ catalysts and determined the Ba-to-Ir ratio of ca. 3 wt % (see details in Methods section below). The XRD pattern suggests the presence of amorphous $BaO_x$ species (x=1~2) in the catalyst (FIG. 24). The work further explored the structure and composition of the catalyst (TEM, FIG. 16*a-d*): Ir, Ba, and O are homogeneously dispersed throughout the nanoparticle-like catalyst, and a $BaO_x$ nanoparticle with ca. 30 nm in size is found in FIG. 16*c*. This suggests that a portion of the $BaO_x$ nanoparticles is loaded onto $IrO_2$; rather than Ba doping the lattice of $IrO_2$. This can be accounted for by reference to the large difference in the atomic radiuses (268 pm for Ba and 202 pm for Ir). The work also measured the lattice fringes as 0.23 nm (HRTEM, FIG. 16*e*)—these were associated with $IrO_2$ {200} facets. The work then investigated the valence state of each element in the $BaO_x/IrO_2$ catalyst, Ir and Ba to be in the IV and II oxidation states, respectively (XPS, FIG. 16*f,g*); and O 1s XPS peak is assigned to the OH—Ir and O—Ir bonds (FIG. 16*h*). Based on these findings, it was concluded that the catalyst is composed of $BaO_x$ (x=1~2) nanoparticles loaded on $IrO_2$.

Figure 17A:
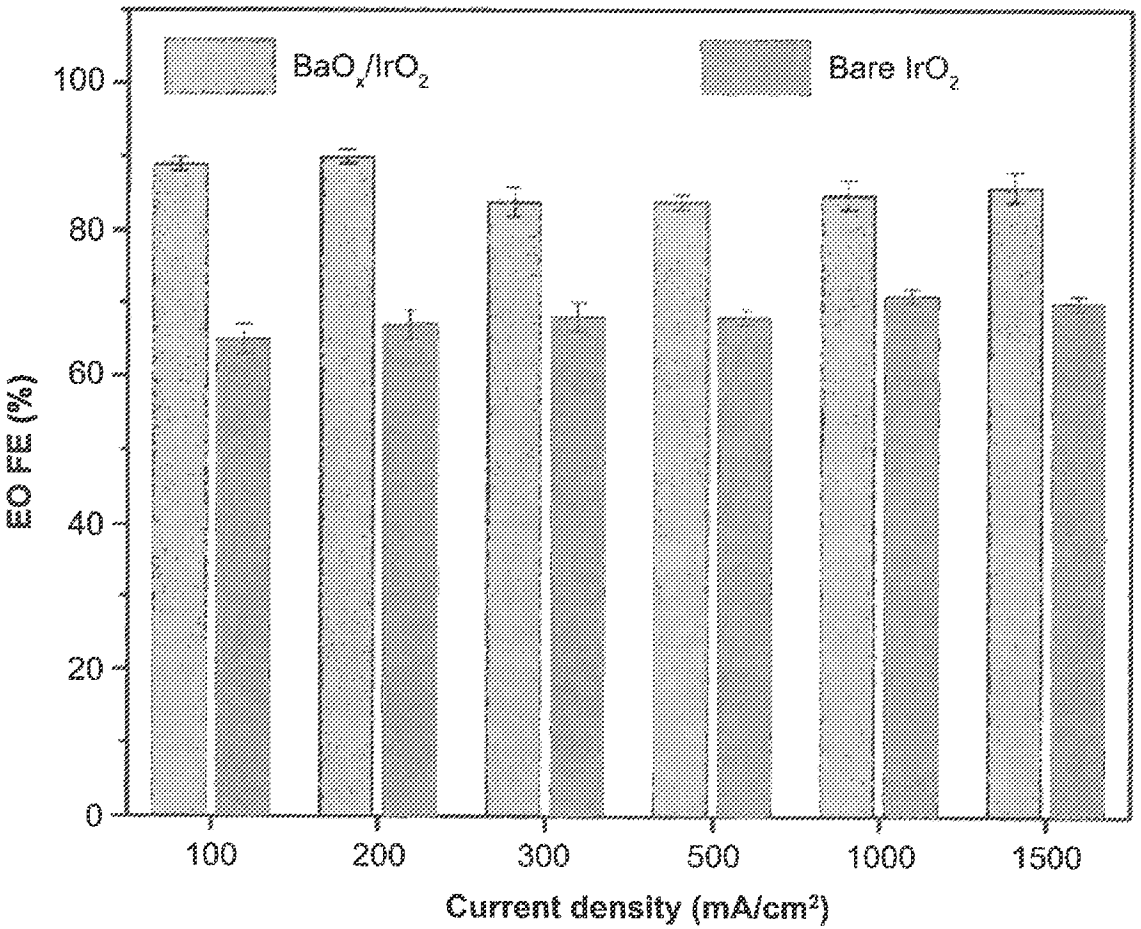
FIG. 17 | Electrochemical performance of the $BaO_x/IrO_2$ electrocatalysts. (a) EO FE and (b) full-cell energy efficiency and plant-gate levelized cost using $BaO_x/IrO_2$ catalysts compared with bare $IrO_2$ sample at different applied current densities. The electricity cost was set as 5 cents/kWh to reflect the current renewable electricity cost. (c) Stability test for producing EO during 300 hours of electrolysis under the current density of 100 mA/cm$^2$. All voltages are non-iR-corrected. The error bars correspond to the standard deviation of three independent measurements.
Figure 25:
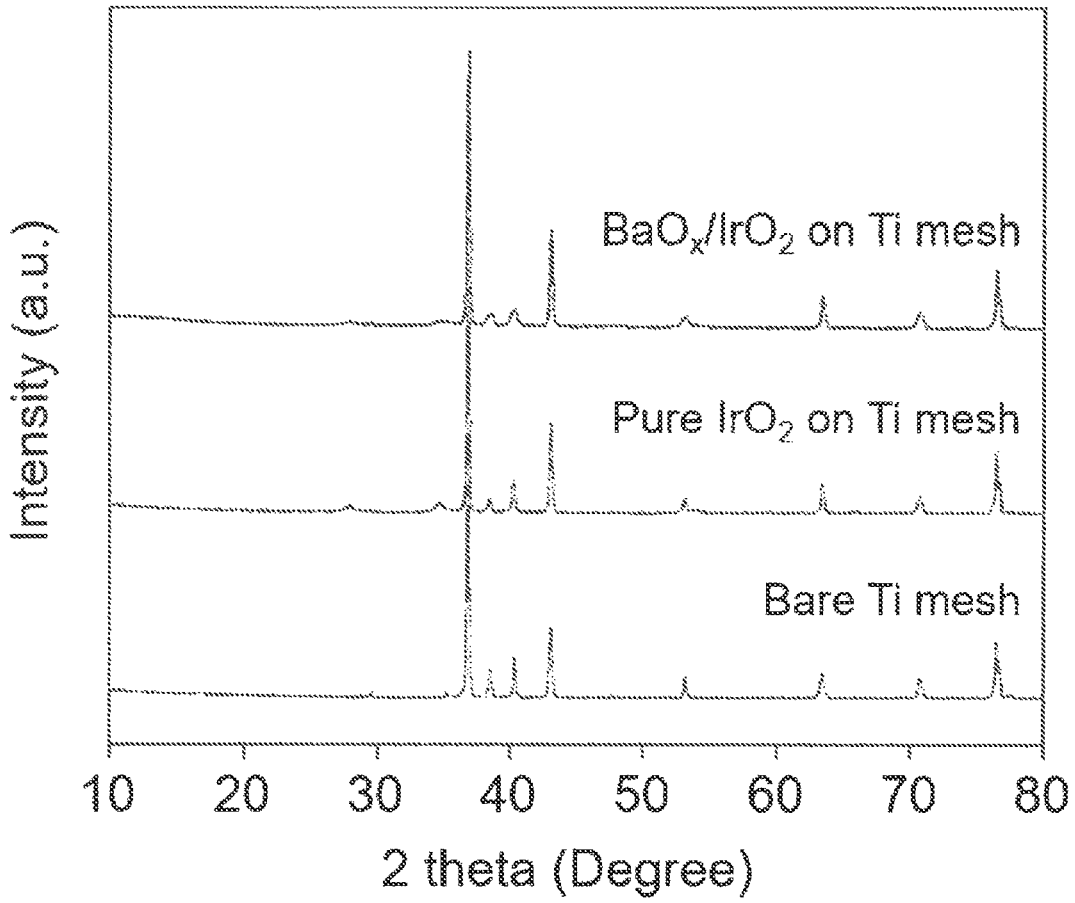
FIG. 25 | XRD pattern for $BaO_x/IrO_2$ on Ti mesh, compared with the pure $IrO_2$ on Ti mesh and the bare Ti mesh substrate.
Figure 26B:
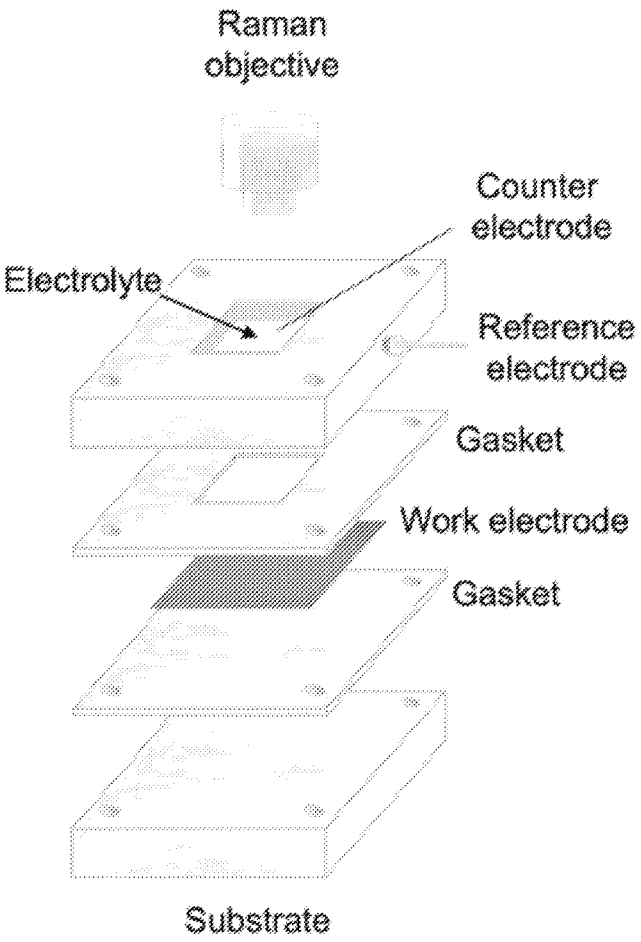
FIG. 26 | (a) In-situ Raman spectra of the $BaO_x/IrO_2$ and bare $IrO_2$ electrocatalysts using 2 M KCl as the electrolyte at various potentials, after background subtraction. (b) Schematic illustration of the home-built electrochemical cell for in-situ Raman measurements. Raman measurements were conducted using a Renishaw inVia Raman microscope and a water immersion objective with a 785 nm laser. An Ag/AgCl (3 M KCl) electrode and a Pt wire were used as the reference and counter electrodes, respectively.
Figure 26A:
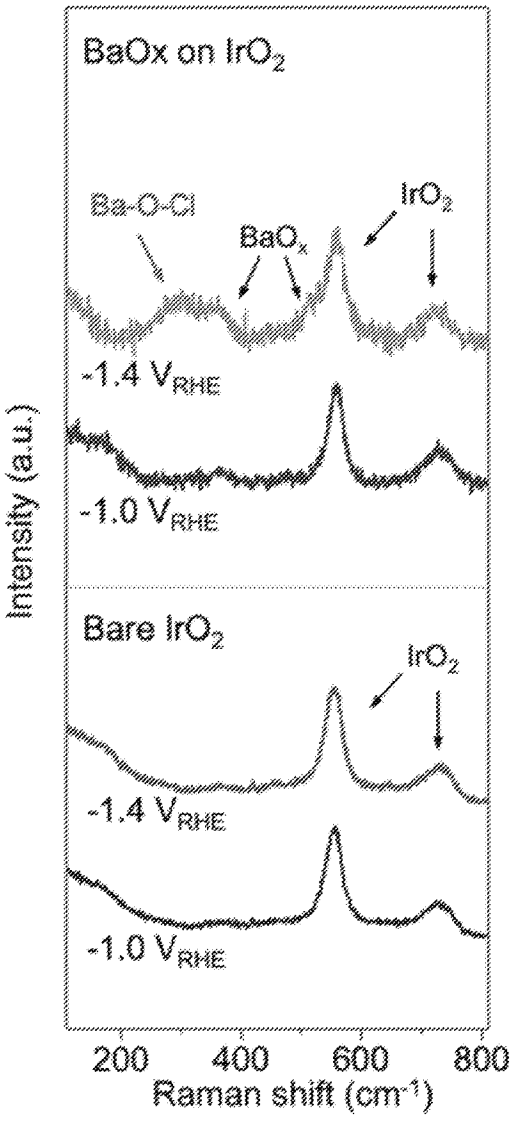

In terms of the performance of ethylene oxide electrosynthesis, the work evaluated the $BaO_x/IrO_2$ performance in a two-electrode flow-cell setup using a titanium (Ti) mesh substrate (XRD, FIG. 25). As presented in FIG. 17*a*, at current densities ranging from 100 to 1500 mA/cm$^2$, the FEs of $C_2H_4$-to-EO conversion on $BaO_x/IrO_2$ catalyst are >85% and reach a plateau of 90±1% at 200 mA/cm$^2$. On the $IrO_2$/Ti control, the FEs for EO are ~65% in the same current density range, consistent with the performance results of other recent work. The work limited the FE toward unreactive $ClO^-$ to below 10% on $BaO_x/IrO_2$ electrocatalyst, thus reducing the aqueous waste streams by >3 times compared to the bare $IrO_2$ catalyst having ~30% FE for $ClO^-$. The work also found, by conducting in-situ Raman measurements (FIG. 26), that the Ba—O—Cl structure is formed on $BaO_x/IrO_2$ catalysts during reaction, consistent with the models suggested by DFT calculations (FIG. 19).

Figure 27B:
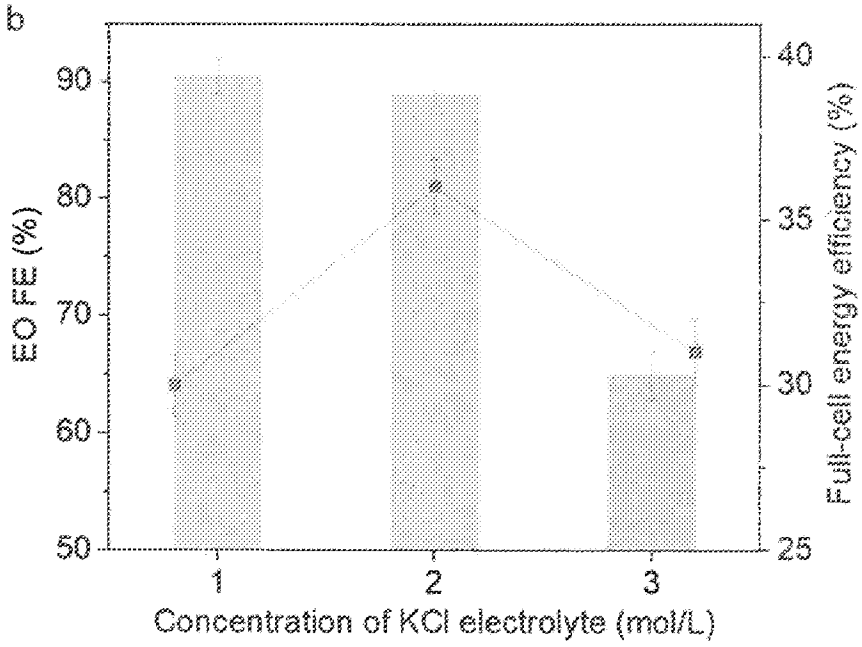
FIG. 27 | EO FEs on the $BaO_x/IrO_2$ catalysts with various (A) $BaO_x$ loadings and (B) KCl electrolyte concentrations. The applied current density is 100 mA/cm$^2$. The error bars represent the standard deviation from at least three independent tests.
Figure 27A:
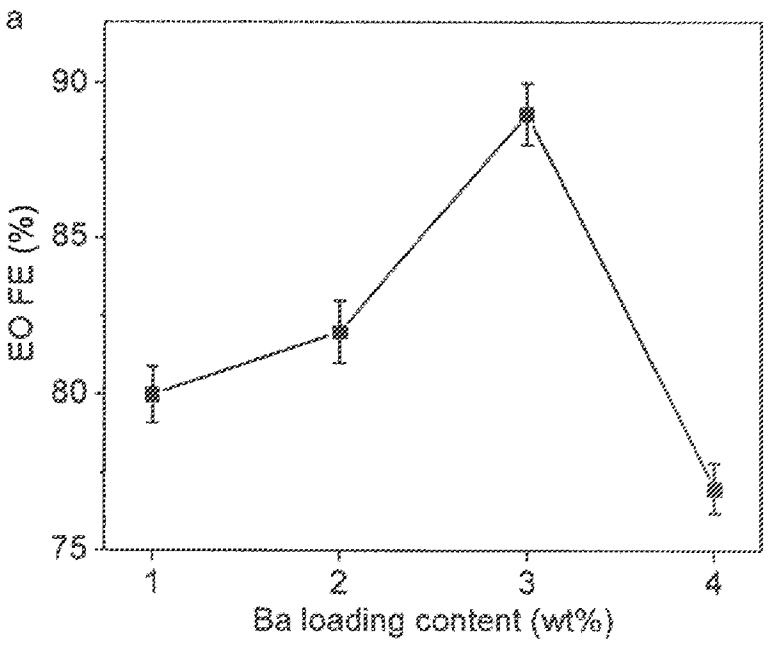
Figure 28A:
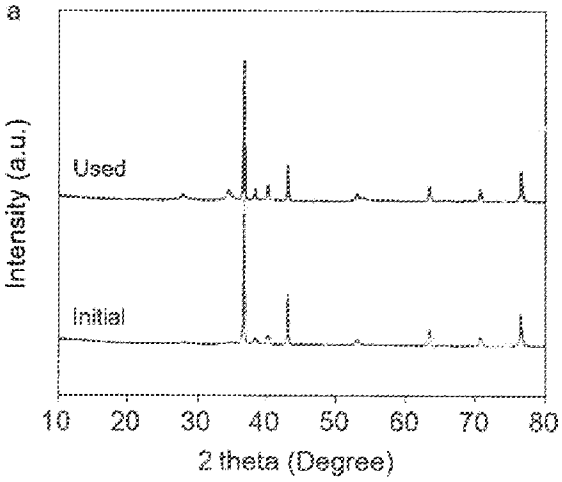
FIG. 28 | (a) XRD patterns, and (b) Ba 3d and (c) Ir 4f XPS spectra of the original and post-reaction $BaO_x/IrO_2$ catalysts with different $BaO_x$ loadings or KCl electrolyte concentrations. (d) STEM image with elemental mappings of (e) Ir, (f) Ba and (g) O of the post-reaction $BaO_x/IrO_2$ catalyst. The dotted cycles in (f) show the representative $BaO_x$ nanoparticles.
Figure 28B:
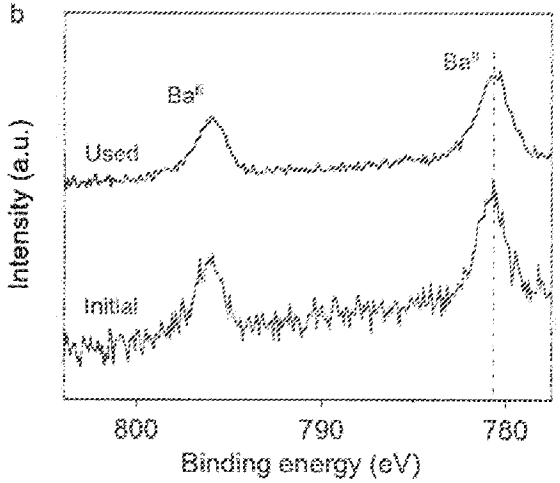
Figure 28C:
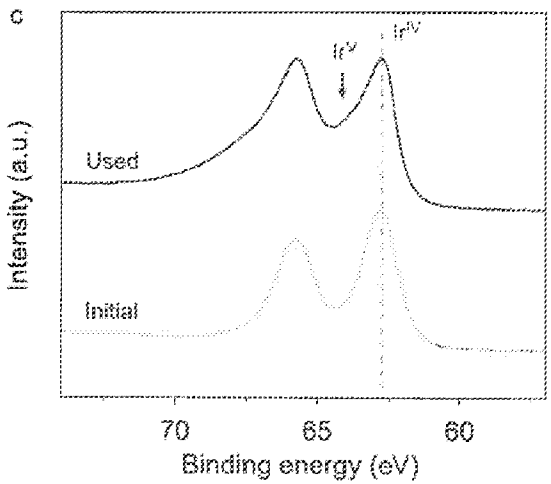
Figure 28D:
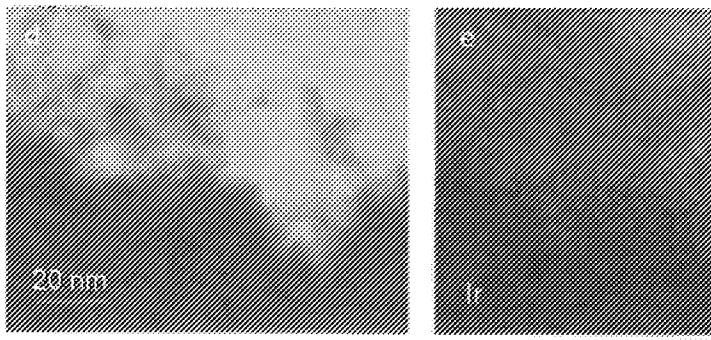
Figure 28E:
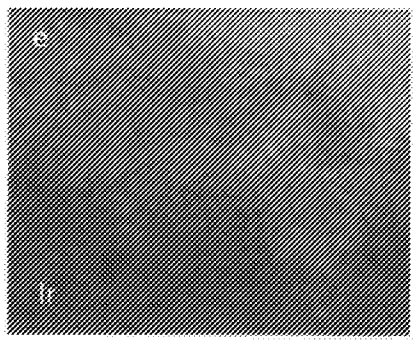
Figure 28F:
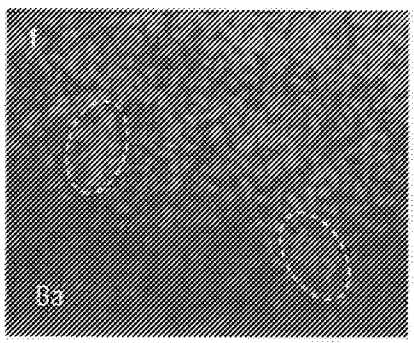
Figure 28G:
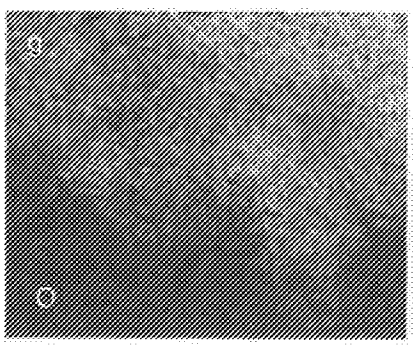

It was noted that the product selectivity in $C_2H_4$-to-EO conversion is 98±0.3%, with no over-oxidation to $CO_2$ detected. The work also investigated the performance of $BaO_x/IrO_2$ catalysts with different $BaO_x$ loadings (from 1 to 4 wt %) in various anolyte concentrations (from 1 to 3 M KCl) (FIG. 27). Of the catalysts, 3 wt % $BaO_x/IrO_2$ in 2 M KCl anolyte exhibits the highest performance. This enables an EO full-cell energy efficiency (EE) of 37% (non-iR-corrected) at 100 mA/cm$^2$ (FIG. 17*b*)—representing a 2.5-fold improvement in EE compared to the literature benchmark systems that operate under the similar reaction rates (see Table 4).

Figure 17B:
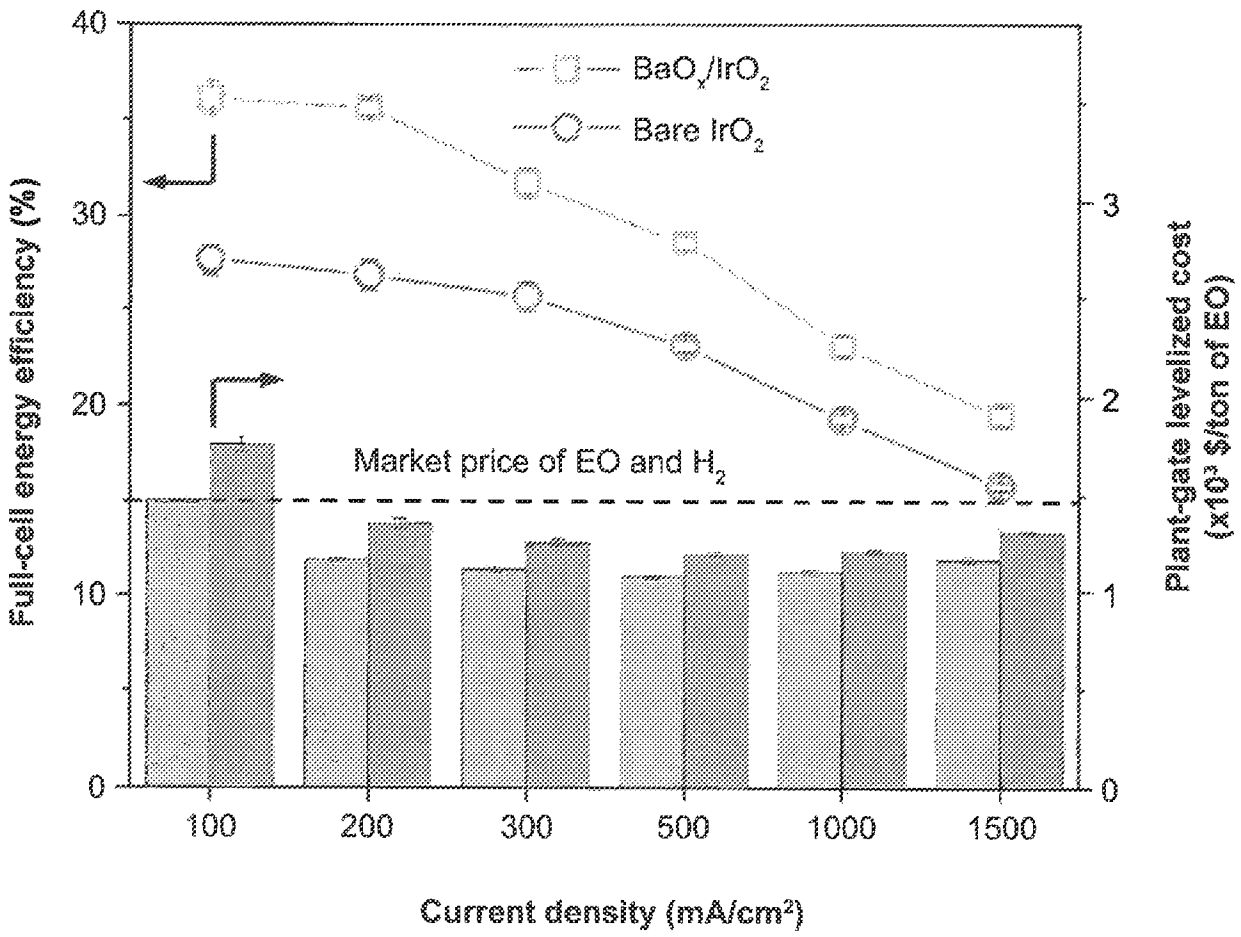

The work also carried out techno-economic assessment (TEA, see Supplementary Note 2) to assess the contribution of the $BaO_x/IrO_2$ promoted performance to total plant-gate levelized cost (PGLC, FIG. 17*b*). Using electricity price of 5 cents/kWh, it was found that the system equipped with the $BaO_x/IrO_2$ catalyst—in a wide current density range of 100 to 1500 mA/cm$^2$—is projected to enable a production cost that is lower than the combined market value of produced EO and $H_2$ ($1486).

Figure 17C:
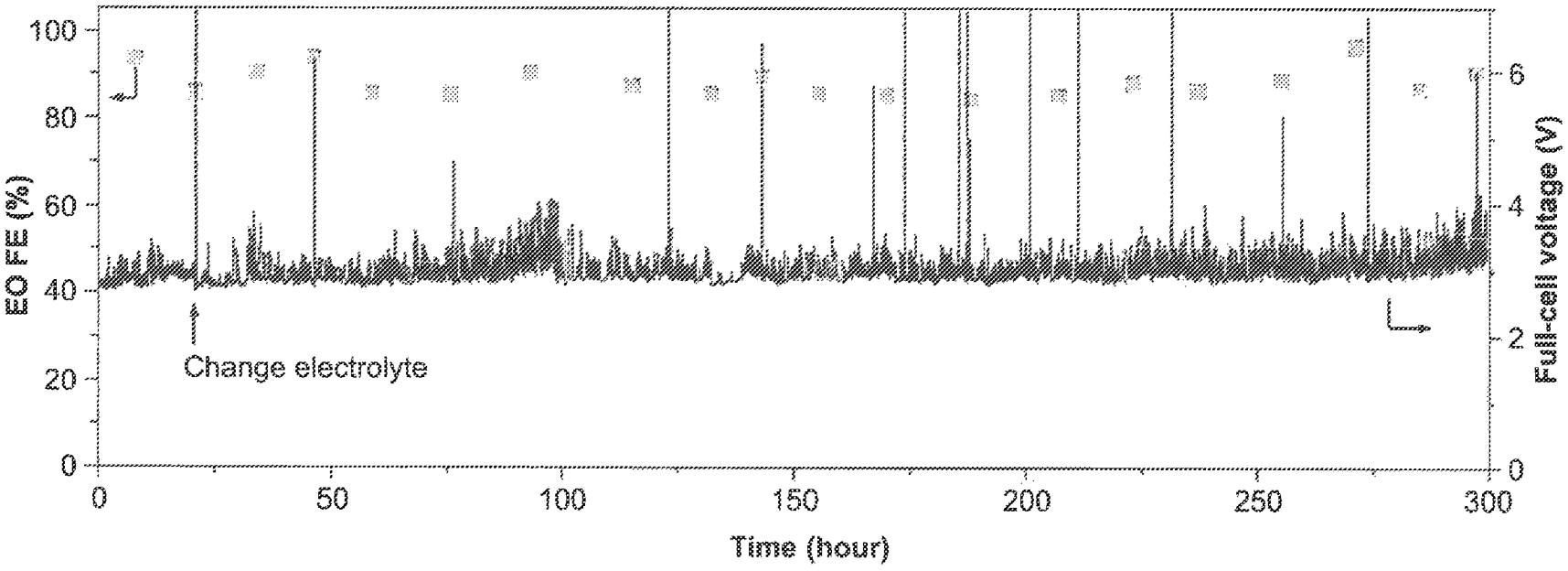

The work also assessed the stability of the system. The extended operation was performed at a current density of 100 mA/cm$^2$, where the system delivers the highest full-cell EE with profitable PGLC. The catalyst maintains an average EO FE of >85% and selectivity of ~98% for 300 hours of continuous operation with a full-cell voltage of ~3.2 V (non-iR-corrected) (FIG. 17*c*). The work then analyzed the structure and composition of the $BaO_x/IrO_2$ catalyst upon completion of the extended operation. XRD pattern, XPS spectra, and TEM images of the catalyst (FIG. 28) suggest no obvious changes in elemental valence state, element distribution, and nanoparticle-like structure. Post-reaction ICP-AES analysis of the catalysts indicates that the catalyst preserves its original Ba loading of ca. 3 wt % through 300 hours of uninterrupted electrooxidation.

Figure 29:
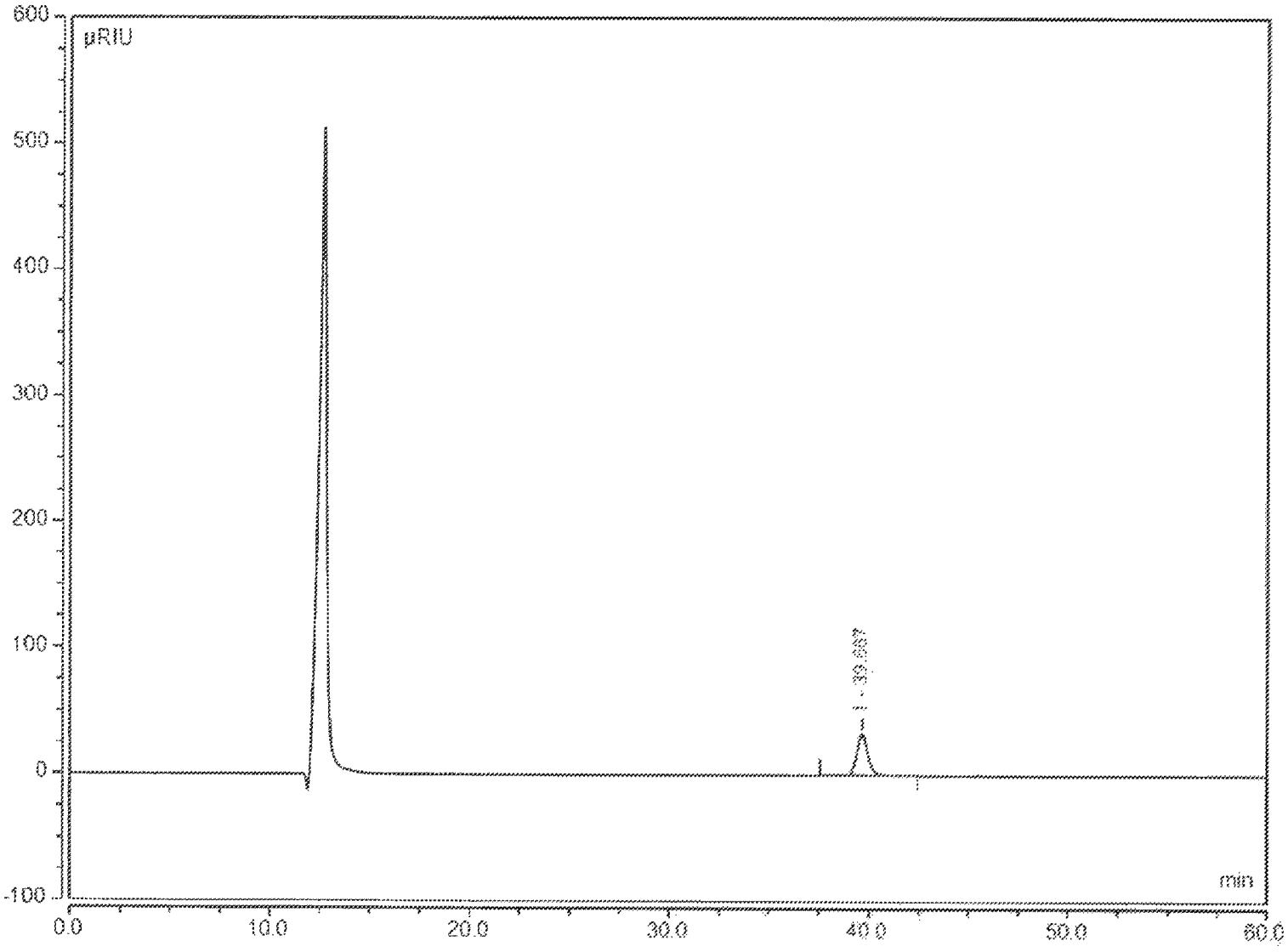
FIG. 29 | Representative curve of the anolyte after 1-h of electrochemical test from the high-performance liquid chromatography. The peak at 39.667 min is assigned to the ethylene chlorohydrin product.

Testing detected ethylene chlorohydrin ($HOC_2H_4Cl$) as the only anodic product during electrolysis (FIG. 29), which is formed due to the reaction between HOCl and $C_2H_4$(Eq. S3 in Supplementary Note 1). It was thus concluded that the final EO FE is only related to the amount of HOCl, because the $Cl_2$ will convert $C_2H_4$ to ethylene dichloride that is not detected, while the other species in anolyte (such as $Cl^-$ and $ClO^-$ anions) are unreactive to $C_2H_4$.

The work also provided the EO production performance in acidic electrolytes (pH 3 and 5, Table 5); however, no EO is produced, attributable to the absence of $OH^-$ in acidic catholytes (Eq. S4 in Supplementary Note 1) and hence the suppressed conversion of $HOC_2H_4Cl$ into EO (Eq. S5 Supplementary Note 1).

The work also assessed full-cell optimization, including the use of anodic EtOR with cathodic ORR. While the work increased the $C_2H_4$-to-EO FE to 90% by using $BaO_x/IrO_2$ catalyst, the energy input (~9 MJ/kg of EO) was still 2.2× higher than that of the current thermochemical processes. It was noted that the anodic upgrading of $C_2H_4$ to EO (EtOR) coupled with HER requires a high theoretical reaction potential of 1.36 V (FIG. 18*a*), undesirably increasing the full-process energy requirement by producing the by-product $H_2$. It was posited that if one could—without sacrificing the EO FEs and production rates—displace HER at the cathode with a lower-thermodynamic-potential reaction, one would significantly reduce the energy input of the $C_2H_4$-to-EO conversion.

Figure 18A:
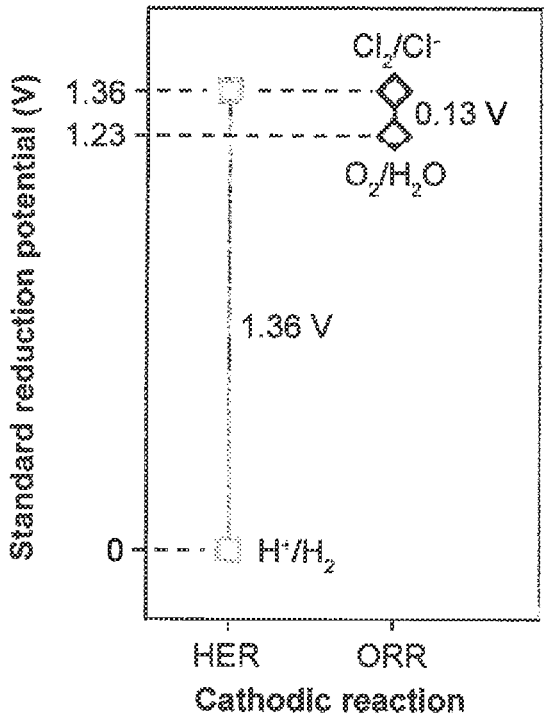
FIG. 18 | Coupling with cathodic ORR and redox-mediated paired system. (a) Theoretical reaction potential for producing EO when the cathode is HER or ORR. EO FE and corresponding full-cell voltage (b) and electrical energy demand and plant-gate levelized cost (c) when coupled with cathodic ORR at different applied current densities. The electricity cost was set as 5 cents/kWh to reflect the current renewable electricity cost. (d) Stability test for producing EO during 100 hours of electrolysis with cathodic ORR under a current density of 100 mA/cm$^2$. (e) Total reaction equation and schematic description of the electrochemical process to produce EO from $CO_2$ using the redox-mediated paired system with an oxygen redox mediator. (f) Comparison of $CO_2$-to-EO FEs using $BaO_x/IrO_2$ catalysts herein relative to that in the highest-performing prior reports for producing EO directly from $CO_2$ and water[6]. The downstream of $CO_2R$ electrolyser was sparged into the anolyte of $C_2H_4$-to-EO oxidation flow cell (current density: 300 mA/cm$^2$) for all studied $CO_2$ flow rates without purification. (g) Reported cathodic and anodic partial current densities for other paired systems combing $CO_2RR$ with anodic upgrading reactions[6,17-21]. Data for the redox-mediated paired system demonstrated in this work are showed in (g) for comparison. All voltages are non-iR-corrected. The error bars correspond to the standard deviation of three independent measurements.
Figure 18B:
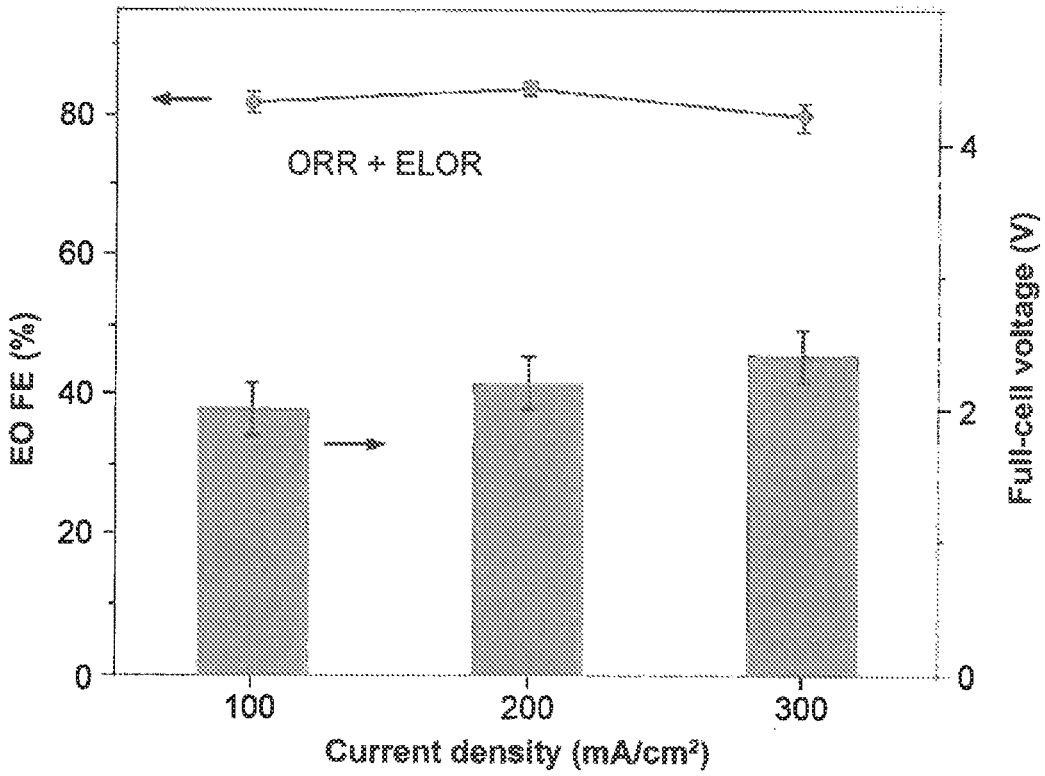

This study thus replaced HER with ORR, enabling a theoretical reaction potential of 0.13 V (FIG. 18*a*). At the applied current densities of 100, 200, and 300 mA/cm$^2$, the FEs of $C_2H_4$-to-EO conversion were >80% with the full-cell voltages of 2.0, 2.2, and 2.4 V, respectively (FIG. 18*b*).

Figure 30:
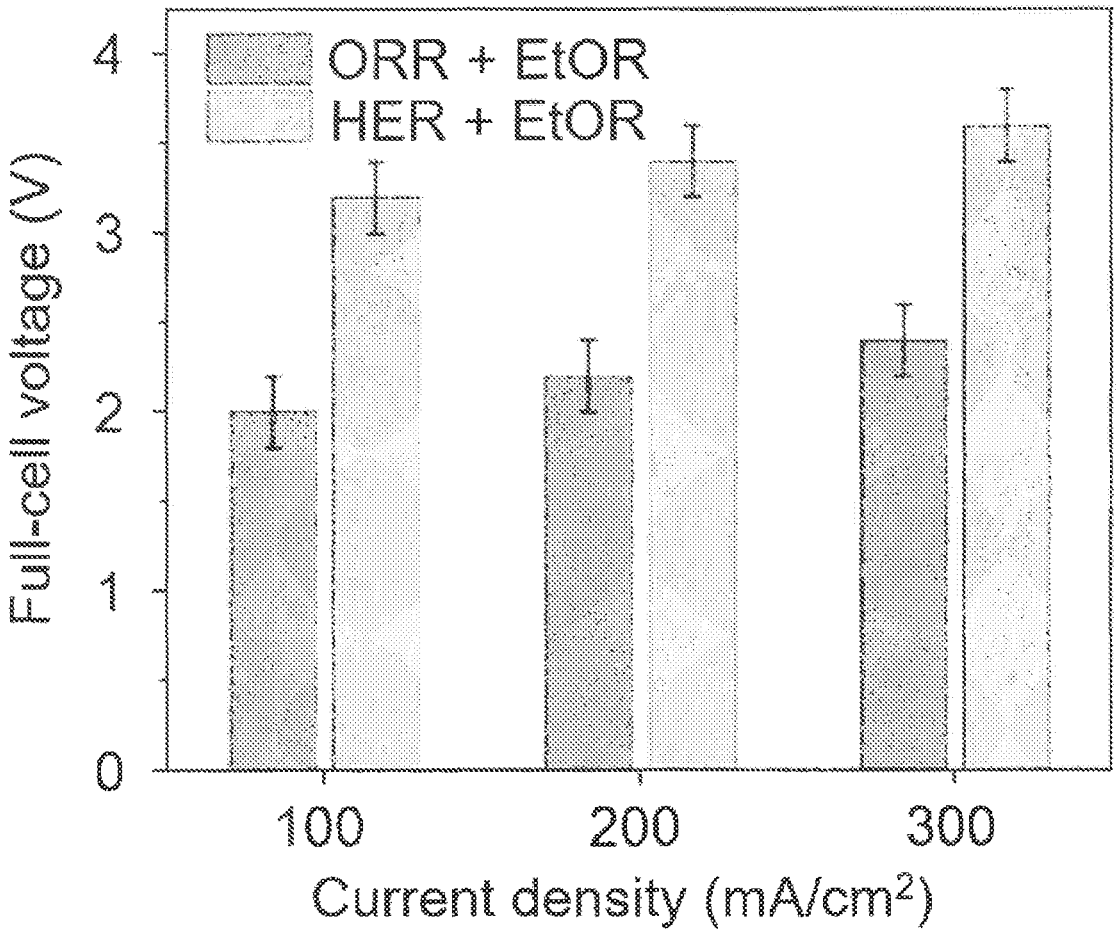
FIG. 30 | Full-cell voltage comparison of different cathodic reactions. The error bars represent the standard deviation from at least three independent tests.
Figures 31A, 31B, 31C:
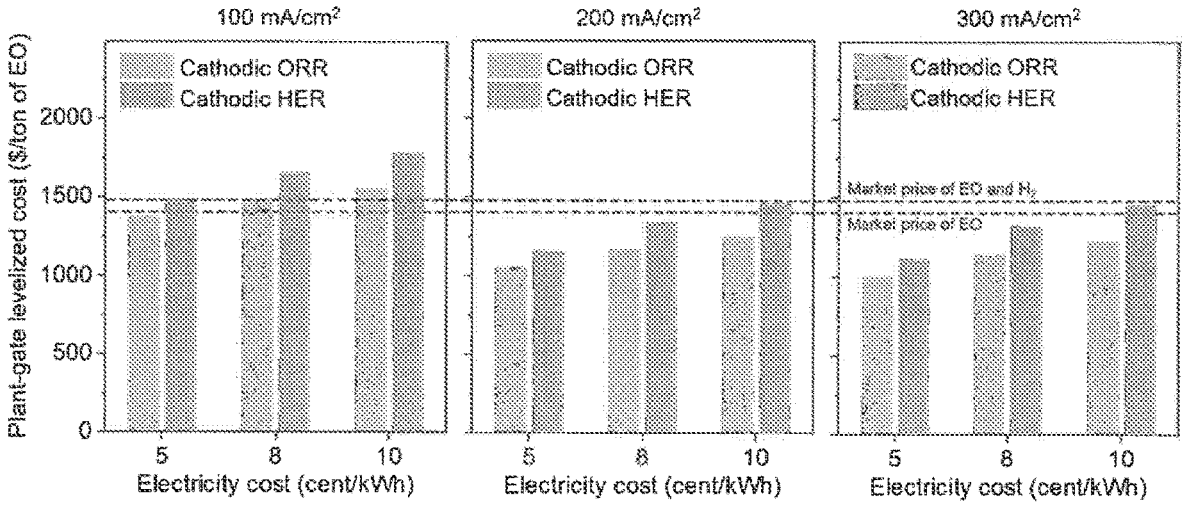
FIG. 31 | Plant-gate levelized cost for producing EO when we pair with cathodic ORR or HER as a function of electricity cost and current density. The red dash line represents the market price of EO, while the black dashed line presents the market price of EO and corresponding $H_2$ produced at the cathode.

It should be noted that the actual operating full-cell voltage is reduced by 1.2 V compared to that of the best prior report that relied on cathodic HER (FIG. 30). The reduction in the operating voltage in turn leads to an energy savings of 5.4 kMJ per ton of EO produced (/$t_{EO}$)—an energy savings that corresponds to the energy to produce $H_2$ in the cathodic HER case (0.045 $t_{H2}$/tEO, energy of 5.4 kMJ/$t_{EO}$). The reduced voltage results in a PGLC reduction of $110/$t_{EO}$, and the loss in economic value by stopping $H_2$ production (0.045 $t_{H2}$/tEO, value of $90/$t_{EO}$) is smaller than the savings in cost introduced by the lower reaction potential (FIG. 31).

Figure 18C:
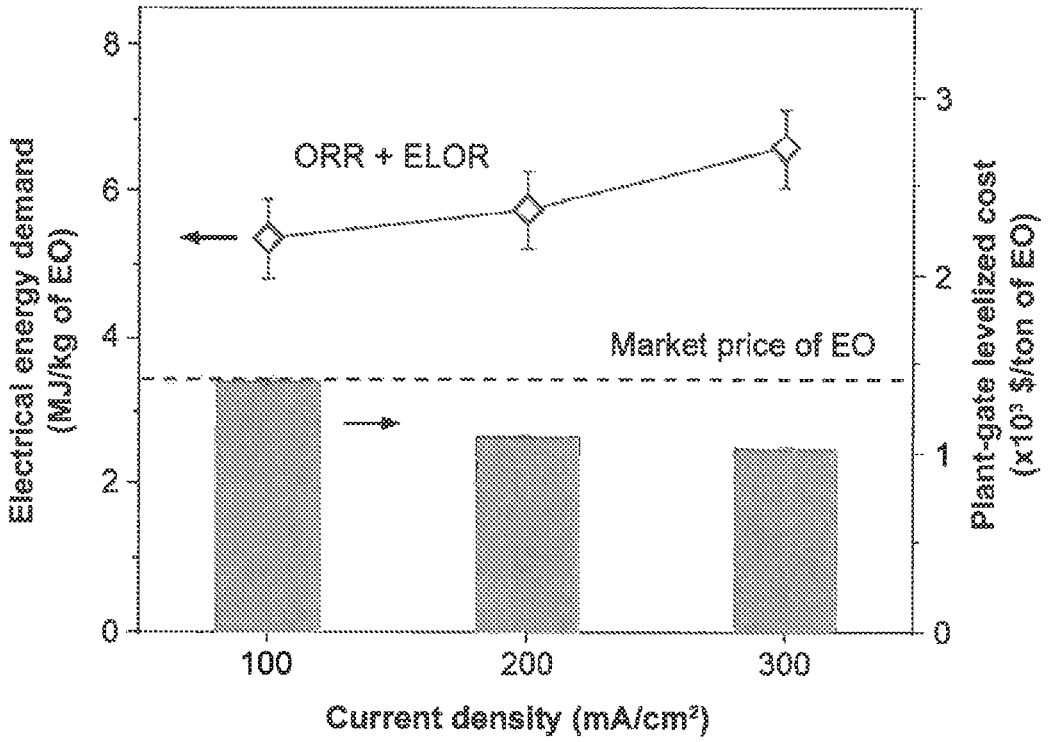
Figure 18D:
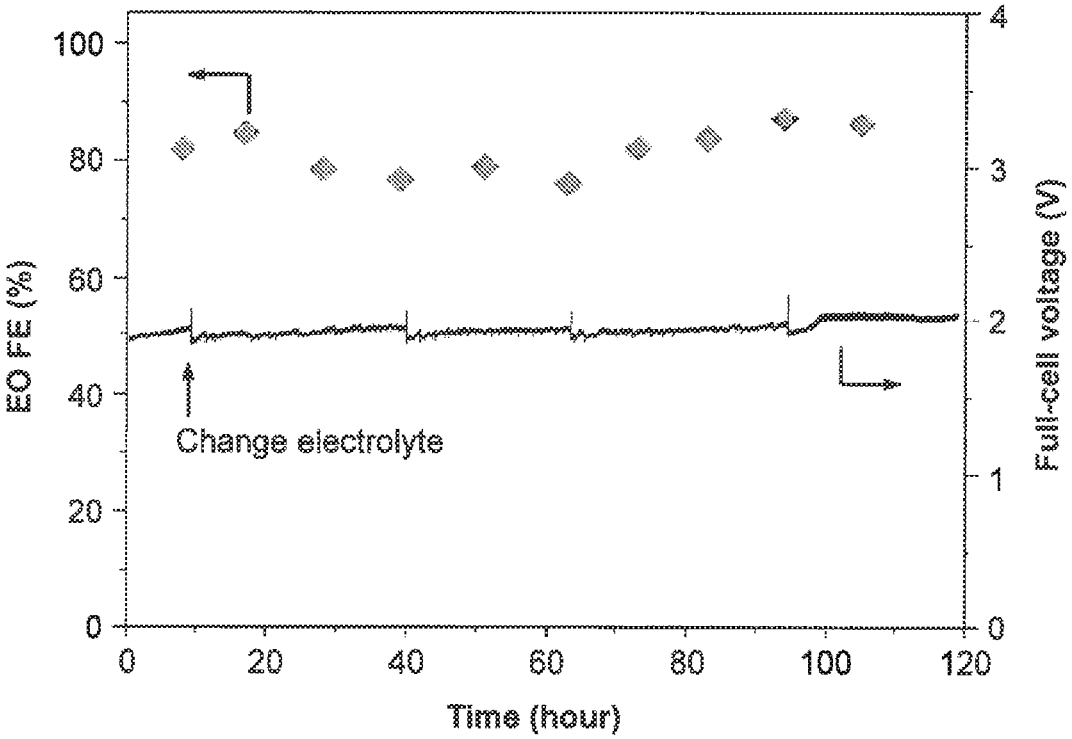

With the benefit of cathodic ORR, the PGLCs in a current density range of 100-300 mA/cm$^2$ are projected to be profitable, with a record-low electrical energy input of 5.3 MJ/kg of EO (FIG. 18*c*), representing a 3.6× reduction in the energy intensity compared to the benchmark electrochemical process. This energy intensity is close to that of conventional emissions-intensive industrial process for producing EO (~4 MJ/kg of EO). It should be noted that in this electrochemical system, the work used the same gas feeds as the industrial direct oxidation process (air and ethylene) for producing EO with an EO selectivity of 98% while that in the industry is <80%. The system was stable—maintaining an average EO FE of >80% and a full-cell voltage of ~2 V at an applied current density of 100 mA/cm$^2$ for over 100 hours (FIG. 18*d*).

Figure 18E:
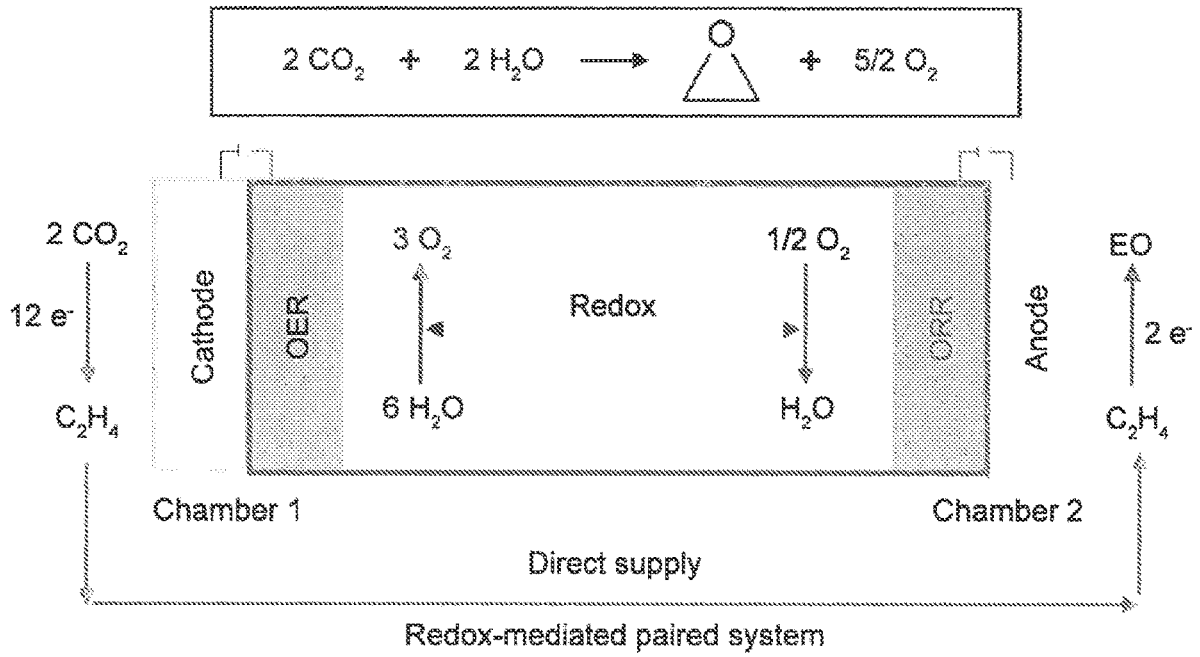
Figure 32:
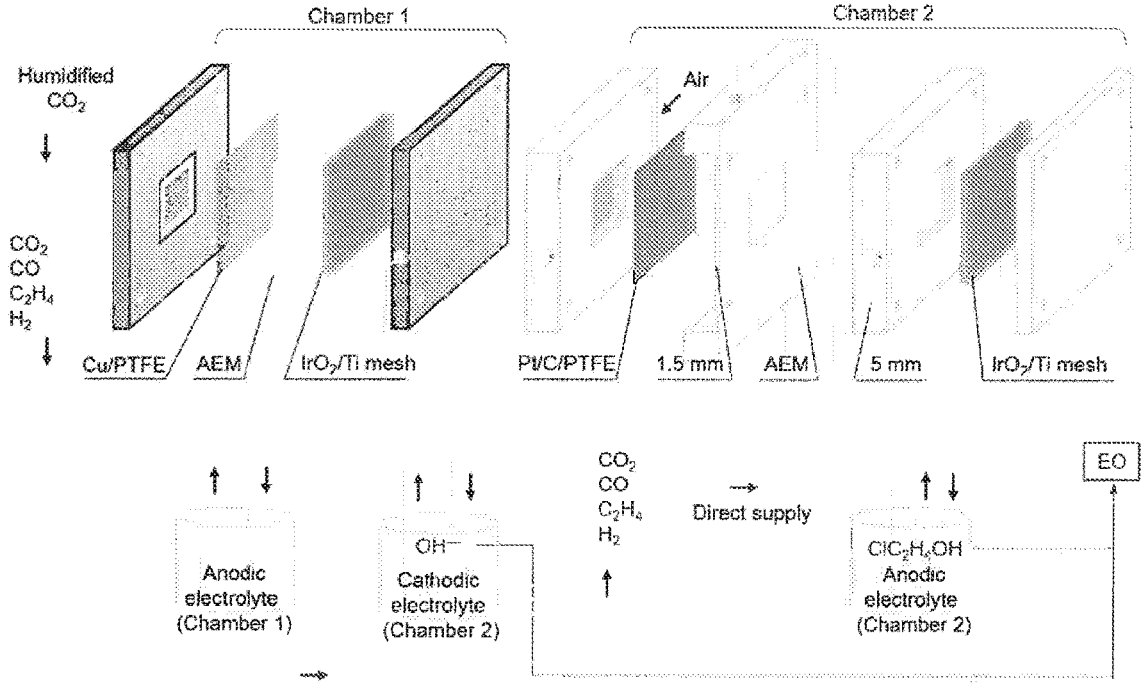
FIG. 32 | A schematic description of the redox-mediated paired system to produce EO from $CO_2$ and water. The output gas of $CO_2$ reduction was sparged into the anolyte of ethylene-to-EO oxidation flow cell without purification.
Figure 35A:
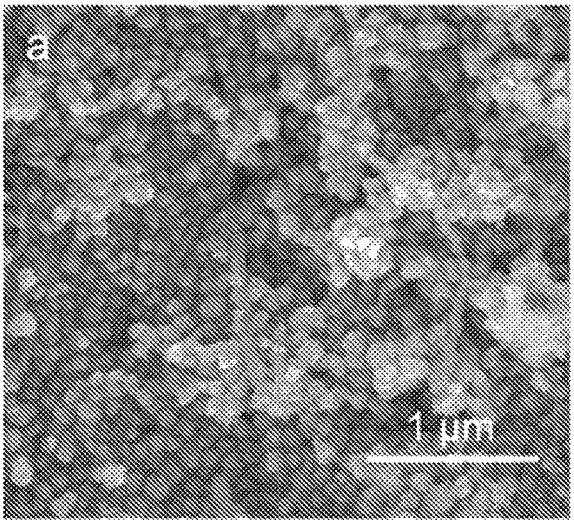
FIG. 35 | SEM and TEM images of the cathode comprised of copper nanoparticles deposited onto copper coated polytetrafluoroethylene substrate for $CO_2$RR in chamber 1 of the redox-mediated paired system before (a,b) and after (c,d) electrochemical tests.
Figure 35B:
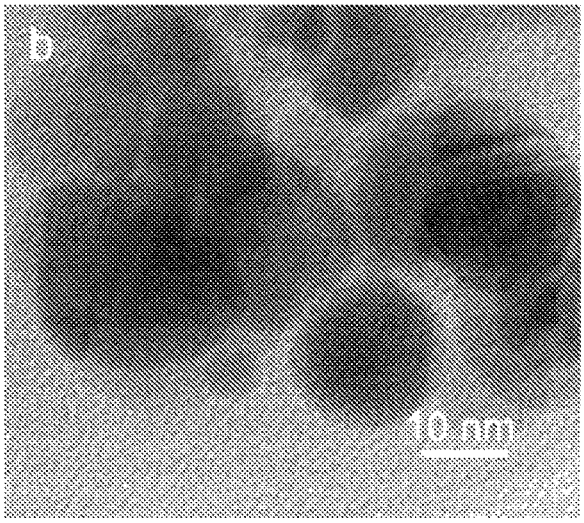
Figure 35C:
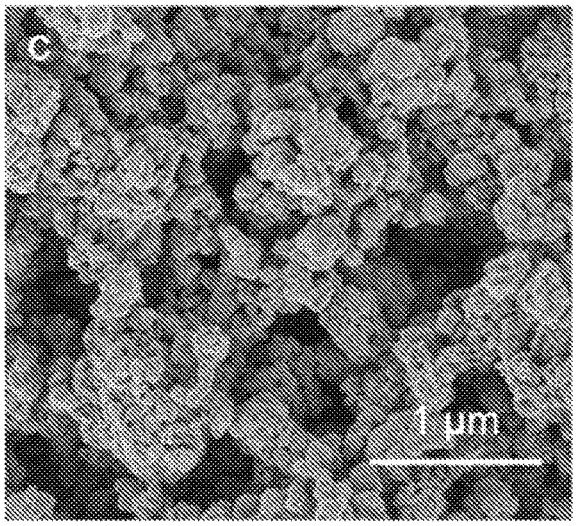
Figure 35D:
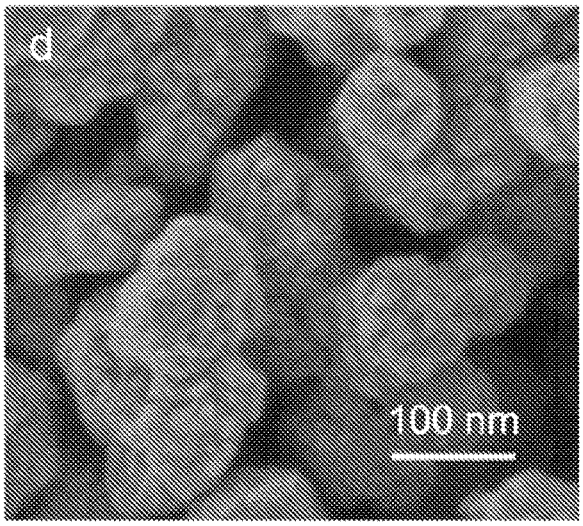
Figure 36A:
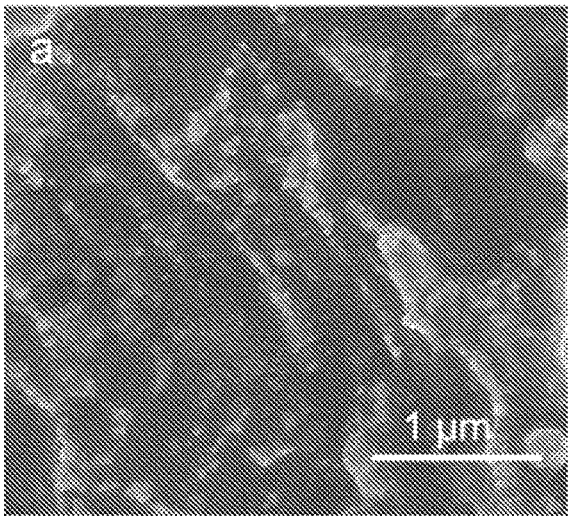
FIG. 36 | SEM and TEM images of $IrO_2$ catalyst for OER in chamber 1 of the redox-mediated paired system before (a,b) and after (c,d) electrochemical tests.
Figure 36B:
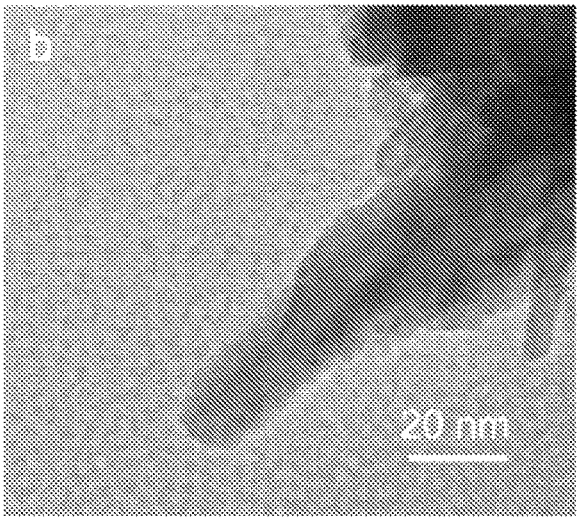
Figure 36C:
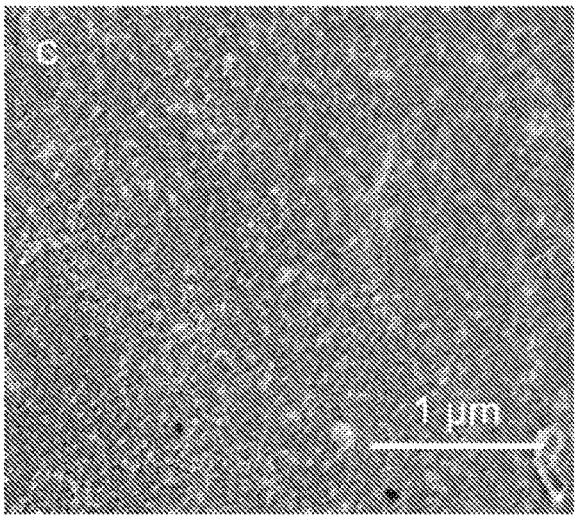
Figure 36D:
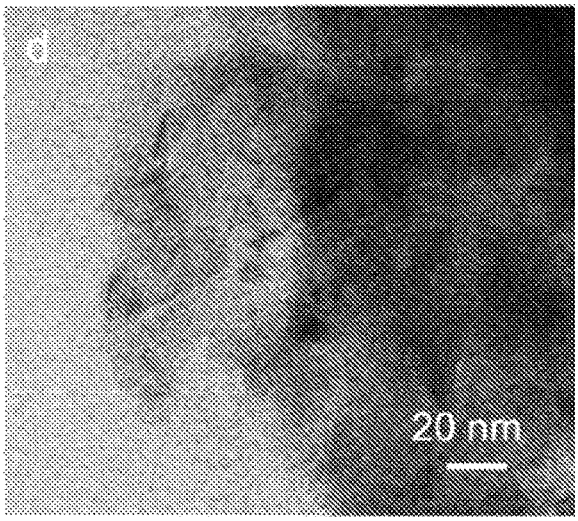

The work also developed and assessed an oxygen-redox-mediated paired system for $CO_2$-to-EO conversion. Using the configuration of cathodic ORR with anodic EtOR, an oxygen redox ($H_2O/O_2$) mediated paired system was built to produce EO from $CO_2$ (FIG. 18*e* and FIG. 32). The $CO_2$-to-$C_2H_4$ reduction in chamber 1 with $C_2H_4$-to-EO oxidation in chamber 2 are connected by the $H_2O/O_2$ mediator that cycles between OER and ORR (Eqs. 1-3 as follows).

On the anode side of chamber 1 for producing 1 mol of $C_2H_4$:

$$6H_2O \rightarrow 3O_2 + 12H^+ + 12e^- \quad (1)$$

On the cathode side of chamber 2 for producing 1 mol of EO:

$$\tfrac{1}{2}O_2(\text{fed by air}) + H_2O + 2e^- \rightarrow 2OH^- \quad (2)$$

In the $H_2O/O_2$ mediator (combining Eq. 1 and Eq. 2):

$$5H_2O \rightarrow \tfrac{5}{2}O_2 + 10H^+ + 10e^- \quad (3)$$

It should be noted that two approaches have been developed to produce EO from $CO_2$ by electrochemical means (see Table 3, FIG. 33, and Supplementary Note 3). The first is two independent electrolyzers: one for $CO_2RR$ coupled with oxygen evolution reaction (OER), and another for EtOR coupled with HER. The second is direct coupling of $CO_2RR$ with EtOR in one electrolyzer. However, the first approach requires an added theoretical reaction potential of 1.23 V (FIG. 18*a*), and second approach has current matching issue that limits the anodic EO FE to an upper ~17% (Supplementary Note 4 and Table 6).

The oxygen-redox-mediated paired system overcomes the above problems: the system maintained a low theoretical reaction potential of 1.28 V for $CO_2$-to-$C_2H_4$ reduction with $C_2H_4$-to-EO oxidation (Table 3), and overcame the larger electron consumption in $CO_2$-to-$C_2H_4$(12 $e^-$) vs. $C_2H_4$-to-EO (2 $e^-$) by converting more $H_2O$ into $O_2$, rendering $H_2O$ as the only sacrificial agent (Eq. 3).

The redox-mediated electrochemical system also enables the synthesis of EO from $CO_2$, water, and renewable electricity with a consumption of 2 $t_{CO2}/t_{EO}$, in contrast to a total emission of 2.0~2.7 $t_{CO2}/t_{EO}$ and direct emission of 0.55 $t_{CO2}/t_{EO}$ in the existing thermochemical processes (FIG. 34 and Tables 7-8).

Figure 18F:
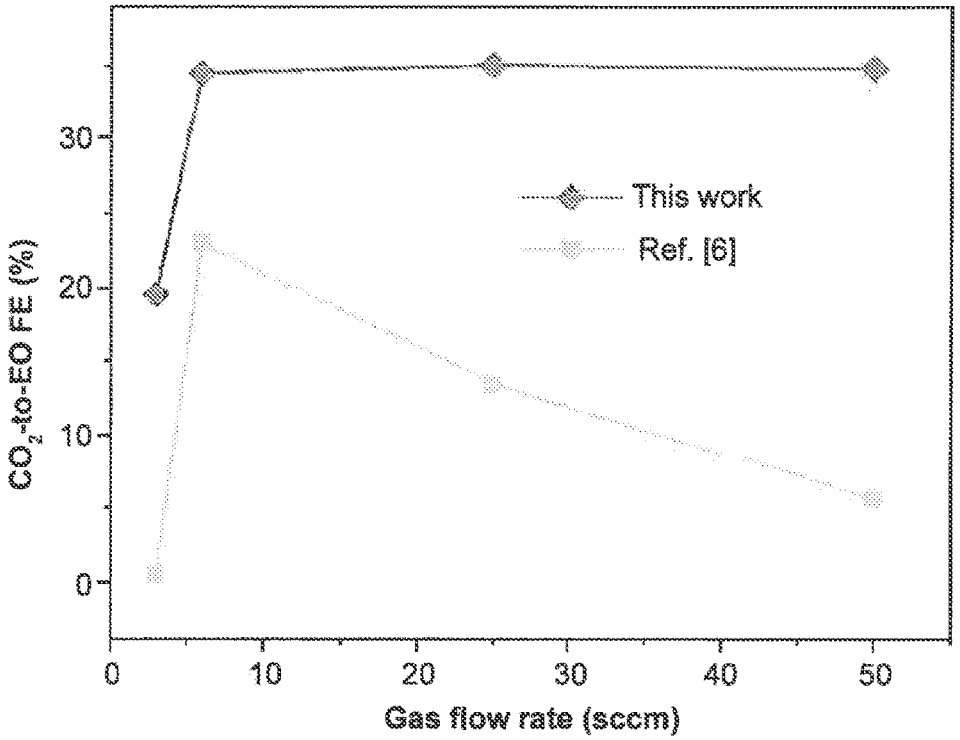
Figure 37A:
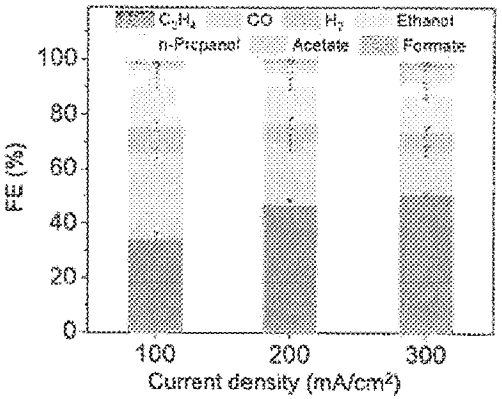
FIG. 37 | (a) $CO_2$RR product distributions and (FIG. 37B) extended $CO_2$-to-$C_2H_4$ conversion in chamber 1 of the redox-mediated paired system for 100 hours. The error bars represent the standard deviation from at least three independent tests. The stability test indicates that the $C_2H_4$ required for the chamber 2 is constantly provided by chamber 1.
Figure 37B:
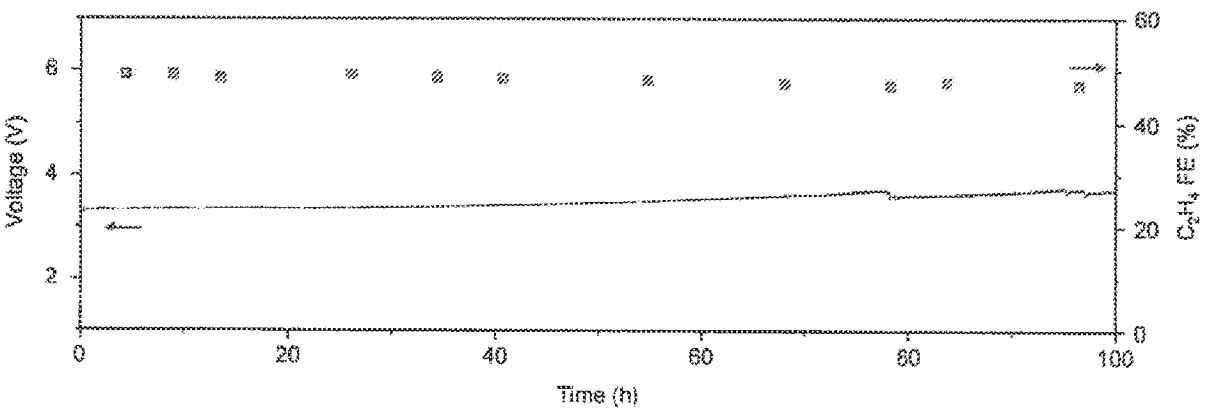
Figure 38A:
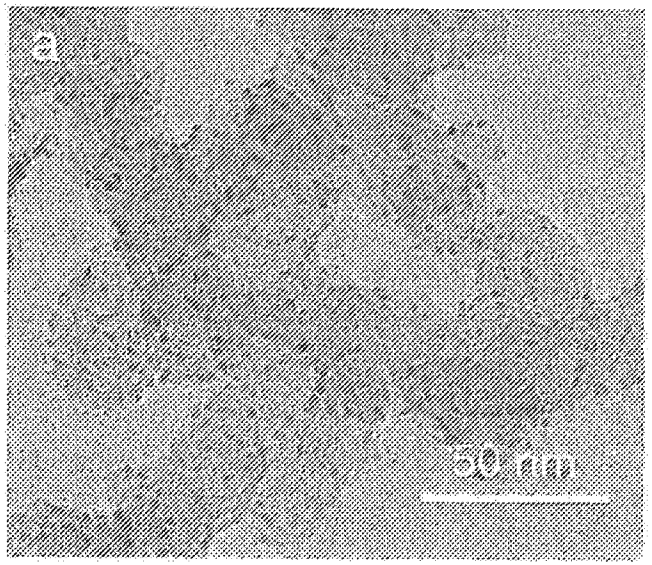
FIG. 38 | (a) TEM image of the platinum supported carbon catalyst and (b) corresponding size distribution of platinum nanoparticles.
Figure 38B:
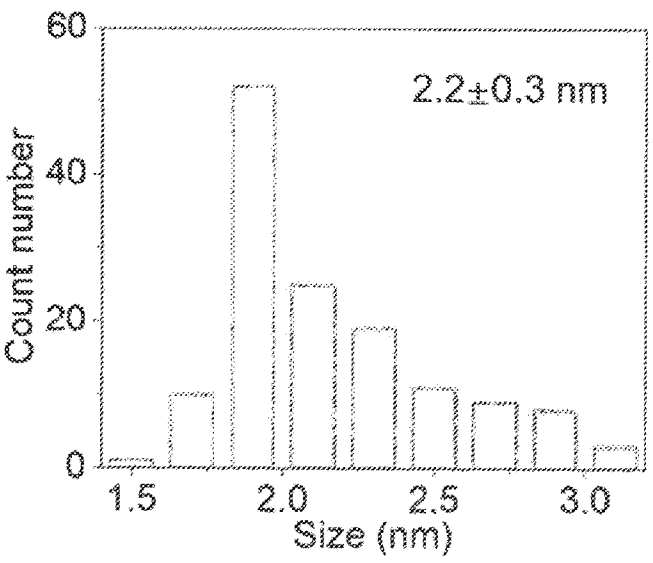

The work produced $C_2H_4$ with ~45% FE from the $CO_2$RR at different current densities, and the cathode and anode in chamber 1 maintain stable operation for 100 hours of $CO_2$RR (FIGS. 35-37 and Table 9). The work achieved a total $CO_2$-to-EO FE of ~35% by using the electrocatalytically generated $C_2H_4$ from chamber 1 at a current density of 300 mA/cm$^2$ with different $CO_2$ gas flow rates (FIG. 18*f*, FIG. 38, and Table 10). It is noted that, for comparison, this EO productivity is >1.5× higher than that reported in the literature-benchmark electrocatalytic $CO_2$-to-EO conversion system.

Figure 18G:
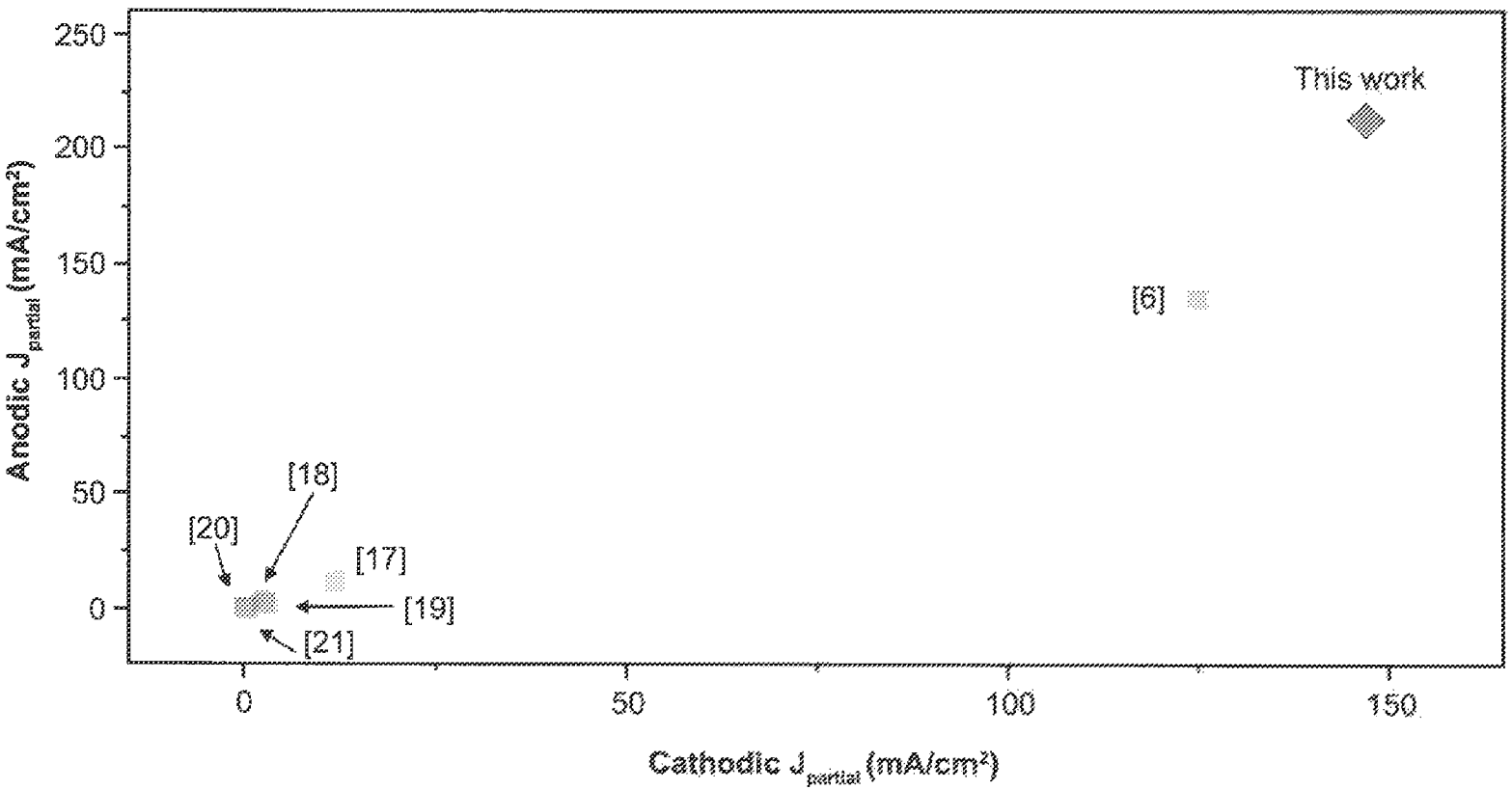
Figure 19A:
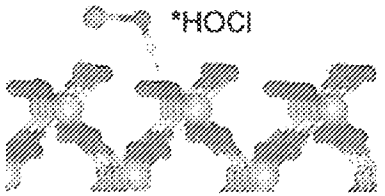
FIG. 19 | Surface adsorption configurations of $IrO_2$(200) with perfect (a and b) and $O_v$ (c and d) surfaces, and $Ba_3O_4$-cluster loaded $IrO_2$(200) with perfect (FIGS. e and f) and $O_v$ (g and h) surfaces. The dashed circles in c, d, g, and h show the $O_v$ site. Gold, iridium; blue, barium; green, chlorine; red, oxygen; pink, hydrogen.
Figure 19B:
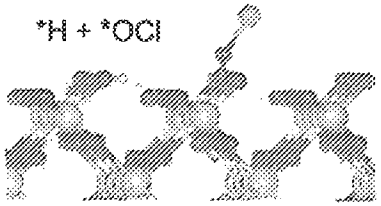
Figure 19C:
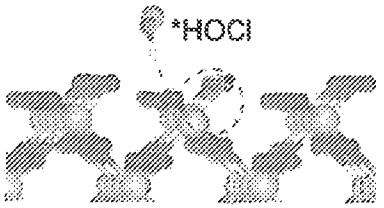
Figure 19D:
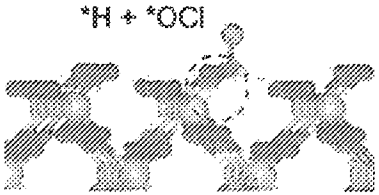
Figure 19E:
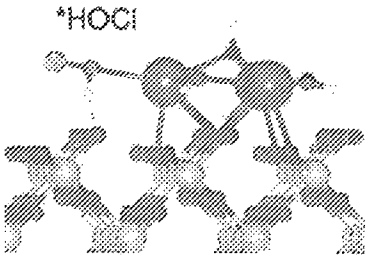
Figure 19F:
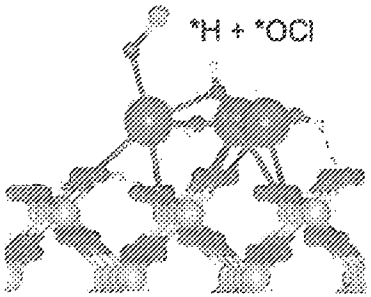
Figure 19G:
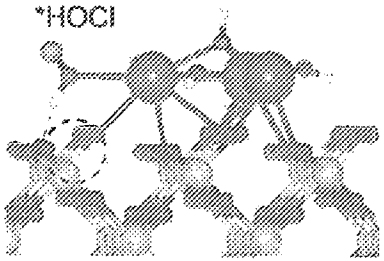
Figure 19H:
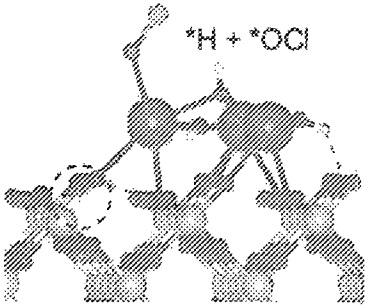
Figure 20:
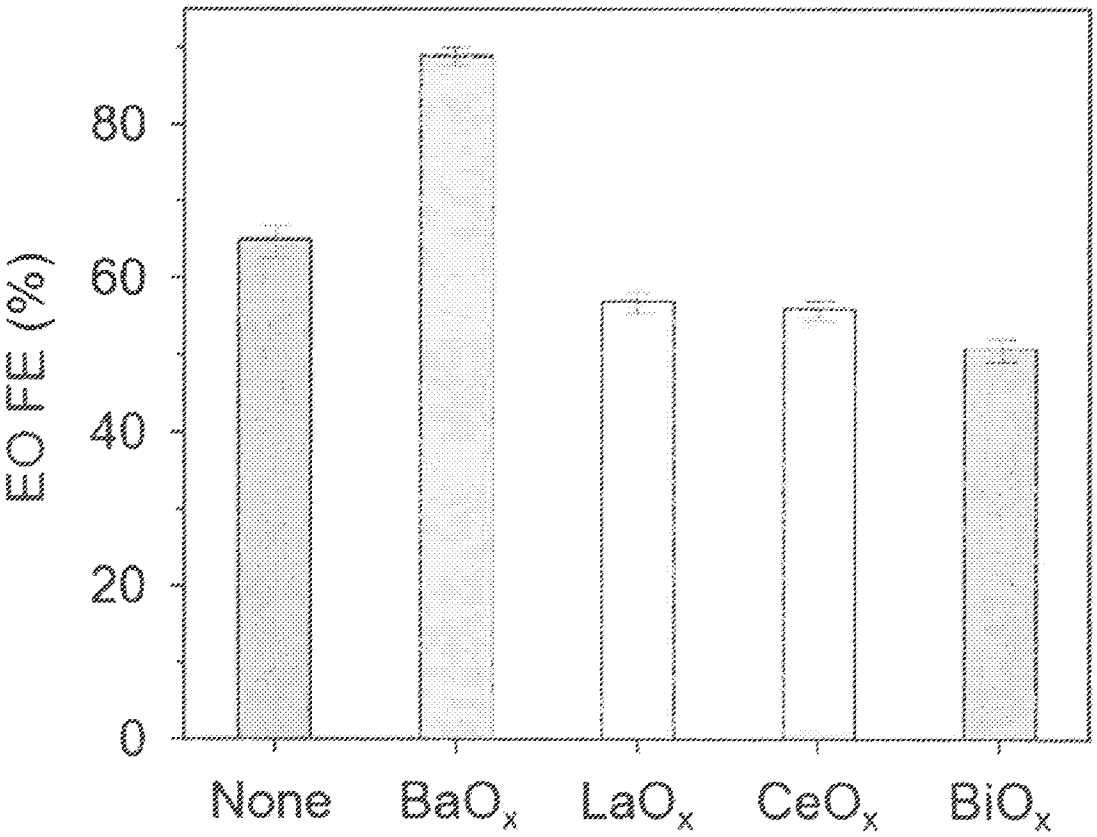
FIG. 20 | EO FEs on the bare $IrO_2$ (None) and different period-6-metal oxides loaded $IrO_2$ catalysts with 3 wt % loadings. All electrochemical reactions are performed in 2 M KCl electrolyte at a current density of 100 mA/cm$^2$. The error bars represent the standard deviation from at least three independent tests.
Figure 21A:
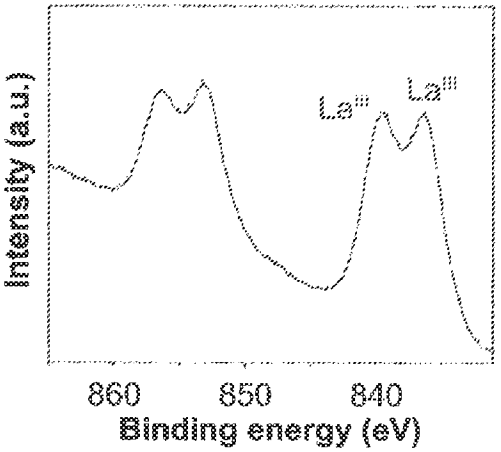
FIG. 21 | La 3d (a), Ir 4f (b) and O 1s (c) XPS spectra and TEM elemental mappings of La (d), Ir (e) and O (f) of the as-prepared $LaO_x/IrO_2$ catalyst.
Figure 21B:
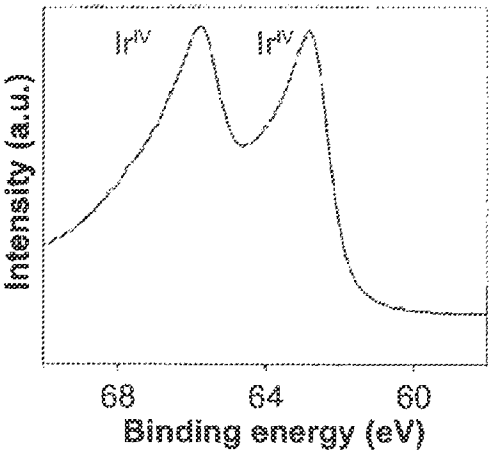
Figure 21C:
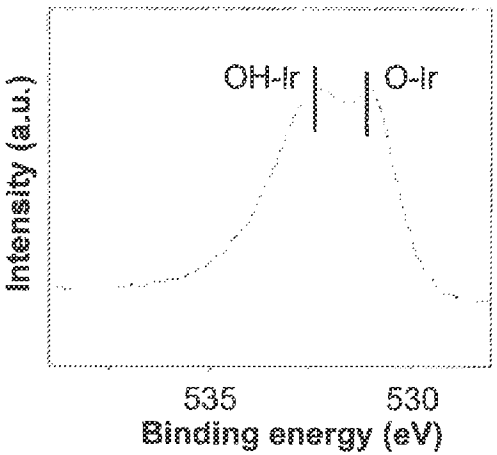
Figure 21D:
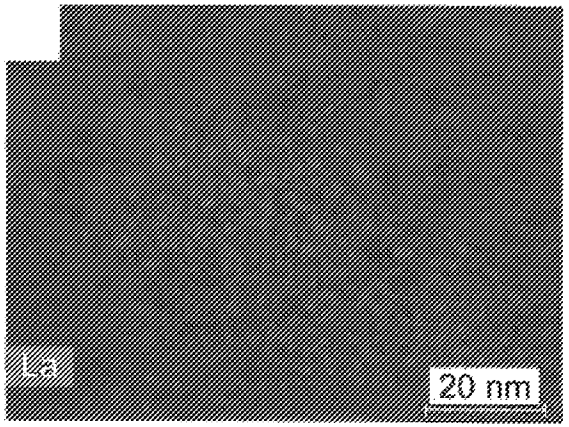
Figure 21E:
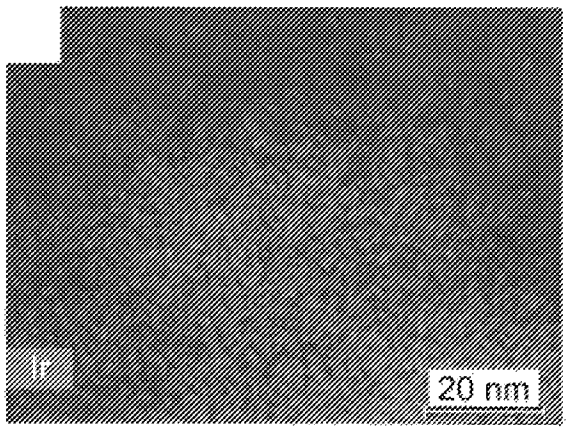
Figure 21F:
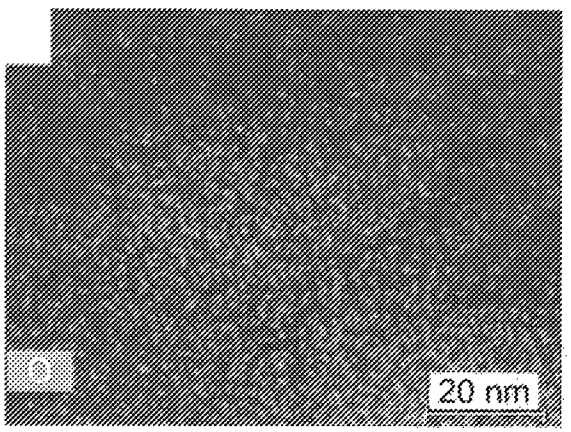
Figure 22A:
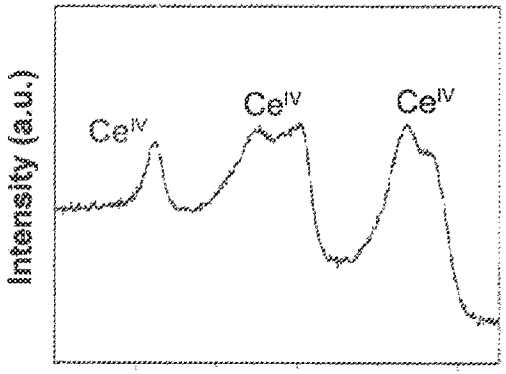
FIG. 22 | Ce 3d (a), Ir 4f (b) and O 1 s (c) XPS spectra and TEM elemental mappings of Ce (d), Ir (e) and O (f) of the as-prepared $LaO_x/IrO_2$ catalyst.
Figure 22B:
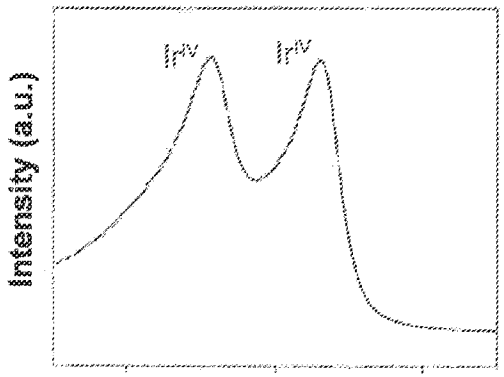
Figure 22C:
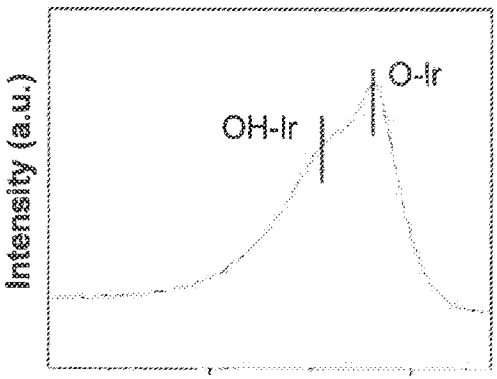
Figure 22D:
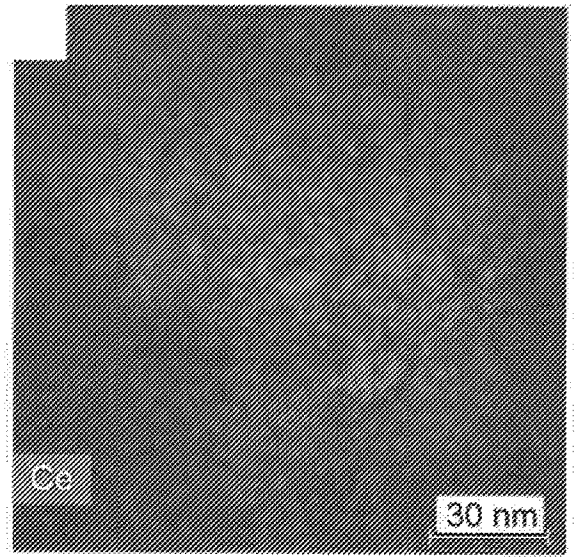
Figure 22E:
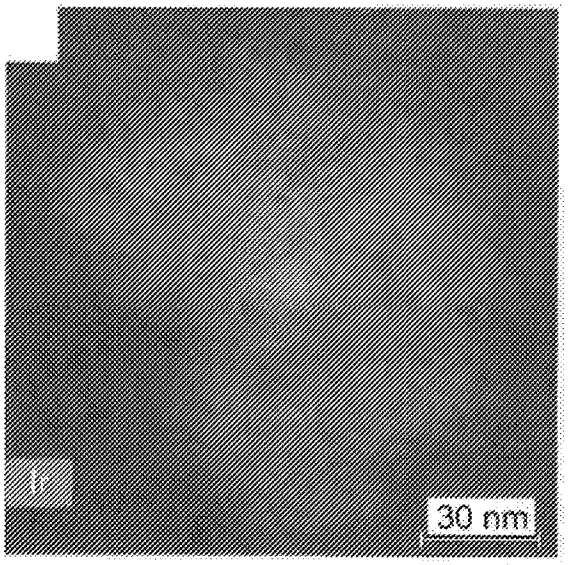
Figure 22F:
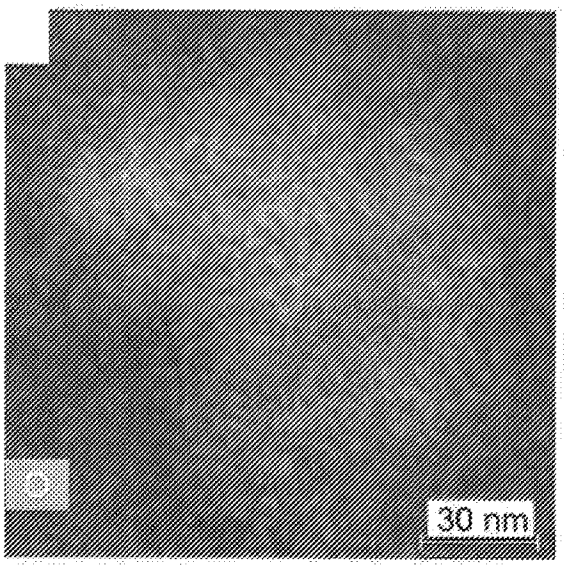
Figure 23A:
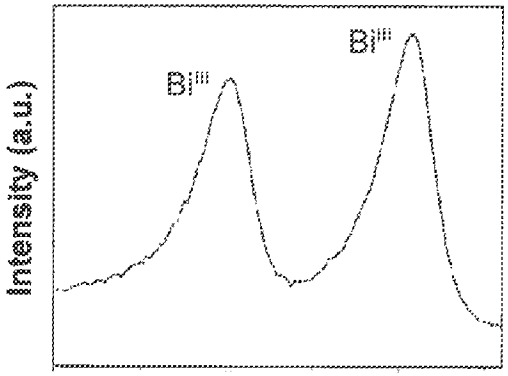
FIG. 23 | Bi 4f (a), Ir 4f (b) and O 1s (d) XPS spectra and TEM elemental mappings of Bi (d), Ir (e) and O (f) of the as-prepared $BiO_x/IrO_2$ catalyst.
Figure 23B:
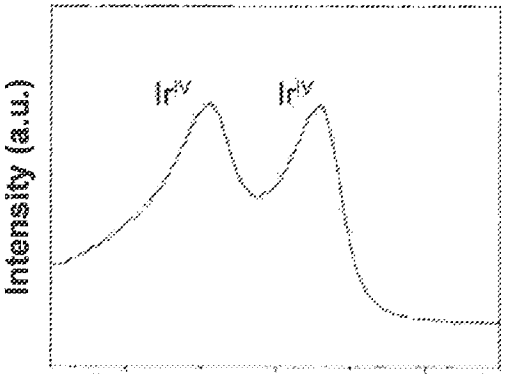
Figure 23C:
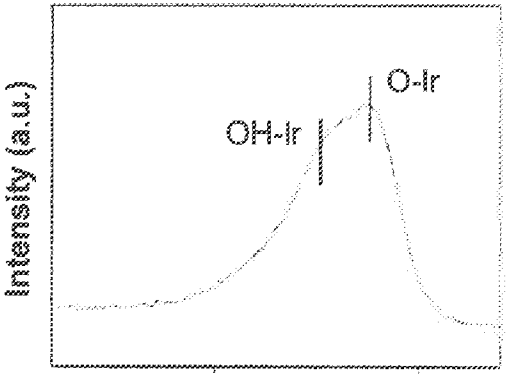
Figure 23D:
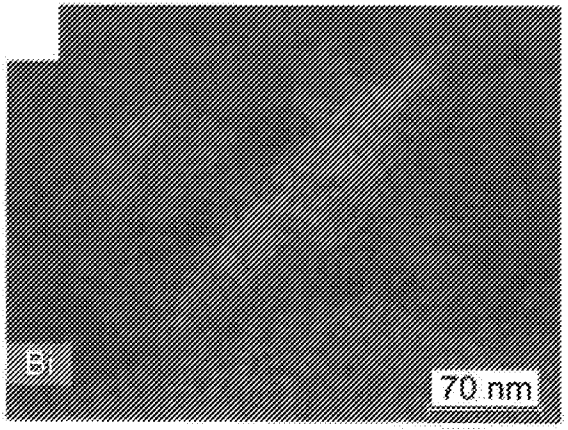
Figure 23E:
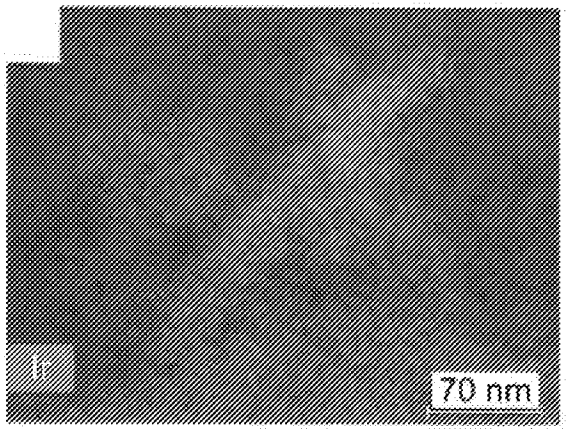
Figure 23F:
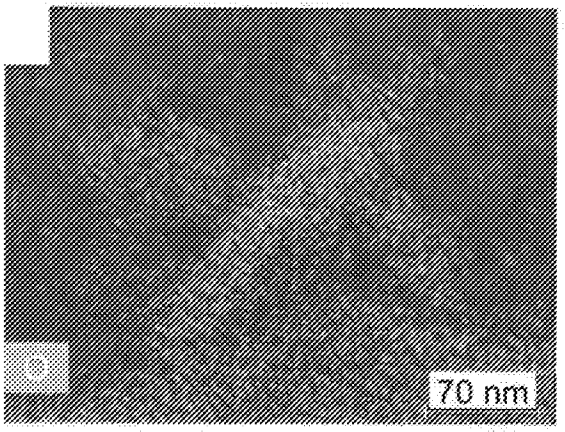

The work also compared the performance of the redox-mediated paired system with prior paired systems combing $CO_2$RR with anodic upgrading reactions. With a total current density of 300 mA/cm$^2$ and high FEs, this work achieved partial current densities of 147 and 213 mA/cm$^2$ for the cathodic $C_2H_4$ product and anodic EO product, respectively. These outperform by 1.5× the best prior reports of paired systems that combine $CO_2$ reduction with anodic upgrading (FIG. 18*g* and Tables 11-12).

In terms of discussion, this work addressed limitations of electrochemical production of EO from $CO_2$. in the end, we achieved an FE for $CO_2$-to-EO conversion that enables a 1.5-fold higher productivity compared to literature benchmark electrochemical systems. The work presented a surface modification strategy to enhance the electrosynthesis of EO on the period-6-metal oxides as HOCl-cleavage-inhibitor candidates loaded $IrO_2$. Using this strategy, the work found out the $BaO_x/IrO_2$ interface serves to prevent the pathway for HOCl cleavage. The catalysts achieved a higher EO FE of 85-91% than the bare $IrO_2$ studied in the previous work and a selectivity of 98% in a current density range from 100 to 1500 mA/cm$^2$. We obtained a stable full-cell EE of 37% at 100 mA/cm$^2$ for 300 hours when pairing cathodic HER. By displacing cathodic reaction to ORR, we achieved a 1.2 V reduction in the full-cell voltage, enabling a record-low energy input of 5.3 MJ/kg for producing EO electrochemically, representing a 3.6× reduction in energy intensity compared to the benchmark electrochemical process[6]. We further devised an $O_2$-redox-mediated paired system comprising $CO_2$-to-$C_2H_4$ reduction and $C_2H_4$-to-EO oxidation with a total ~35% FE for complete $CO_2$-to-EO conversion, which means that high-rate, efficient, and stable electrosynthesis of EO can be achieved by using $CO_2$, $H_2O$, and renewable electricity as the only consumables.

Methods

Materials Preparation

The electrodes for the anodic reaction were prepared by following a five-step procedure. The procedure involves (i) etching the titanium (Ti) mesh in 3 M HCl (≥98%, Sigma Aldrich®) at 75° C. for 40 min, (ii) soaking the etched Ti mesh into a well-mixed solution of iridium (IV) oxide dehydrate (99.99%, Alfa Aesar®), HCl (ACS reagent, 37%) and barium chloride dihydrate (>99.999%) (with various wt % ratios), and isopropanol (Sigma Aldrich®), (iii) drying the resulting Ti mesh at 120° C., (iv) sintering the Ti mesh at 500° C. to obtain $BaO_x/IrO_2$ catalyst on Ti mesh ($IrO_2$/Ti), and (v) repeating the soaking, drying, and sintering steps until the target $BaO_x/IrO_2$ loading of 2 mg/cm$^2$ is achieved. $IrO_2$ on Ti mesh electrodes were prepared by following a procedure similar to that described above, except for incorporating barium chloride dihydrate salt into the catalyst ink. For the XRD measurement, a similar procedure was followed, yet $BaO_x/IrO_2$ catalyst was supported onto a hydrophilic carbon cloth (CT Carbon Cloth without MPL, Fuel Cell Store) instead of a Ti mesh, and the $BaO_x/IrO_2$ catalyst was extracted from the surface of the carbon cloth upon completion of the synthesis. For other metal oxides loaded catalysts, we changed the barium precursor to the corresponding metal chloride with 3 wt % ratio.

The following provides a description of electrode preparation for the redox-mediated paired system. The electrodes for the $CO_2$RR (chamber 1, cathode) were prepared by following a two-step procedure. In the first step, Cu/PTFE electrodes were prepared by evaporating Cu target (Kurt J. Lesker Company) onto the hydrophobic PTFE substrate (450 μm average pore size) with a constant sputtering rate of 0.5 Å/s at $10^{-6}$ Torr until the ideal sputtering thickness of 150 nm was achieved. In the second step, Cu NPs/Cu/PTFE electrodes were prepared by spray-depositing a homogeneous solution of Cu nanoparticles (Sigma Aldrich®, 25 nm) and a polymeric binder (Aquivion® D79-25BS, Sigma Aldrich) onto the Cu/PTFE substrate until the optimum catalyst loading of 1.25 mg/cm$^2$ was achieved. It is noted that various copper based electrode structures and materials can be used in the context of preparing the $CO_2$RR cathode.

The electrodes for the OER (chamber 1, anode) were akin to the above $IrO_2$ on Ti mesh electrodes. For the electrodes for the ORR (chamber 2, cathode), a well-mixed solution of commercially available platinum supported on graphitized carbon (40% Pt on Vulcan XC72, 40% Pt/Vulcan) and polymeric binder (Aquivion® D79-25BS, Sigma Aldrich) was spray-deposited on a superhydrophobic gas diffusion layer (GDL) on a heated vacuum plate at 50° C. The deposition was continued until the Pt loading of 0.4 mg/cm$^2$ was achieved.

Materials Characterization

TEM imaging and EDX elemental mapping were carried out by a field emission transmission electron microscope (Hitachi HF3300). SEM images were obtained using a scanning electron microscope (Hitachi S-5200). XRD spectra were obtained by an XRD spectrometer (MiniFlex600) with Cu-Kα radiation. XPS was conducted on a Thermo Scientific K-Alpha XPS system using Al Kα X-ray radiation (1486.6 eV) for excitation. The loading content was detected by inductively coupled plasma atomic emission spectroscopy (ICP-AES).

Electrochemical Tests

Ethylene oxidation experiments were carried out in a flow cell, equipped with an anode electrode ($IrO_2$/Ti), anion exchange membrane (Fumasep FAB-PK-130), and cathode electrode. This work fabricated the cathodic and anodic flow field plates for electrolyte delivery with the thicknesses of 1.5 and 5 mm, respectively. With the thicker anodic plate, the work aimed at preventing membrane leaching that would be caused by the generated chlorine (Eq. S1 in Supplementary Note 1). The cathode electrode was fed with air and argon for the ORR and HER, respectively. For the anodic reaction with a reaction area of 1 cm$^2$, pure $C_2H_4$ from the cylinder was used as gas feed unless otherwise stated. The catholyte and anolyte (both 2 M KCl) of the constant volumes of 25 mL were circulated through the electrolyzer with a constant flow rate of 10 mL/min by using a peristaltic pump equipped with silicon tubing. Upon completion of 1-h electrolysis, the samples were collected from the anolyte container and stored in the sealed vials for two days in a refrigerator before further testing. Calibrations were carried out by using diluted solutions of the potential electrolysis products: ethylene oxide and ethylene chlorohydrin. Liquid products were analyzed by a high-performance liquid chromatography with a Thermo Scientific Dionex UltiMate 3000 or a nuclear magnetic resonance spectrometer (Agilent DD2 600 MHz) using dimethylsulfoxide (DMSO) as the internal standard. The $CO_2RR$ performance assessment of the electrodes was made by using a custom-made electrochemical test station. The station included a potentiostat and a booster (Metrohm Autolab, 10A) for the control of applied potential and current, mass flow controller (Sierra, SmartTrak 100) for the supply of $CO_2$, $CO_2RR$ membrane electrode assembly electrolyzer (Dioxide Materials) for electrochemical reaction, humidifier for $CO_2$ humidification, peristaltic pump with silicon tubing for the anolyte circulation. The chamber 1 comprised anode and cathode flow field plates made of titanium and stainless steel, respectively. The geometric flow field areas of the anode and cathode sides were 5 $cm^2$. The anode flow channels were responsible for the uniform supply of 0.1 M $KHCO_3$ anolyte while the cathode flow channels were responsible for the uniform supply of humidified $CO_2$. Before the electrochemical assessment, the anode and cathode electrodes were placed on their respective flow field plates, and each bolt of the electrolyzer was tightened by applying an equal compression torque. For the sake of good electrical contact, the cathode electrode was attached to its respective flow-field plate by using a copper tape frame, which was later on covered via a Kapton tape frame. The electronically conductive anode electrode was mounted firmly on its corresponding flow-field plate. The AEM was activated in 1 M KOH for at least 24 hours and soaked in water for 5 min prior to the cell assembly. Following the electrolyzer assembly, 0.1 M $KHCO_3$ anolyte was circulated with a constant flow rate of 10 mL/min by a peristaltic pump through the anode flow channels. The humidified $CO_2$ was fed into the cathode flow channels with a constant flow rate of 50 sccm by a mass flow controller unless otherwise stated. The reaction was then initiated by applying a current density of interest (100, 200, and 300 $mA/cm^2$). The corresponding full-cell voltage for each current density applied was recorded while concurrently collecting the gas products of the $CO_2RR$ via a gas-tight syringe (Hamilton chromatography syringe) in a constant 1 mL volume from the cathode outlet. The gas samples collected were injected into the gas chromatography unit (GC, PerkinElmer Clarus 680), equipped with three main components: a flame ionization detector (FID), a thermal conductivity detector (TCD), and packed columns. The GC spectra obtained were utilized to calculate the FEs of the gas products, including $H_2$, CO, $CH_4$, and $C_2H_4$. For each current density, the gas product collection was performed at least three times at suitable time intervals.

Density Functional Theory Calculations

Ab-initio DFT calculations were performed by applying the projector augmented wave method as implemented in Vienna Ab-initio Simulation Package (VASP) software. A plane wave cutoff of 450 eV with 2×2×1 Monkhorst-Pack k-points grid were applied for both $IrO_2$ and $BaO_x/IrO_2$. $BaO_x/IrO_2$ (x=1~2) was modeled by depositing barium oxide clusters ($Ba_3O_4$) on a twelve-atomic-layer (4×3) supercell of $IrO_2$(200) surface with O-termination. The work considered the fully hydroxylated barium oxide clusters ($Ba_3O_4H_4$) since the saturation of oxygen atoms in metal oxide clusters was favored under electrochemical environment. The zero damping DFT-D3 method of Grimme was used to ensure a good description of van der Waals interactions. A standard dipole correction was also included to have the electrostatic interaction decoupled between the periodic images. During the relaxation, atoms in the bottommost 6 atomic layers of $IrO_2$ were fixed to their bulk positions, whereas other atoms were allowed to relax. All relaxations were considered to reach the convergence until the Hellman-Feynman force on each ion was <0.01 eV $Å^{-1}$.

FURTHER REFERENCES

1. De Luna, P. et al. What would it take for renewably powered electrosynthesis to displace petrochemical processes? *Science* 364, eaav3506 (2019).
2. Zheng, J. & Suh, S. Strategies to reduce the global carbon footprint of plastics. *Nat. Clim. Chang.* 9, 374-378 (2019).
3. International Energy Agency, Direct $CO_2$ emissions from primary chemical production in the sustainable development scenario, 2015-2030, IEA, Paris. https://www.iea.org/data-and-statistics/charts/direct-co2-emissions-from-primary-chemical-production-in-the-sustainable-development-scenario-2015-2030
4. Boulamanti, A. & Moya, J. A. Energy efficiency and GHG emissions: Prospective scenarios for the chemical and petrochemical industry. DOI: 10.2760/630308 (2017).
5. Li, F. et al. Molecular tuning of $CO_2$-to-ethylene conversion. *Nature* 577, 509-513 (2020).
6. Leow, W. R. et al. Chloride-mediated selective electrosynthesis of ethylene and propylene oxides at high current density. *Science* 368, 1228-1233 (2020).
7. Barton, J. L. Electrification of the chemical industry. *Science* 368, 1181-1182 (2020).
8. Chung, M., Jin, K., Zeng, J. S. & Manthiram, K. Mechanism of chlorine-mediated electrochemical ethylene oxidation in saline water. *ACS Catal.* 10, 14015-14023 (2020).
9. Lum, Y. et al. Tuning OH binding energy enables selective electrochemical oxidation of ethylene to ethylene glycol. *Nat. Catal.* 3, 14-22 (2020).
10. Zhuang, T.-T. et al. Dopant-tuned stabilization of intermediates promotes electrosynthesis of valuable $C_3$ products. *Nat. Commun.* 10, 4807 (2019).
11. Tachikawa, T., Beniya, A., Shigetoh, K. & Higashi, S. Relationship between OER activity and annealing temperature of sputter-deposited flat $IrO_2$ thin films. *Catal. Lett.* 150, 1976-1984 (2020).
12. Touni, A., Papaderakis, A., Karfaridis, D., Vourlias, G. & Sotiropoulos, S. Oxygen evolution reaction at $IrO_2$/Ir(Ni) film electrodes prepared by galvanic replacement and anodization: effect of precursor Ni film thickness. *Molecules* 24, 2095 (2019).
13. Carrillo, A. J., Sastre, D., Serrano, D. P., Pizarro, P. & Coronado, J. M. Revisiting the $BaO_2$/BaO redox cycle for solar thermochemical energy storage. *Phys. Chem. Chem. Phys.* 18, 8039-8048 (2016).
14. Nikolaeva, E. V., Zakiryanova, I. D., Korzun, I. V., Bovet, A. L. & Antonov, B. D. Interaction between barium oxide and barium containing chloride melt. *Z. Naturforsch.* 70, 325-331 (2015).
15. Jouny, M., Luc, W. & Jiao, F. General techno-economic analysis of $CO_2$ electrolysis systems. *Ind. Eng. Chem. Res.* 57, 2165-2177 (2018).
16. Israel, G. C., Martin, J. K. & Soper, F. G. 260. The kinetics of chlorohydrin formation. Part I. The reaction between hypochlorous acid and allyl alcohol in aqueous solution. *J. Chem. Soc.* 1282-1285 (1950).

17. Perez-Gallent, E. et al. Electroreduction of $CO_2$ to CO paired with 1,2-propanediol oxidation to lactic acid. toward an economically feasible system. *Ind. Eng. Chem. Res.* 58, 6195-6202 (2019).

18. Li, T., Cao, Y., He, J. & Berlinguette, C. P. Electrolytic $CO_2$ reduction in tandem with oxidative organic chemistry. *ACS Cent. Sci.* 3, 778-783 (2017).

19. Llorente, M. J., Nguyen, B. H., Kubiak, C. P. & Moeller, K. D. Paired electrolysis in the simultaneous production of synthetic intermediates and substrates. *J. Am. Chem. Soc.* 138, 15110-15113 (2016).

20. Wang, Y. et al. Simultaneous electrosynthesis of syngas and an aldehyde from $CO_2$ and an alcohol by molecular electrocatalysis. *ACS Appl. Energy Mater.* 2, 97-101 (2019).

21. Bajada, M. A. et al. A precious-metal-free hybrid electrolyzer for alcohol oxidation coupled to $CO_2$-to-syngas conversion. *Angew. Chem. Int. Ed.* 59, 15633-15641 (2020).

22. Kresse, G. & Joubert, D. From ultrasoft pseudopotentials to the projector augmented-wave method. *Phys. Rev.* B 59, 1758-1775 (1999).

23. Kohn, W. & Sham, L. J. Self-consistent equations including exchange and correlation effects. *Phys. Rev.* 140, A1133-A1138 (1965).

24. Kresse, G. & Furthmüller, J. Efficient iterative schemes for ab initio total-energy calculations using a plane-wave basis set. *Phys. Rev.* B 54, 11169-11186 (1996).

25. Monkhorst, H. J. & Pack, J. D. Special points for Brillouin-zone integrations. *Phys. Rev.* B13, 5188-5192 (1976).

26. Zhou, B. et al. Highly efficient binary copper-iron catalyst for photoelectrochemical carbon dioxide reduction toward methane. *Proc. Natl. Acad. Sci.* 117, 1330-1338 (2020).

27. Grimme, S., Antony, J., Ehrlich, S. & Krieg, H. A consistent and accurate ab initio parametrization of density functional dispersion correction (DFT-D) for the 94 elements H—Pu. *J. Chem. Phys.* 132, 154104 (2010).

28. Neugebauer, J. & Scheffler, M. Adsorbate-substrate and adsorbate-adsorbate interactions of Na and K adlayers on Al(111). *Phys. Rev.* B 46, 16067-16080 (1992).

TABLE 3

Electrochemical systems to produce EO from $CO_2$.

| | Redox-mediated paired system | Two independent electrolyzers | One electrolyzer |
|---|---|---|---|
| Cathode 1 | $CO_2$-to-$C_2H_4$ | $CO_2$-to-$C_2H_4$ | $CO_2$-to-$C_2H_4$ |
| Anode 1 | OER | OER | $Cl_2$ evolution reaction (for $C_2H_4$-to-EO) |
| $E_1^o$ (V) | 1.15 | 1.15 | 1.28 |
| Cathode 2 | ORR | HER | / |
| Anode 2 | $Cl_2$ evolution reaction (for $C_2H_4$-to-EO) | $Cl_2$ evolution reaction (for $C_2H_4$-to-EO) | / |
| $E_2^o$ (V) | 0.13 | 1.36 | / |
| $E_T^o$ (V)* | 1.28 | 2.51 | 1.28 |
| Advantages | Low theoretical reaction potential to produce EO from $CO_2$ All chambers are able to run in optimal conditions without cross-interference | All cells are able to run in optimal conditions without cross-interference | Low theoretical reaction potential to produce EO from $CO_2$ |
| Problems | / | High plant-gate levelized cost for producing EO | FE upper limitation of ~17% Cross-interference (carbonate formation) |

*$E_T^o = E_1^o + E_2^o$. When pH = 7, $E^o$ (standard reduction potential) of $H^+/H_2$, $O_2/H_2O$, $Cl_2/Cl^-$ and $CO_2/C_2H_4$ is −0.42, 0.81, 0.94 and −0.34 V, respectively.

Supplementary Information

The following supplementary information is provided with sections thereof being referred to above.

TABLE 4

Comparison of performance herein vs. that in the highest-performing prior report with the profitable plant-gate levelized cost

| Catalyst | Current density ($mA/cm^2$) | EO FE (%) | Full-cell EE (%) | Anodic half-cell EE (%) | Plant-gate levelized cost for EO ($)* | Reference |
|---|---|---|---|---|---|---|
| $BaO_x/IrO_2$ | 200 | 90 | 36% | 42% | 1460 (Calculated by full-cell data) | This work |
| Pure $IrO_2$ | 300 | 71 | 15% | 30% | 1486 (Calculated by half-cell data) | Science 368, 1228-1233 (2020). |

*Electricity cost of 10 cents/kWh (same in the compared reference).

TABLE 5

EO FEs using $BaO_x/IrO_2$ catalysts in different pH electrolytes

| pH of electrolyte | $HOC_2H_4Cl$ FE (%) | EO FE (%) |
|---|---|---|
| 3 | 8* | 0† |
| 5 | 55* | 0† |
| 7 | 91 | 89 |

* The decrease of $HOC_2H_4Cl$ FEs is due to the suppression of HOCl generation in acidic electrolyte, in which we will generate $Cl_2$ gas instead (Eq. S2 in Supplementary Note 1). Electrolyte pH is tuned by adding HCl in 2M KCl solution. Each reaction runs at 100 mA/cm$^2$ current density for 1 hour.
†No EO is produced because no $OH^-$ is generated in acidic catholyte (Eq. S4 in Supplementary Note 1) and thus the $HOC_2H_4Cl$ cannot be convert into EO (Eq. S5 in Supplementary Note 1).

TABLE 6

FEs of EO product in one electrolyzer to directly couple the cathodic $CO_2RR$ with the anodic EtOR to produce EO directly from $CO_2$ and water

| Notation | J (mA/cm$^2$) | EO faradaic efficiency (%) |
|---|---|---|
| One electrolyzer | 100 | 1.8 |
| | 200 | 1.9 |
| | 300 | 1.5 |

TABLE 7

$CO_2$ emissions of industrial processes for producing EO product

| Notation | $CO_2$ emissions* |
|---|---|
| Ethane-based process | 1.8-2.0 $t_{CO2}/t_{EO}$ |
| Naphtha-based process | 2.5-2.7 $t_{CO2}/t_{EO}$ |

*The $CO_2$ emissions for producing EO product = $CO_2$ emissions of fossil-fuel-to-$C_2H_4$ × $C_2H_4$ consumption of $C_2H_4$-to-EO × $CO_2$ emissions of $C_2H_4$-to-EO. In details, the $CO_2$ emissions of ethane-based process for $C_2H_4$ production, naphtha-based process for $C_2H_4$ production and air-based process for $C_2H_4$-to-EO conversion are 1.0~1.2 $t_{CO}/t_{C2H4}$, 1.8~2.0 $t_{CO}/t_{C2H4}$ and 0.9 $t_{CO2}/t_{EO}$, respectively[2]. The $C_2H_4$ consumption of the air-based process for $C_2H_4$-to-EO is 0.9 $t_{C2H4}/t_{EO}$ (Ref. 2).

TABLE 8

Emission factors in the case of ethylene oxide production in the direct oxidation process

| Emissions | Value ($t_{CO2}/t_{EO}$) |
|---|---|
| Thermal production | 0.17 |
| Electricity use | 0.16 |
| Direct emissions* | 0.55 |
| Total | 0.88 |

*Direct emissions are the results of undesired overoxidation of ethylene to $CO_2$.

TABLE 9

$CO_2RR$ product distributions in chamber 1 of the redox-mediated paired system

| J (mA/cm$^2$) | Voltage (V) | $C_2H_4$ (%) | CO (%) | $H_2$ (%) | Ethanol (%) | n-Propanol (%) | Acetate (%) | Formate (%) |
|---|---|---|---|---|---|---|---|---|
| 100 | −3.1 | 34 ± 3 | 32 ± 2 | 10 ± 2 | 15 ± 2 | 4.9 ± 1.0 | 2.3 ± 0.5 | 0.8 ± 0.2 |
| 200 | −3.4 | 47 ± 2 | 23 ± 3 | 7 ± 2 | 14 ± 2 | 4.1 ± 0.2 | 3.6 ± 0.4 | 1.2 ± 0.2 |
| 300 | −3.7 | 49 ± 2 | 16 ± 2 | 7 ± 2 | 14 ± 2 | 3.7 ± 0.2 | 5.5 ± 0.9 | 1.5 ± 0.3 |

TABLE 10

Comparison of $CO_2$-to-EO FEs of $BaO_x/IrO_2$ with those of the literature benchmark $IrO_2$ for producing EO directly from $CO_2$ and water

| Catalyst | $CO_2$ flow rate (sccm) | $CO_2$-to-$C_2H_4$ FE (%) | $C_2H_4$-to-EO FE (%) | $CO_2$-to-EO FE* (%) | Reference |
|---|---|---|---|---|---|
| $BaO_x/IrO_2$ | 3 | 25 ± 1 | 78 ± 2 | 19.5 | This work |
| | 6 | 46 ± 1 | 75 ± 1 | 34.5 | |
| | 25 | 48 ± 2 | 73 ± 2 | 35.0 | |
| | 50 | 49 ± 2 | 71 ± 1 | 34.8 | |
| $IrO_2$† | 3 | 27 | 2 | 0.5 | Ref. 1 |
| | 6 | 51 | 45 | 23.0 | |
| | 25 | 45 | 30 | 13.5 | |
| | 50 | 43 | 13 | 5.6 | |

*Total FE for $CO_2$-to-EO is calculated by multiplying the FE of $CO_2$-to-$C_2H_4$ conversion with that of $C_2H_4$-to-EO oxidation. The anodic $C_2H_4$ to-EO oxidation (at 300 mA/cm$^2$ current density) was directly supplied from a downstream of $CO_2RR$ electrolyser operating at a current density of 300 mA/cm$^2$. The active geometric area of the $CO_2RR$ electrolyser was 5 cm$^2$, whereas that of the $C_2H_4$-to-EO oxidation cell was 0.25 cm$^2$. The output gas stream contains $H_2$, CO, $C_2H_4$, and residual $CO_2$.
†Data are collected from the literature.

TABLE 11

Comparison of performance herein relative to that in the highest-performing prior reports of electrochemical paired systems that combine $CO_2$ reduction with anodic upgrading

| Cathodic $J_{partial}$ (mA/cm$^2$) | Anodic $J_{partial}$ (mA/cm$^2$) | Cathodic FE (%) | Anodic FE (%) | Reference |
|---|---|---|---|---|
| 147 | 213 | 49 | 71 | This work |
| 125 | 135 | 52 | 45 | Ref. 1 |
| 12 | 12 | 80 | 80 | Ref. 3 |
| 2.6 | 3.4 | 70 | 93 | Ref. 4 |
| 3.1 | 2.0 | 100 | 65 | Ref. 5 |
| 0.3 | 0.6 | 40 | 70 | Ref. 6 |
| 0.2 | 0.3 | 60 | 83 | Ref. 7 |

TABLE 12

Reactions in the systems in Table 11

| Cathodic reaction | Anodic reaction | Reference |
|---|---|---|
| $CO_2$-to-$C_2H_4$ | $C_2H_4$-to-EO | This work |
| $CO_2$-to-$C_2H_4$ | $C_2H_4$-to-EO | Ref. 1 |
| $CO_2$-to-CO | 1,2-Propanediol to lactic acid | Ref. 3 |
| $CO_2$-to-CO | Alcohols to aldehydes | Ref. 4 |
| $CO_2$-to-CO | Condensation of syringaldehyde and o-phenylenediamine to give 2-(3,5-dimethoxy-4-hydroxyphenyl)-benzimidazole | Ref. 5 |
| $CO_2$-to-CO | Benzyl alcohol oxidation to benzaldehyde | Ref. 6 |
| $CO_2$-to-CO | Glycerol to glyceraldehyde | Ref. 7 |

Supplementary Note 1: The electrosynthesis of ethylene oxide from ethylene via chlorine redox in neutral electrolyte. The chlorine evolution reaction (CER) occurs at the anode (Eq. S1), and this disproportionates into HOCl that converts $C_2H_4$ to ethylene chlorohydrin (Eqs. S2-S3). The HER at the cathodic side (Eq. S4) generates the stoichiometric amount of $OH^-$ to convert ethylene chlorohydrin to EO and regenerates the $Cl^-$ in the electrolyte via the subsequent combination of the two reaction streams (Eqs. S5-S7).

$$\text{Anode: } 2Cl^- \rightarrow Cl_2 + 2e^- \quad (S1)$$

$$\text{Anode: } Cl_2 + H_2O \leftrightarrow HOCl + HCl \quad (S2)$$

$$\text{Anode: } C_2H_4 + HOCl \rightarrow HOC_2H_4Cl \quad (S3)$$

$$\text{Cathode: } 2H_2O + 2e^- \rightarrow H_2 + 2OH^- \quad (S4)$$

$$\text{Mixing step: } HOC_2H_4Cl + OH^- \rightarrow C_2H_4O(\text{ethylene oxide}) + H_2O + Cl^- \quad (S5)$$

$$\text{Mixing step: } HCl + OH^- \rightarrow H_2O + Cl^- \quad (S6)$$

$$\text{Overall: } C_2H_4 + H_2O \rightarrow C_2H_4O(\text{ethylene oxide}) + H_2 \quad (S7)$$

Supplementary Note 2: Techno-economic assessment. To determine the economic potential of renewable-electricity-powered production of EO in chamber 2 from the $C_2H_4$ produced in chamber 1, we conducted a techno-economic assessment (TEA) based on a model modified from previous work. Below is the list of assumptions made for the TEA calculations in chamber 2.

1. The production capacity of the plant is one ton of EO per day.
2. The total cost of the electrolyzer is \$10,000 per $m^2$.
3. The price of electricity, unless otherwise stated, is 5 ¢/kWh.
4. The total cost of the catalyst and membrane makes up 5% of the total electrolyzer cost.
5. The faradaic efficiencies of $C_2H_4$-to-EO are 89, 90, and 84% at 100, 200, and 300 mA/$cm^2$.
6. In redox-mediated paired system, the full-cell voltages of 2.0, 2.2, and 2.4 V, respectively.
7. In two independent electrolyzers, the full-cell voltages of 3.2, 3.4, and 3.6 V, respectively.
8. The prices of EO and water are assumed to be \$1,400 and \$5 per ton, respectively[8,9].
9. The separation cost comprises two components: gas stripping cost for EO and $C_2H_4$ gas separation and recycle system. The combined cost of these two components is assumed to be 20% of the electricity cost.
10. Other operation costs are assumed to be 10% of the electricity cost.
11. The plant will be operational 19.2 hours a day.

Below is the model of the cost components used to calculate the plant-gate levelized cost of EO production (US\$ per ton of EO).

1. Capital cost, including electrolyzer, catalyst and membrane cost.
2. Maintenance cost.
3. Balance of Plant.
4. Product separation cost.
5. Electricity cost.
6. Input chemicals cost, including the cost of water consumed.
7. Other operational costs.

To calculate the above cost components, the following equations are used:

Electrolyzer cost(\$/ton of EO)=Capital recovery factor×Total cost of electrolyzer(\$)÷(Catalyst lifetime(year)×365(day/year)×Production of product (ton/day)) 1.

Total cost of electrolyzer(\$)=Total surface area needed($m^2$)×Price per $m^2$(here is \$10,000/$m^2$) 2.

Total surface area needed($m^2$)=Total current needed (A)÷Current density(A/$m^2$) 3.

Total current needed(A)=Plant capacity(ton/day)× number of electrons transferred in reaction×96, 485(C/mol)÷(Product molecular weight(ton/mol)×24(hour/day)×3600(second/hour)×faradaic efficiency(%)) 4.

Catalyst and membrane cost(\$/ton of EO)=5%×Total cost of electrolyzer(\$)÷(Catalyst lifetime(year)× 365(day/year)×Production of product(ton/day)) 5.

Capital recovery factor=Discount rate×(1+Discount rate)$^{Lifetime}$÷((1+Discount rate)$^{Lifetime}$−1) 6.

Electricity cost(\$/ton of EO)=Power consumed(kW)× 24(hour/day)×Electricity cost(\$/kWh)÷Plant capacity (ton/day) 7.

Power consumed(kW)=Total current needed(A)×Cell voltage(V)÷1,000(W/kW) 8.

Maintenance cost(\$/ton of EO)=Maintenance frequency×Maintenance factor(% of Capital cost)× Total capital cost(\$/ton of EO) 9.

Balance of plant(\$/ton of EO)=Balance of plant factor(%)×Capital cost(\$/ton of EO) 10.

Installation cost(\$/ton of EO)=Lang factor(%)×Capital cost(\$/ton of EO) 11.

Supplementary Note 3: Discussion on the electrochemical approaches to produce EO from $CO_2$. To date, two approaches have been developed to produce EO from $CO_2$ by electrochemical means: the first is to perform the reactions in two independent electrolyzers (Supplementary FIG. 33*a*), including one for $CO_2$RR coupled with the oxygen evolution reaction (OER), and another for EtOR coupled with the HER; the second is to directly couple the cathodic $CO_2$RR with the anodic EtOR in a paired or integrated electrolyzer configuration (FIG. 33*b*).

However, the first approach requires an added theoretical reaction potential of 1.23 V (FIG. 18*a*), resulting in an additional \$110/$t_{EO}$. The $H_2$ produced (0.045 $t_{H2}$/tEO or \$90/$t_{EO}$) does not compensate for the cost introduced by the additional reaction potential. The second approach—direct coupling—offers a low voltage to produce EO from $CO_2$ (FIG. 33*b* and Table 3), but the current matching required in such paired or integrated electrolyzer configuration limits the anodic EO FE to an upper ~17%. The undesirable cross-interference also restricts the EO FE to an impractical 2% due to the completely quenched cathodic $OH^-$ by carbonate formation (Table 6).

In more detail, the redox-mediated paired system combines a membrane electrode assembly configuration (chamber 1 for $CO_2$RR) and a flow cell configuration (chamber 2 for EtOR) in order to achieve the best performance for each reaction (Supplementary FIG. 32). In chamber 1, $CO_2$-to-$C_2H_4$ reduction occurs as the cathodic reaction with OER in anodic side (Eqs. S8-S10). The oxygen reduction reaction (ORR) was fed by air at the cathodic side in chamber 2 (Eq.

S11). These reactions are connected by the $H_2O/O_2$ mediator that cycles between OER at the anode of chamber 1 and ORR at the cathode of chamber 2 (Eqs. S9 and S11). Chamber 1 will oxidize five more moles of $H_2O$ in the mediator (Eq. S18) in order to supply sufficient ethylene for the downstream $C_2H_4$-to-EO conversion in chamber 2 to produce one mole of EO.

In chamber 1:

$$\text{Cathode: } 2CO_2+12H^++12e^-\rightarrow C_2H_4+4H_2O \quad (S8)$$

$$\text{Anode: } 6H_2O\rightarrow 3O_2+12H^++12e^- \quad (S9)$$

$$\text{Overall: } 2CO_2+2H_2O\rightarrow C_2H_4+3O_2 \quad (S10)$$

In chamber 2:

$$\text{Cathode: } \tfrac{1}{2}O_2(\text{fed by air})+H_2O+2e^-\rightarrow 2OH^- \quad (S11)$$

$$\text{Anode: } 2Cl^-\rightarrow Cl_2+2e^- \quad (S12)$$

$$\text{Anode: } Cl_2+H_2O\leftrightarrow HOCl+HCl \quad (S13)$$

$$\text{Anode: } C_2H_4+HOCl\rightarrow HOC_2H_4Cl \quad (S14)$$

$$\text{Mixing step: } HOC_2H_4Cl+OH^-\rightarrow C_2H_4O+H_2O+Cl^- \quad (S15)$$

$$\text{Mixing step: } HCl+OH^-\rightarrow H_2O+Cl^- \quad (S16)$$

$$\text{Overall: } C_2H_4+\tfrac{1}{2}O_2\rightarrow C_2H_4O \quad (S17)$$

In the $H_2O/O_2$ mediator (combining Eq. S9 and eq. S11):

$$\text{Overall: } 5H_2O\rightarrow \tfrac{5}{2}O_2+10H^++10e^- \quad (S18)$$

Supplementary Note 4: Theoretical FE of EO produced from $CO_2$ in one electrolyzer. To calculate the theoretical FE of EO produced from $CO_2$ in one electrolyzer (FIG. 33*b*), the following equations are used:

$$\text{The theoretical EO FE}=\text{Electronic imbalance factor}\times CO_2\text{-to-}C_2H_4\text{ FE (\%)}\times C_2H_4\text{-to-EO FE (\%)} \quad 1.$$

$$\text{Electronic imbalance factor}=\text{Moles of required electrons for } C_2H_4\text{-to-EO}\div\text{Moles of required electrons for } CO_2\text{-to-}C_2H_4 \quad 2.$$

Therefore, for the upper limitation of the EO FE:

$$\text{The FE}=(2\div 12)(\text{Electronic imbalance factor})\times 100\%\ (CO_2\text{-to-}C_2H_4\text{ FE})\times 100\%\ (C_2H_4\text{-to-EO FE})=16.7\%$$

SUPPLEMENTARY REFERENCES

1. Leow, W. R. et al. Chloride-mediated selective electrosynthesis of ethylene and propylene oxides at high current density. *Science* 368, 1228-1233 (2020).
2. Boulamanti, A. & Moya, J. A. Energy efficiency and GHG emissions: Prospective scenarios for the chemical and petrochemical industry. DOI: 10.2760/630308 (2017).
3. Pérez-Gallent, E. et al. Electroreduction of $CO_2$ to CO paired with 1,2-propanediol oxidation to lactic acid. toward an economically feasible system. *Ind. Eng. Chem. Res.* 58, 6195-6202 (2019).
4. Li, T., Cao, Y., He, J. & Berlinguette, C. P. Electrolytic $CO_2$ reduction in tandem with oxidative organic chemistry. *ACS Cent. Sci.* 3, 778-783 (2017).
5. Llorente, M. J., Nguyen, B. H., Kubiak, C. P. & Moeller, K. D. Paired electrolysis in the simultaneous production of synthetic intermediates and substrates. *J. Am. Chem. Soc.* 138, 15110-15113 (2016).
6. Wang, Y. et al. Simultaneous electrosynthesis of syngas and an aldehyde from $CO_2$ and an alcohol by molecular electrocatalysis. *ACS Appl. Energy Mater.* 2, 97-101 (2019).
7. Bajada, M. A. et al. A precious-metal-free hybrid electrolyzer for alcohol oxidation coupled to $CO_2$-to-syngas conversion. *Angew. Chem. Int. Ed.* 59, 15633-15641 (2020).
8. "Ethylene oxide (EO) prices and information", (ICIS Ltd., 2011). https://www.icis.com/explore/resources/news/2007/11/05/9075771/ethylene-oxide-eo-prices-and-pricing-information/
9. Bushuyev, O. S. et al. What should we make with $CO_2$ and how can we make it? *Joule* 2, 825-832 (2018).

We claim:

1. An electrocatalyst for selective anodic oxidation of an olefin reactant to produce ethylene halohydrin in a halide ion based electrolyte, the electrocatalyst comprising iridium oxide loaded with a period-6 metal oxide and provided on a substrate;

wherein the period-6 metal oxide has a loading between 0.5 wt % and 5 wt % with respect to the iridium oxide.

2. The electrocatalyst of claim 1, wherein the period-6 metal oxide comprises barium oxide, lanthanum oxide, cerium oxide, or bismuth oxide or a combination thereof.

3. The electrocatalyst of claim 1, wherein the period-6 metal oxide is barium oxide.

4. The electrocatalyst of claim 1, wherein the substrate comprises metal, carbon, or porous ceramic.

5. The electrocatalyst of claim 1, wherein the substrate comprises titanium.

6. The electrocatalyst of claim 1, wherein the substrate is in the form of a mesh, felt, foam, or cloth.

7. The electrocatalyst of claim 1, wherein the iridium oxide is provided as nanoparticles on the metal substrate.

8. The electrocatalyst of claim 1, wherein the substrate is in the form of a network of filaments defining openings, and the iridium oxide and period-6 metal oxide is deposited on the filaments and also forms a catalytic web extending across the openings.

9. The electrocatalyst of claim 1, wherein the halide ion comprises Cl and the halide ion based electrolyte is an aqueous KCl electrolyte.

10. The electrocatalyst of claim 1, wherein the loading of the period-6 metal oxide is between 1 wt % and 4 wt % with respect to the iridium oxide.

11. The electrocatalyst of claim 1, wherein the period-6 metal oxide is barium oxide and the iridium oxide is provided as nanoparticles on the substrate.

12. The electrocatalyst of claim 11, wherein the substrate is in the form of a network of filaments defining openings, and the iridium oxide and the barium oxide are deposited on the filaments and also form a catalytic web extending across the openings.

13. The electrocatalyst of claim 11, wherein the barium oxide has a loading between 1 wt % and 4 wt % with respect to the iridium oxide.

14. A method of manufacturing the electrocatalyst as defined in claim 1, comprising depositing iridium oxide onto a substrate to form an iridium oxide layer and loading a period-6 metal oxide with respect to the iridium oxide layer to form a loaded catalytic material.

15. The method of claim 14, wherein the loading is performed to provide between 2 wt % and 3.5 wt % loaded period-6 metal oxide with respect to the iridium oxide layer, and further comprising pre-treating the substrate prior to depositing the iridium oxide thereon, and wherein the pre-treating comprises etching.

16. An electrochemical process for producing oxirane from olefin reactants, comprising:

contacting a halide based electrolyte with an anode located in an anodic compartment, the anode comprising the electrocatalyst as defined in claim 1;

generating a source of $OH^-$ at a cathode in a cathodic compartment;

contacting olefin reactants with the electrolyte to generate ethylene halohydrin; and contacting the ethylene halohydrin with a solution comprising $OH^-$ ions to form oxirane.

17. An electrochemical process for producing oxirane from olefin reactants, comprising:

contacting a chloride based electrolyte with an anode located in an anodic compartment, to generate hypochlorous acid;

contacting a catholyte with a cathode located in a cathodic compartment under oxygen reduction reaction (ORR) conditions;

contacting olefin reactants with at least a portion of the hypochlorous acid to generate ethylene chlorohydrin; and converting at least a portion of the ethylene chlorohydrin to oxirane;

wherein the anode comprises an electrocatalyst as defined in claim 1.

18. The process of claim 17, further comprising withdrawing the chloride based electrolyte from the anodic compartment and contacting the electrolyte with the olefin reactants to form an anodic solution comprising the ethylene chlorohydrin; and withdrawing a loaded cathodic solution comprising OH ions from the cathodic compartment and mixing the anodic solution with the loaded cathodic solution to react the ethylene chlorohydrin with the $OH^-$ to produce the oxirane.

19. An electrochemical process for producing oxirane from olefin reactants, comprising:

in a first electrochemical subsystem contacting $CO_2$ with an electroreduction catalyst to convert the $CO_2$ into olefins and contacting a first anolyte with an oxidation electrocatalyst, thereby generating olefin reactants;

in a second electrochemical subsystem, contacting a halide based electrolyte with an electrocatalyst to produce HOX species, wherein X is a halide, and contacting a catholyte with a cathodic catalyst;

contacting at least a portion of the halide based electrolyte comprising the HOX species with at least a portion of the olefin reactants to form ethylene halohydrin; and contacting the ethylene halohydrin with OH ions to form oxirane;

wherein the electrocatalyst in the second electrochemical subsystem comprises the electrocatalyst as defined in claim 1.

20. The process of claim 19, wherein the first anolyte comprises water and the oxidation electrocatalyst causes generation of oxygen; the first anolyte is circulated through a first anodic compartment that accommodates the oxidation electrocatalyst; the electroreduction catalyst is copper based and is provided on a PTFE gas diffusion membrane; the oxidation electrocatalyst comprises $IrO_2$; the oxidation electrocatalyst and the electroreduction catalyst are separated by and in contact with an anion exchange membrane; the second electrochemical subsystem comprises an air conduit for passage of air for contacting a first side of the cathodic catalyst, and a cathodic compartment receiving the catholyte and allowing contact thereof with a second side of the cathodic catalyst; the catholyte comprises water and is circulated through the cathodic compartment; the catholyte withdrawn from the cathodic compartment provides a source of the $OH^-$ ions used to contact the ethylene halohydrin to form the oxirane; a first portion of the catholyte withdrawn from the cathodic compartment is flowed for addition to the ethylene halohydrin, and a second portion is recirculated through the cathodic compartment; the halide based electrolyte comprising the HOX species is removed from an anodic compartment of the second electrochemical subsystem and supplied into a vessel along with at least a portion of the olefin reactants from the first electrochemical subsystem to form an anodic electrolyte mixture; a first portion of the anodic electrolyte mixture is supplied from the vessel into the anodic compartment as at least part of the halide based electrolyte; a second portion of the anodic electrolyte mixture is removed from the vessel and contacted with the OH— ions to form the oxirane; and the electrocatalyst of the second electrochemical subsystem comprises iridium oxide, cobalt oxide, platinum, platinum oxide, palladium or palladium oxide.

* * * * *